United States Patent [19]

Johdai et al.

[11] Patent Number: 5,037,083

[45] Date of Patent: Aug. 6, 1991

[54] SHEET STORING APPARATUS FOR SHEETS EJECTED FROM A COPYING MACHINE AND A METHOD OF CONTROLLING IT

[75] Inventors: Akiyoshi Johdai; Hideo Muramatsu, both of Osaka; Takeshi Yoshikai, Minokamo, all of Japan

[73] Assignee: Minolta Camera Kabushiki Kaisha, Osaka, Japan

[21] Appl. No.: 400,674

[22] Filed: Aug. 30, 1989

[30] Foreign Application Priority Data

Aug. 31, 1988 [JP] Japan ..... 63-217309

[51] Int. Cl.[5] ..... B65H 29/20

[52] U.S. Cl. ..... 271/288; 271/176; 271/270; 355/316

[58] Field of Search ..... 271/176, 288, 270; 355/316

[56] References Cited

U.S. PATENT DOCUMENTS

| | | | |
|---|---|---|---|
| 3,510,125 | 5/1970 | Krueger et al. | 271/10 |
| 3,947,018 | 3/1976 | Stange | 271/99 |
| 4,073,391 | 2/1978 | O'Brien et al. | 214/65 |
| 4,371,155 | 2/1983 | Astero et al. | 270/53 |
| 4,408,756 | 10/1983 | Miyashita | 271/288 |
| 4,537,497 | 8/1985 | Masuda | 355/14 R |
| 4,573,789 | 3/1986 | Wada | 355/14 SH |
| 4,702,589 | 10/1987 | Ito | 355/14 SH |
| 4,914,485 | 4/1990 | Emori | 271/288 X |

FOREIGN PATENT DOCUMENTS

| | | |
|---|---|---|
| 57-72537 | 5/1982 | Japan . |
| 59-177232 | 10/1984 | Japan . |
| 61-103165 | 5/1986 | Japan . |
| 61-54691 | 11/1986 | Japan . |

*Primary Examiner*—Richard A. Schacher

*Attorney, Agent, or Firm*—Willian, Brinks, Olds, Hofer, Gilson & Lione

[57] ABSTRACT

A sheet storing apparatus which is attachable to a copying machine and a method of controlling it, wherein sheets ejected from the copying machine one after another are stacked in order. A detector for detecting the condition of the sheet transportation is installed in a sheet transporting section thereof, and a control section controls the timing of driving a sheet storing section, a sheet transporting section and a sheet aligning section, based on an output of the detector and data on the speed of the sheet transportation in the copying machine. The control section has a timer for determining the timing of driving each section, and the value of the timer is adjusted in accordance with the data on the speed of the sheet transportation.

12 Claims, 37 Drawing Sheets

40
50
60
70
70a
SE1
61b
26
61a
65
62
77
75
72
69
74
73a
73
73b
80
70b
71
70c
78
2
51
89
76
79
82
SE2
66
30
92
c
79a
94
91b
91
91a
95a
170
179
116
1
SE3
123
163
99
122
165
160
93
120
105
100
95
161
90
110
125
121
M1
125a
124
97
d
98
SE4
159
97a
141
117
M2
140
130
143
5
153
131
152
151
132
142

SHEET STORING APPARATUS FOR SHEETS EJECTED FROM A COPYING MACHINE AND A METHOD OF CONTROLLING IT

BACKGROUND OF THE INVENTION

1. Field of the Invention

The present invention relates to a sheet storing apparatus and a method of controlling it, and more specifically, a sheet storing apparatus attachable to an image forming apparatus such as a copying machine, a laser Printer, etc., wherein sheets ejected from the image forming apparatus are stacked in order so that a duplex/composite copying operation or a stapling operation will be available.

2. Description of Related Art

Recently, by increasing request for an automatic copying operation, various types of refeeding apparatuses for a duplex/composite copying operation and various types of sheet storing apparatus such as a finisher having a function of stapling sheets with a stapler or a clip, etc. have been proposed and developed. Image forming apparatuses such as copying machines, laser printers, etc. vary in the system speed, that is, the speed of the sheet transportation. Accordingly, such sheet storing apparatuses are requested to comply with various system speeds of image forming apparatuses.

Generally, this type of sheet storing apparatus is controlled by a microcomputer, and the speed of the sheet transportation and the timing of driving each actuating member in the apparatus are changed with a switch or the like so that they are corresponding to the system speed of the image iorming apparatus. However, as types of image forming apparatuses are increasing in number, the number of switches for changing the speed and the timing is increasing, and inside the microcomputer, many programs corresponding to respective changes of the speed and the timing need to be prepared, resulting in the necessity of a microcomputer with a large capacity.

SUMMARY OF THE INVENTION

It is, therefore, an object of the present invention to provide a sheet storing apparatus and a method of controlling it, which are flexible enough to comply with various system speeds of image forming apparatuses, that is, a sheet storing apparatus wherein a switch for changing the speed of the sheet transportation and the driving timing is unnecessary and a microcomputer does not need to have a large capacity ior the storage of various programs.

To attain the object above, a sheet storing apparatus according to the present invention is an apparatus attachable to an image forming apparatus, wherein sheets ejected from the image forming apparatus are stored. The sheet storing apparatus comprises a sheet Path through which sheets are transported; means for detecting a sheet traveling in the sheet path; and control means for controlling each section in the sheet storing apparatus in accordance with an output of the detecting means. The control means comprises timer means for determining the timing of driving each section and means for adjusting the value of the timer means in accordance with the speed of the sheet transportation in the image forming apparatus. Further, the control means is a microcomputer repeating a program whose one routine is executed in a specified time. The timer means is a counter which counts the number of times of the microcomputer's repeating the program up to a specified number. The adjusting means adjusts the specified number to be counted up by the timer means. Furthermore, the sections which are controlled by the control means are storing means wherein sheets are stored, means for transporting sheets ejected from the image forming apparatus to the storing means and means for aligning sheets transported to the storing means.

With the constitution described above, the system speed of the image forming apparatus is sent from a microcomputer of the image forming apparatus, and the value is transmitted into a constant in the sheet transporting apparatus. The constant is used for operations with a reference value in order to calculate the respective timings of the storing means, the transporting means and the aligning means, and thus the timing of driving each means is determined. For instance, the transmission of the system speed of the image forming apparatus into a constant is performed by dividing the system speed by the value of the internal timer of the microcomputer in the sheet storing apparatus. Based on this constant, the reference value to be used in calculating the timings is adjusted. According to this control system, only one program is necessary, and a switch for changing the setting becomes unnecessary.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENT

Figure 1:
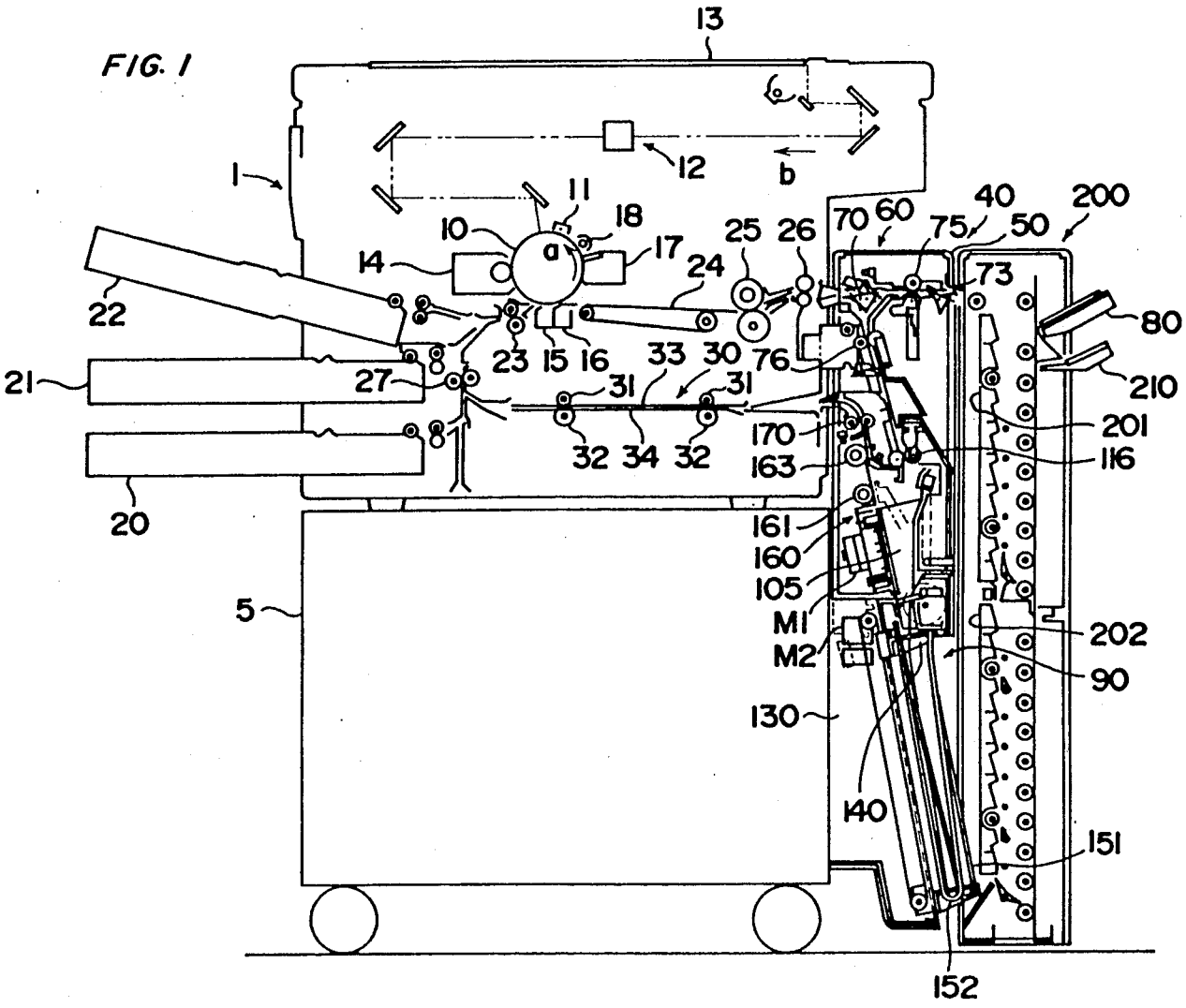
FIG. 1 is a schematic block diagram showing a sheet storing/refeeding unit, including a copying machine, according to the present invention.

An embodiment of the present invention will now be described with reference to the accompanying drawings wherein the invention is applied as a sheet storing-/refeeding unit for a copying machine.

[Copying Machine]

A copying machine 1, which is mounted on a desk 5, is designed to copy an original image on a sheet based on a well-known electrophotographic copying method. Inside the copying machine 1, a photosensitive drum 10, placed approximately at the center of the copying machine 1, is driven to rotate in the direction indicated by arrow (a). First, the photosensitive drum 10 is charged with an electrostatic charge by an electric charger 11, and then an optical unit 12 is moved in the direction indicated by arrow (b), by which the image of an original placed on an original glass table 13 is subjected to a slit exposure to be projected onto the photosensitive drum 10. The electrostatic latent image formed on the photosensitive drum 10 is developed into a corresponding toner image by a magnetic brush type of developing device 14, and then transferred onto a sheet by means of a transfer charger 15.

The photosensitive drum 10 is continued to rotate in the direction of arrow (a) even aiter a toner image is transferred so that the residual toner can be removed by a cleaning device 17 with a blade, and simultaneously the residual electric charge is erased by an eraser lamp 18 in order to prepare for the next copying operation.

Copying sheets which are loaded in automatic feeding cassettes 20, 21 and 22, are fed one by one selectively from the cassettes 20, 21 or 22. Then, a fed sheet is synchronized with a toner image formed on the photosensitive drum 10 by pairs of timing rollers 23, and is transported to a transfer section. After the transfer processing, the sheet is separated from tbe drum 10 by means of the ac corona discharge from a separation charger 16 and its stiffness. Further, the sheet is delivered to a fixing device 25 by a transport belt 24 which is provided with an air suction unit not shown in the drawings, where the toner image is fixed to the sheet, then the sheet is discharged from the copying machine 1 by pairs of discharge rollers 26.

In contrast, below the photosensitive drum 10, a refeeding path 30, through which sheets are fed from a storing/refeeding unit 40 as described in detail later to the timing rollers 23, is provided. lhe refeeding path 30 comprises pairs of transport rollers 31 and 32 as well as guide plates 33 and 34 disposed adjacent to the rollers 31 and 32. Copying sheets are fed into the refeeding path 30 with the copied image up at the time of a duplex copying mode, or with the upper surface down at the time of a composite copying mode which will be described later. The sheet is transported from the refeeding path 30 to the timing rollers 23 through Pairs of rollers 27, then is supplied to the transfer section.

[Storing/Refeeding Unit]

(Basic Constitution)

Figure 2:
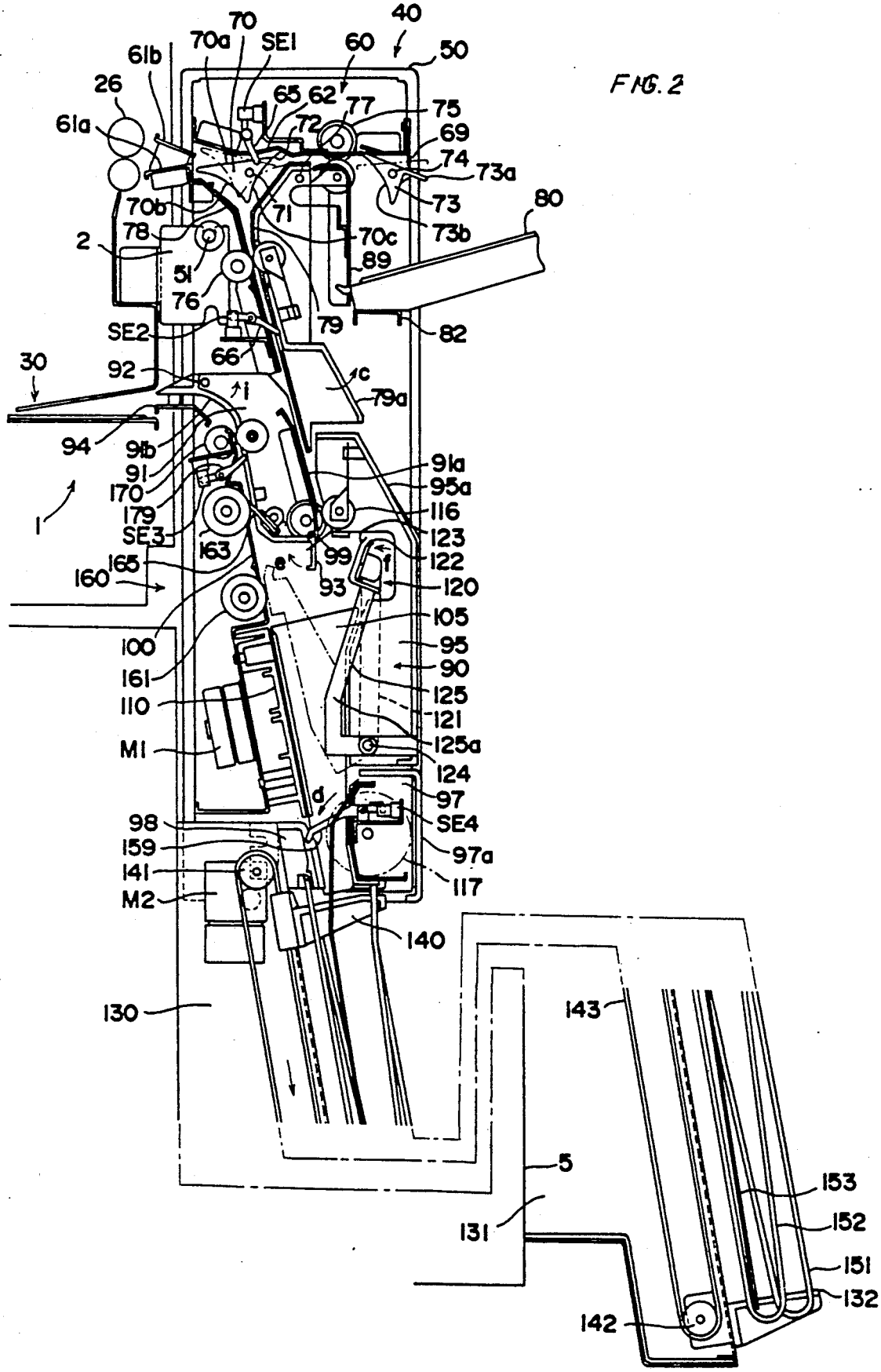
FIG. 2 is an internal composition showing the sheet storing/refeeding unit.

As shown in FIG. 2, the storing/refeeding unit 40 comprises an upper unit 50 having the iunctions of transporting, aligning, and refeeding sheets, and a lower unit 130 having the function of storing sheets. The upper unit 50 is suspended on U-shaped grooves formed at hooks 2 fixed to a front frame and a rear frame of the copying machine 1 by engaging a stepped shaft 51 thereof fixed to a front frame and a rear frame of the upper unit 50. The lower unit 130 is fixed to a side of the desk 5 with screws with its upper end portion slightly inserted in the upper unit 50.

The reason why the storing/refeeding unit 40 is separated into the two sub-units 50 and 130, both of which are independently detachable from the copying machine 1 and the desk 5, is to facilitate the removing operation of the sub-units 50 and 130 as well as to permit independent removal of the sub-units 50 and 130, which assures greater stability when the sub-units 50 and 130 are removed and placed on the floor.

The storing/refeeding unit 40 can be combined with selectively a sheet tray 80 or a sorter 200. FIG. 2 shows the condition where the storing/refeeding unit 40 is combined with the sheet tray 80. FIG. 1 shows the condition where the unit 40 is combined with the sorter 200. The construction and function of the sorter 200 are well known, i.e. to distribute sheets among a total of 20 bins 210 disposed one upon another. When the sorter 200 is used, the sheet tray 80 is placed in the uppermost bin position to function as a sheet tray in a non-sorting mode or as the first bin in a sorting mode.

The storing/refeeding unIt 40 comprises a sheet diverter section 60 for changing the transport form of sheets ejected from the copying machine 1, an intermediate storing section 90 for temporarily storing the sheets whose first surface has received a copied image in the duplex/composite copying mode, and a sheet refeeding section 160 for refeeding the sheets which have been stored in the intermediate storing section 90 toward the refeeding path 30 one after another for the image copying on the second surface.

(Constitution and Operation of the Diverter Section)

The sheet diverter section 60 comprises guide plates 61*a*, 61*b*, and 62, diverter pawls 70 and 73, pairs of ejection rollers 75, pairs of transport rollers 76, guide plates 78 and 79, etc. The diverter pawl 70 has an upper surface 70*a* for guiding sheets, and arched surfaces 70*b* and 70*c* to which a resin film 72 is adhered for guiding sheets. The film 72 has a tip portion In contact with the guide plate 62 to pass the sheet coming irom the left portion in FIG. 2 toward the right portion. The film 72 guides the sheet coming from the right portion toward the arched surface 70*c* of the diverter pawl 70. The diverter pawl 70 is pivoted on a shaft 71 and changed over between a position as illustrated by the solid line and a position as illustrated by the dashed line in FIG. 2 by the turning-on and turning-off operations of a solenoid. The other diverter pawl 73 has an upper surface 73*a* for guiding sheets and an arched surface 73*b*. The diverter pawl 73 is pivoted on a shaft 74 to be changed over between a position as illustrated in the solid line and a position as illustrated in the dashed line by the turning-on and turningoff operations of a solenoid. The rotating direction of the ejection rollers 75 can be changed forward or backward via a clutch by the turning-on and turning-off operations of a solenoid. lhe guide plate 79 is pivoted on a shaft 77 in the direction of arrow (c) to open the path for removing the jammed sheet, etc.

The sheet tray 80 is supported on a support plate 82, where the trailing end of sheets ejected through the ejection rollers 75 are regulated and aligned by means of a regulation plate 89. When the sheet tray 80 is attached to the storing/refeeding unit 40, the diverter pawl 73 is removed. When the sorter 200 is attached, the sheet tray 80 and the support plate 82 are removed to be replaced by the diverter pawl 73.

At the sheet path composed of the upper surface 70*a* of the diverter pawl 70 and the guide plate 62 as well as below the transport rollers 76 in the sheet path composed of the guide plates 78 and 79 are respectively provided with pbotosensors SEl and SEZ wbich respectively bave actuators 65 and 66 to detect a sheet passing. An eraser brush is arranged above the diverter pawl 73 to remove electrostatic charge of a sheet e]ected from the storing/reieeding unit 40.

The following describes the sheet passing from through the diverter section 60.

When a sheet is ejected in the one-sided copying mode or in the duplex/composite copying mode, the diverter pawls 70 and 73 are set respectively to the positions as illustrated by the solid line and the dashed line, and the ejecticn rollers 75 rotates forward so as to transport the sheet to the diverter pawl 73. When the sorter 200 is attached, the sheet transported from the copying machine 1 to the diverter section 60 through the ejection rollers 26 is guided by the guide plate 62, the upper surface 70*a* of the diverter pawl 70, and the upper surface 73*a* of the diverter pawl 73, and the sheet is provided with travel force by the ejection rollers 75 to be transported into the sorter 200. When the sheet tray 80 is attached, the diverter pawl 73 is removed from the storing/refeeding unit 40, and therefore the sheet is ejected from the ejection rollers 75 directly onto the sheet tray 80.

When the sheet whose first surface has received an image is ejected from the copying machine 1 in the duplex copying mode, the diverter pawl 70 is set to the position as illustrated by the dashed line, and the sheet is guided by the guide plate 78 and the arched surface 70*b* of the diverter pawl 70 to be transported from the transport rollers 76 toward the intermediate storing section 90 which will be described in detail later.

Further, when the sheet whose first surface has received an image is ejected from the copying machine 1 in the composite copying mode, the diverter pawl 70 is set to the position as illustrated by the solid line, and the ejection rollers 75 is rotated forward. The sheet is guided by the upper surface 70*a* of the diverter pawl 70 and the arched surface 73*b* of the diverter pawl 73. When a certain period has passed since the trailing end of the sheet was detected by the photosensor SE1, the forward rotation of the ejection rollers 75 is stopped. This period corresponds to the time required for the trailng end of the sheet to move a shaft 71, bearings 180 and 181 being disposed on both ends of the shaft 71 outside the front frame and the rear frame not shown in the drawings. An end of the shaft 71 is connected to a plunger 182 of a solenoid SLl through a lever 3. The solenoid SLl is fixed to the front frame not shown in the drawings through a bracket 184. When the solenoid SLl is turned off, the diverter pawl 70 is urged by a coil spring 5 wound around the shaft 71 to be put in a position as illustrated by the solid line in FIG. 2. When the solenoid SLl is turned on, the diverter pawl 70 is turned in the direction of arrow (p) to be put in a position as illustrated by the dashed line.

The other diverter pawl 73 is pivoted on a shaft 74 by disposing a bearing at the back end of the shaft 74 inside the frame not shown in the drawings and inserting a shaft portion 187*a* of a lever 187 in a hole 74*a* formed on the front end of the shaft 74. The diverter pawl 73 is connected to a plunger 188 of a solenoid SL2 through the lever 187. The solenoid SLZ is fixed to the rear frame not shown in the drawings througb a bracket 189. When the solenoid SLZ is turned off, the diverter Pawl 73 is urged by a coil spring 190 wound around the shaft portion 187*a* to be put in a position as illustrated by the dashed line in FIG. 2. When the solenoid SL2 is turned on, the diverter pawl 73 is turned in the direction of arrow (q) to be put in a position as illustrated by the solid line.

The axial movement of the diverter pawl 73 is regulated by engaging an elastic spacer 191 with the shaft 74. Therefore, to remove the diverter pawl 73, firstly pull out the spacer 191 from the shaft 74 in the direction of arrow (r) (downward), and then slide the diverter pawl 73 in the direction of arrow (s) (backward). With these operations, the engagement between the hole 74*a* and the lever shaft portion 187*a* is released. Finally, pull the front side of the diverter pawl 73 slightly upward and move the pawl 73 in the reverse direction of arrow (s) to remove the pawl 73. For mounting the diverter pawl 73, perform the above procedures in reverse order. With the above construction, the diverter pawl 73 can be easily mounted and removed without the use of tools.

(Mounting Arrangement of the Sheet Tray)

Figure 16:
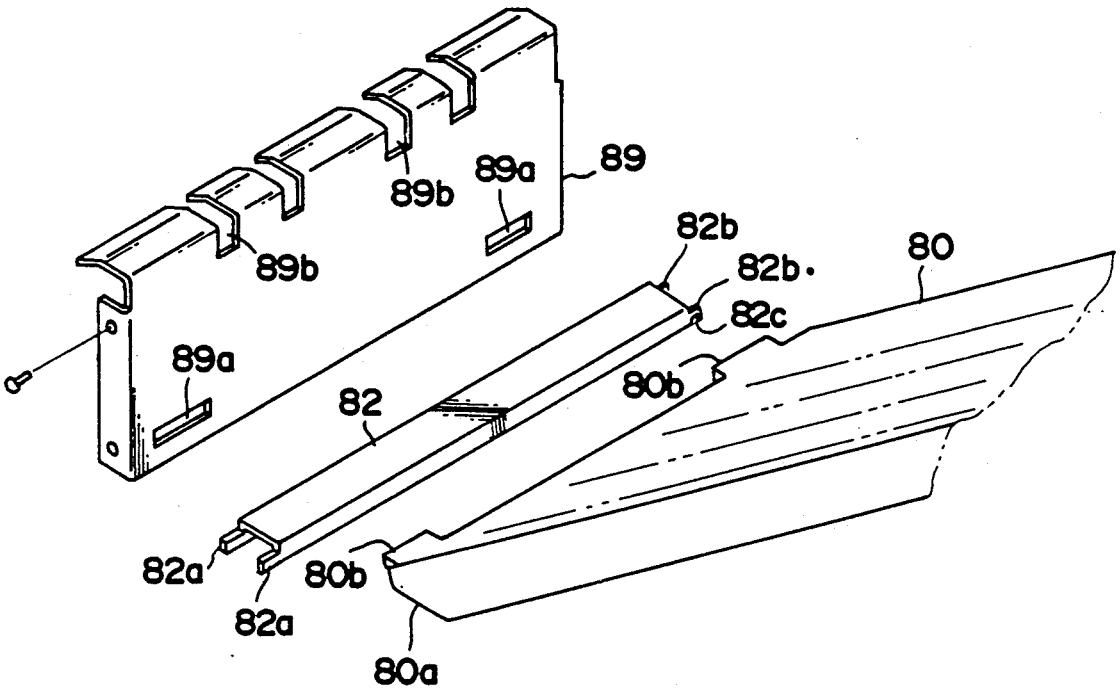
FIG. 16 is an exploded perspective view showing a mounting arrangement of a sheet tray and its support plate.
Figure 17:
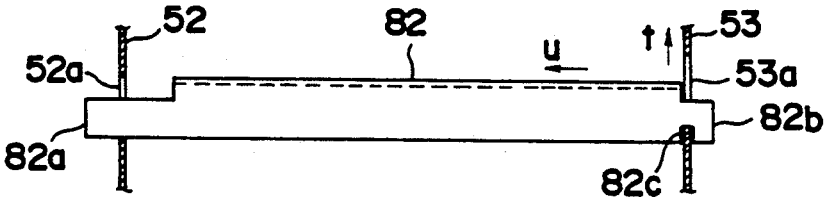
FIG. 17 is a vertical sectional view showing a mounting arrangement of the support plate.

As shown in FIG. 16 and 17, the support plate 82 is fitted between frames 52 and 53 by engaging each protrusion 82*a* on one end of the plate 82 with the opening 52*a* of the frame 52, engaging each protrusion 82*b* on the other end thereof with the opening 53*a* of the frame 53, and engaging a notch 82*c* of each protrusion 82*b* with the lower edge of the opening 53*a*. The regulation plate 89 is fitted between the frames 52 and 53 with screws. The sheet tray 80 is attached to the upper unit 50 as being appropriately positioned by putting its lower edge on the support plate 82, and engaging its protrusion 80*b* respectively with slits 89*a* of the regulation plate 89. The lower rollers of the ejection rollers 75 are placed in notchs 89*b* of the regulation plate 89.

In replacing the sheet tray 80 with the sorter 200, the sheet tray 80 can be removed by disengaging the protrusions 80*b* from the slits 89*a*. The support plate 82 can be removed by pushing the protrusions 82*b* upward in the direction of arrow (t) to disengage the plate 82 from the notch 82*c*, and then the plate 82 is moved in the direction of arrow (u) (to the front) to disengage the protrusions 82*b* from the rear frame 53. With the above construction, the sheet tray 80 and the support plate 82 can be easily mounted and removed without the use of tools.

When the sheet tray 80 is attached, the upward movement of the support plate 82 is regulated by the force of gravity of the plate 82 and the tray 80.

(Constitution and Operation of the Intermediate Storing Section)

The intermediate storing section 90 is composed of a segment belonging to the upper unit 50 and a segment belonging to the lower unit 130. In detail, the intermediate storing section 90 comprises a frame 91 having a guide surface 91*a*, a guide ilame 95, a base plate 100, side regulation plates 105 (refer to FIG. 3) for guiding both sides of a sheet, a support plate 110 for supporting the side regulation plates 105, guide frames 97 and 98, pairs of storing rollers 116, a paddle wheel 117, a pressure mechanism 120 for pressing the trailing portion of the sheet to be stored, a frame 131, a lower regulation plate 140 for regulating the lower edge of the stored sheet, first guide members 151 and 152 made of a wire material, second guide members 153 made of a wire material, a stepping motor Ml for driving the side regulation plates 105, and a geared motor M2 for driving the lower regulation plate 140, etc. In the portion where the guide frames 97 and 98 are placed, a photosensor SE4 having an actuator 159 is installed to detect whether the intermediate storing section 90 is stored with sheets.

The sheet carrying surface comprises the base plate 100, the support plate 110 and the guide frame 98 when sheets are stored in the intermediate storing section 90.

Figure 11C:
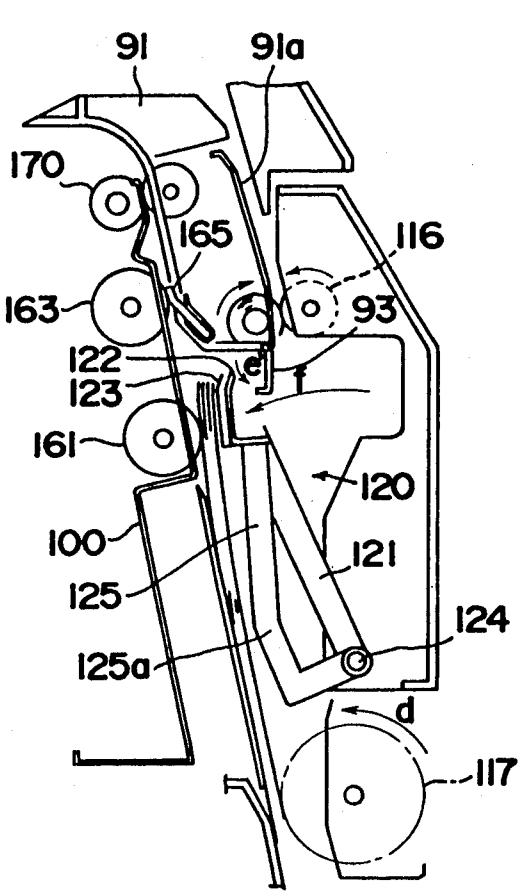
FIGS. 11*a*, 11*b* and 11*c* are explanatory drawings showing a sheet storing operation.
Figure 11B:
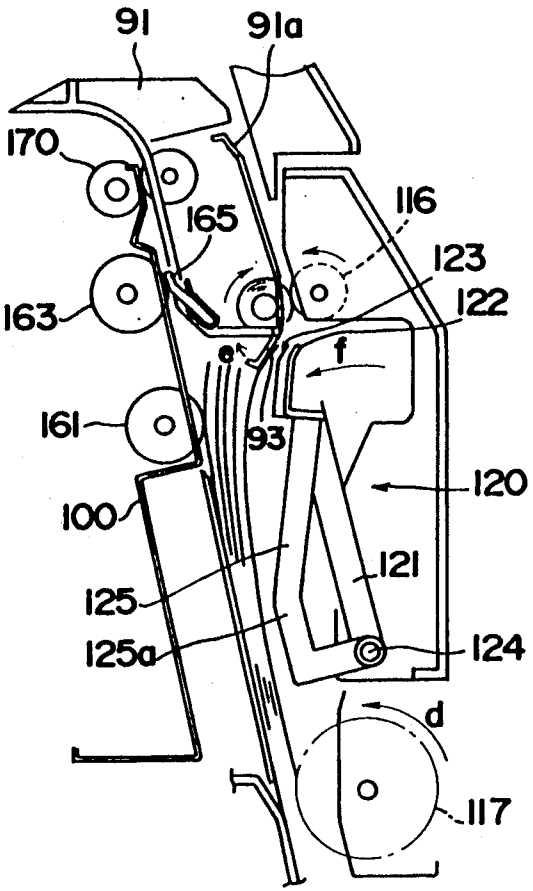
Figure 11A:
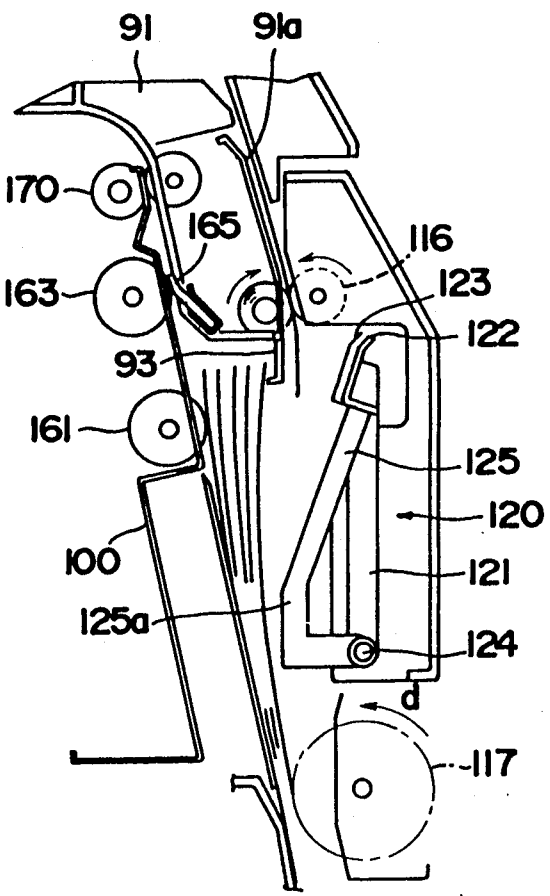

The lower regulation plate 140 is for regulating tbe lower edges (the leading ends for the storing) of the sheets stored as being fixed to a timing belt 143 extending between a pulley 141 of the geared motor M2 mounted to the frame 131 and a pulley 142 rotatably mounted to the frame 131. The lower regulation plate 140 can move vertically along the inclined surface of the frame 131 based on the forward or reverse rotation of geared motor M2 to be appropriately positioned in terms of height according to the size of the sheets to be stored. In this embodiment, the arrangement is such that B5-sized sheet can be transported on latitudinal positioned, A4-sized and B5-sized sheets can be transported on longitudinal positioned and latitudinal positioned respectively, and B4-sized and A3-sized sheets can be transported on longitudinal positioned, transport regulation being center based in all cases ln FIG. 2, the position of the lower regulation plate 140 shown by the solid line is a regulation position in the case of latitudinal positioned for B5 size, a minimum size, and the lower regulation plate 140 assumes this position as its home position, from which it is moved to a position corresponding to any relevant sheet size when the geared motor M2 is driven. The reason why the lower regulation plate 140 is moved in this way according to the size of sheets is that the upper edges of the stored sheets has to be held at a constant level in preparation for subsequent refeeding operation, the upper end level of the sheets being taken as a level at which the upper portion of each sheet is ready to touch a refeeding roller 161 as shown in FIGS. 11*a*, 11*b* and 11*c*.

Figure 13:
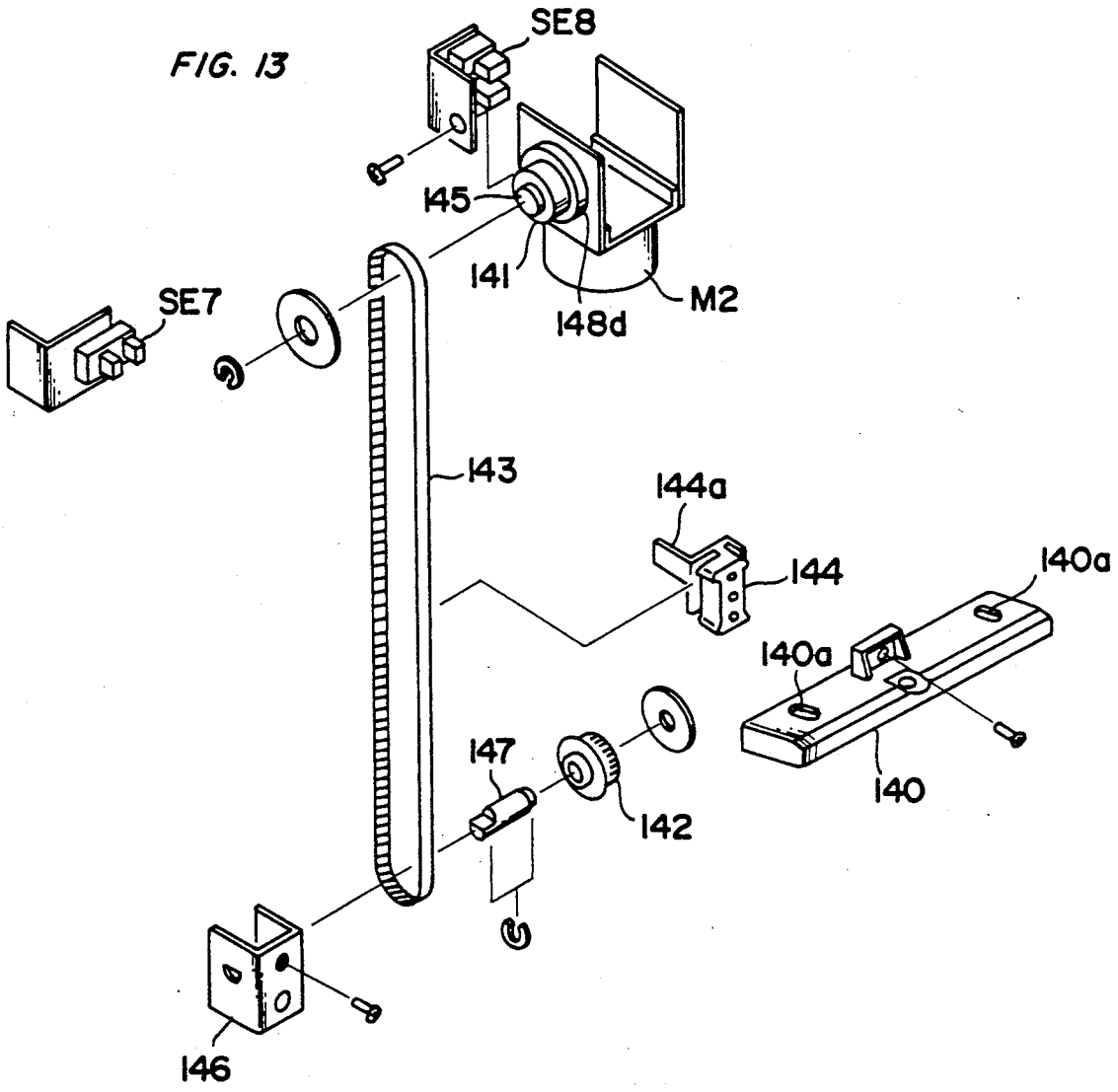
FIG. 13 is an exploded perspective view showing a drive mechanism for a lower regulation plate.

The following describes the drive mechanism of the lower regulation plate 140 with reference to FIG. 13.

The lower regulation plate 140 is linked to the timing belt 143 via a slide member 144. The slide member 144 is guided vertically along a slit formed on the inclined surface of the frame 131. A protrusion 144*a* formed on the slide member 144 disturbs the optical axis of a photosensor SE7 when the lower regulation plate 140 is positioned at the uppermost home position, and thereby the position of the lower regulation plate 140 is detected. An output pulley 141 is fitted to a shaft 145 of the geared motor M2, while an idle pulley 142 is supported at the frame 131 as being rotatable around a shaft 147 via a bracket 146. Tbe timing belt 143 is extended between the pulleys 141 and 142 as mentioned above.

As shown in FIGS. 14*a* through 14*d*, the geared motor M2 has a worm gear 148*a* and a pulse-generating disk 149 fixed to a drive shaft of the motor M2, a helical gear 148*b* engaging with the worm gear 148*a*, an intermediate gear 148*c* fixed to the same shaft of the helical gear 148*b*, and a gear 148*d* rotatably supported around a pulley shaft 145 so as to engage with the intermediate gear 148*c*. The rotation force of the motor M2 is transmitted to the output pulley 141 via the gears 148*a* through 148*d*. Since the geared motor M2 employs a reduction mechanism comprising the worm gear 148*a* and the helical gear 148*b* in its drive system, even when the geared motor M2 is turned off with sheets put on the lower regulation plate 140, the lower regulation plate 140 is not displaced downward by the weight of the stored sheets.

The travel amount of the lower regulation plate 140 is detected by counting the rotation amount of the pulse-generating disk 149 fixed to the drive shaft by a photosensor SE8. The travel speed of the lower regulation plate 140 is made sufficient to move to the regulation position for any selected sheets size within a time from the start of the sheet feeding in the copying machine 1 to the passage of the trailing end of the sheet through the storing rollers 116 without regard to the position of the lower regulation plate 140. Therefore, it is not required to delay the sheet feeding for the attainment of moving the lower regulation plate 140 to the appropriate regulation position, which does not reduce the efficiency oi image copying procedures.

The paddle wheel 117 has a plurality of flexible radial fins around its rotating shaft as being rotatable in the direction of arrow (d) to exert supplementary transport force to each of the sheets transported irom the storing rollers 116 to the intermediate storing section 90. The tip of the paddle 117 is spaced a predetermined distance from the guide frame 98 so that if a small number of sheets are stored and there is little resistance to sheet transport, no more mobility than required is given to the sheets, each sheet being prevented from "crease" development thereon. If more than a predetermined number of sheets has been stored, the paddle wheel 117 will thereafter press the sheets strongly against the guide frame 98 as the stored sheets are increased in number and impart high mobility in proportion to the increase the number of sheets. Meanwhile, as described hereinafter, in the process of sheet refeeding, the paddle wheel 117 does not come into contact with the sheets when the number of sheets is decreased below a certain number, and there will be no transport resistance from the paddle wheel 117.

Figure 8:
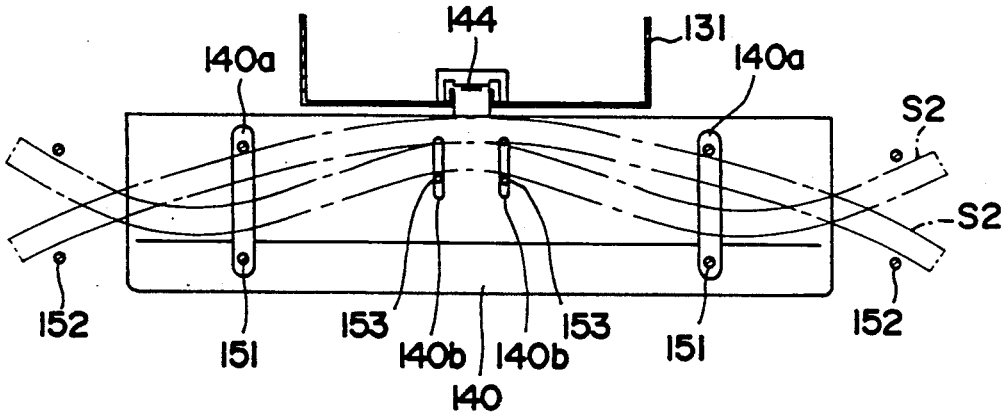

The first guides 151 and 152 are made of wires having a certain rigidity as being supported by the guide frames 97 and 98 at the upper position and supported by a holder 132 disposed at the lower edge of the frame 113. As shown in FIG. 8, tbe internal first guides 151 are extended through slits 140*a* formed on the lower regulation plate 140, while tbe external first guides 152 are placed outside the lower regulation plate 140, both of them being expanded outward as extending downward (refer to FIG. 10).

The second guides 153 are made of elastic wires as being supported by the frame 97 at the upper portion. The second guides 153 are extended through slits 140*b* of the lower regulation plate 140 as being placed in a position for guiding the approximate center portion of the sheet and movable in the direction of the sheet stacking.

Figure 7:
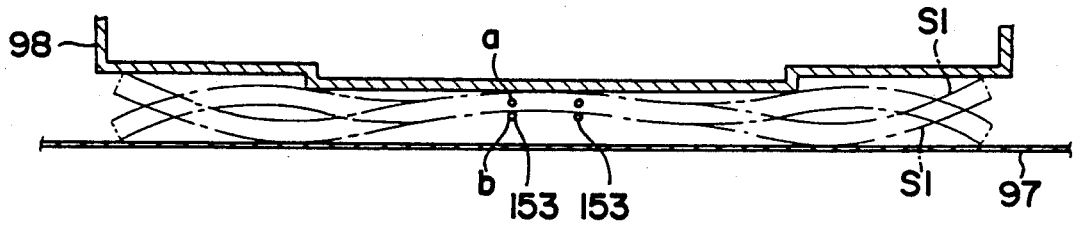
FIGS. 7, 8 and 9 are horizontal sectional views showing a sheet guide section of a lower unit respectively.

These guides 151, 152 and 153 are constructed of a wire material in order to minimize possible resistance against sheets transported and electrostatic adsorption force. They prevent stored sheets from slipping from the lower regulation plate 140 and also function to enable sheets to be loaded smoothly and prevent sheets from buckling. Concretely, as shown in FIG. 7, the first guides 151 and 152 exert no effect on the sheets when the sheets are in 85 size and in latitudinal positioned because the lower regulation plate 140 is set in a position as illustrated by the solid line in FIG. 2. The second guides 153 are placed in the position (a) when no sheets are stored, and the distance between the frame 98 and the second guides 153 is set narrower than the maximum thickness of the sheet stack. The second guides 153 are moved outward as the amount of stored sheets increases. The position (b) corresponds to the retreating position. The sheets S1 illustrated by the dashed lines correspond to those in curled conditions.

Figure 9:
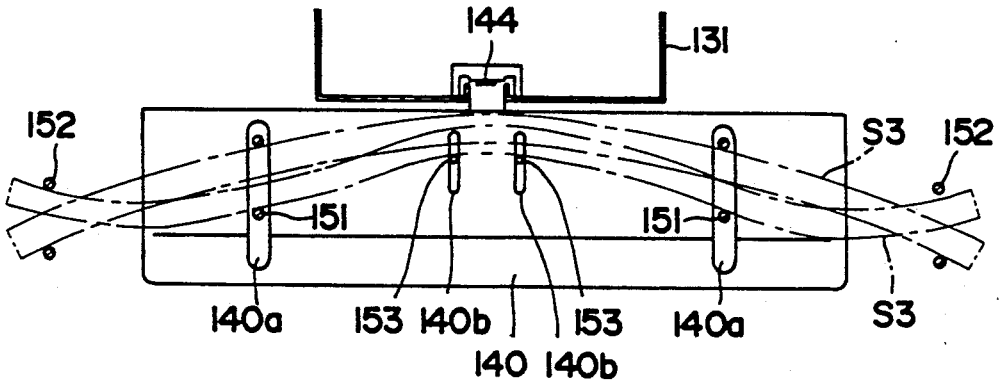

FIGS. 8 and 9 show respectively the condition wbere an A4-sized sheet is transported latitudinal positioned, and the condition where an A3-sized sbeet is transported longitudinal positioned. Since the first guides 152 are extended outward from the middle portion, an A3-sized sheet transported longitudinal positioned can be satisfactorily regulated on both sides. Of course the first guides 152 cooperate with the second guides 153 to stiffen the passing sheet, whereby even a curled sheets S2 and S3 can be properly stored without bending.

Figure 3:
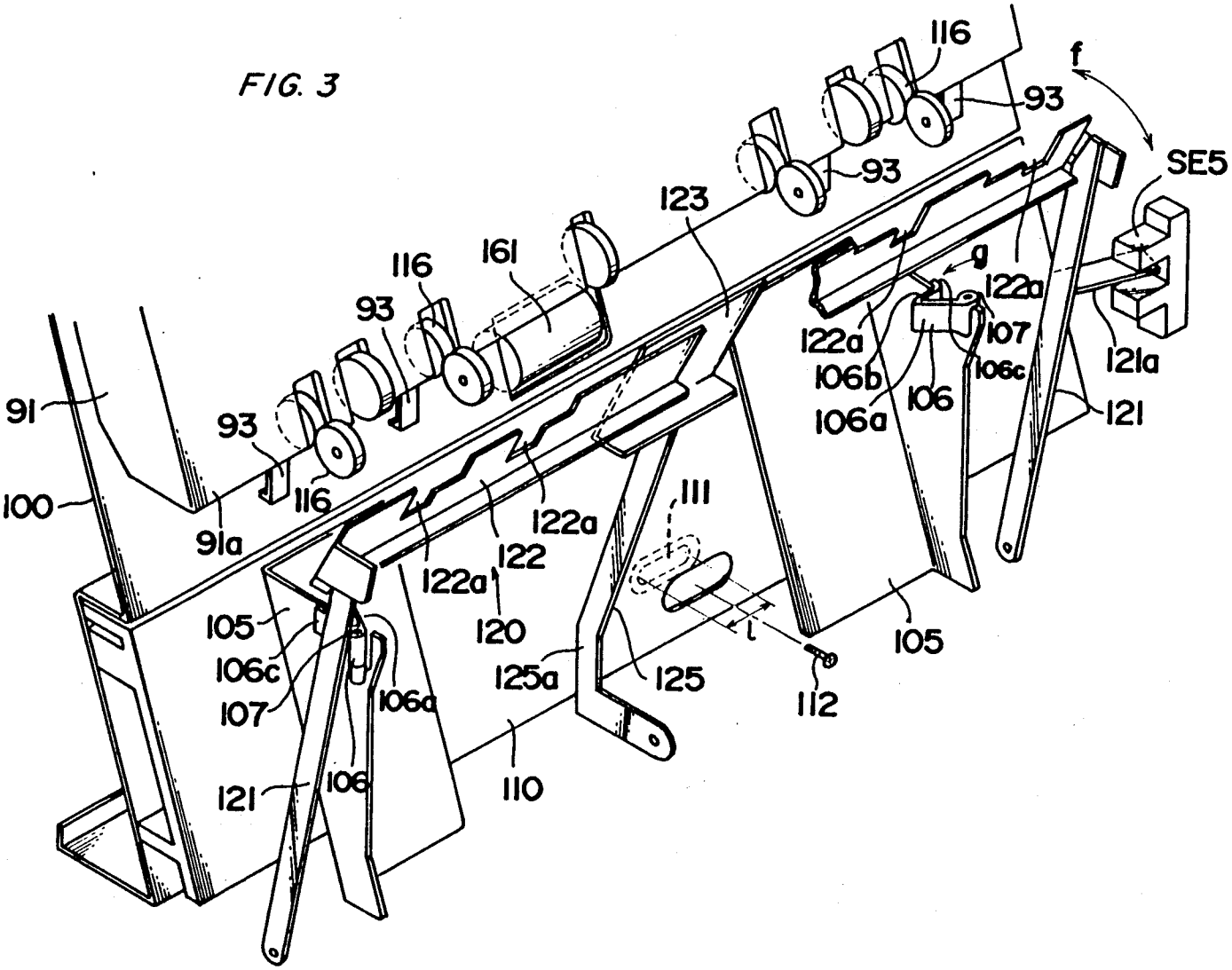
FIG. 3 is a perspective view showing a pressure mechanism.
Figure 5:
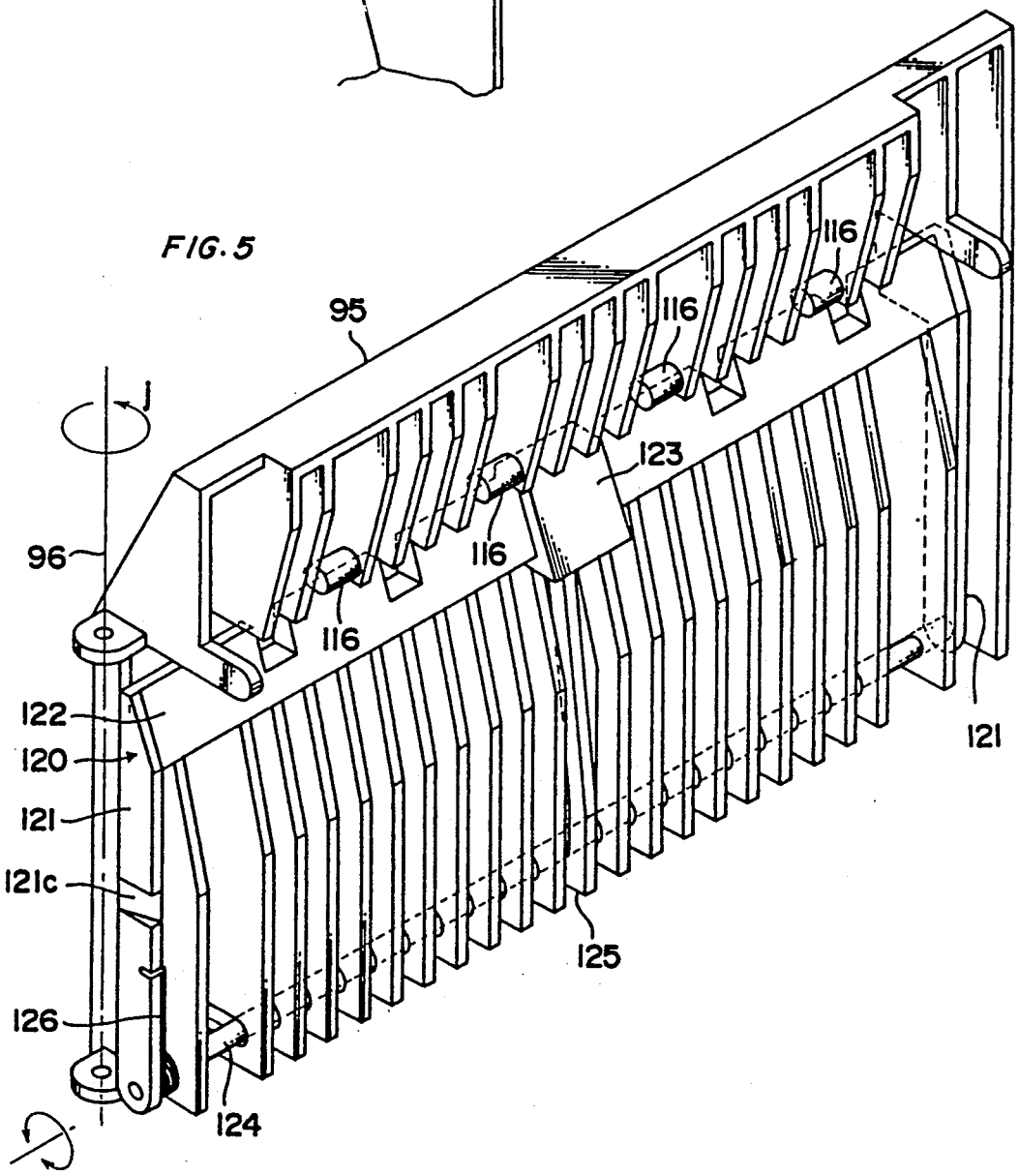
FIG. 5 is a perspective view showing tbe pressure mechanism and a guide frame.

As shown in FIGS. 3 and 5, the pressure mechanism 120 comprises arms 121 placed at both sides, a pressure plate 122 fitted to the tip portions oi the arms 121, a roller pressure plate 123 fixed to the presure plate 122 at a position corresponding to that of the refeeding roller 161 as described in detail later, and an arm 125 for preventing sheets from bending, which is positioned in an approximate center position. lhe pressure mechanism 120 is pivoted on the guide frame 95 via a shaft 124 supporting the arms 121 and turns between a position as illustrated by the solid line and a position as illustrated by the dashed line in FIG. 2 by turning on and off a solenoid. The sheet-bending prevention arm 125 inclines toward the support plate 110 as bending in a middle portion 125*a*. The bending middle portion 125*a* regulates the stored sheet to prevent the sheet from bending. The arm 125 also functions to stiffen the sheet in the storing direction when it is put in contact with the sheet.

As shown in FIG. 5, the guide frame 95 supporting the pressure mechanism 120 via its shaft 124 pivots in the direction of arrow (j) on a shaft 96 fitted to one end thereof, which enables the upper portion of the intermediate storing section 90 to be open. With the opening motion, the pressure mechanism 120 can retreat from the intermediate storing section 90. The arm 121 and the guide frame 95 is connected to each other by a torsion coil spring 126 wound around the shaft 124 to keep the pressure mechanism 120 at a position (home position) as illustrated by the solid line in FIG. 2. A protrusion 121*a* provided for the arm 121 can disturb the optical axis of a photosensor SE5 (refer to FIG. 3). Whether the Photosensor SE5 is on or off determines whether the pressure mechanism 120 is returned to the home position or driven to the position for pressing the trailing portion of the sheets.

Figure 6:
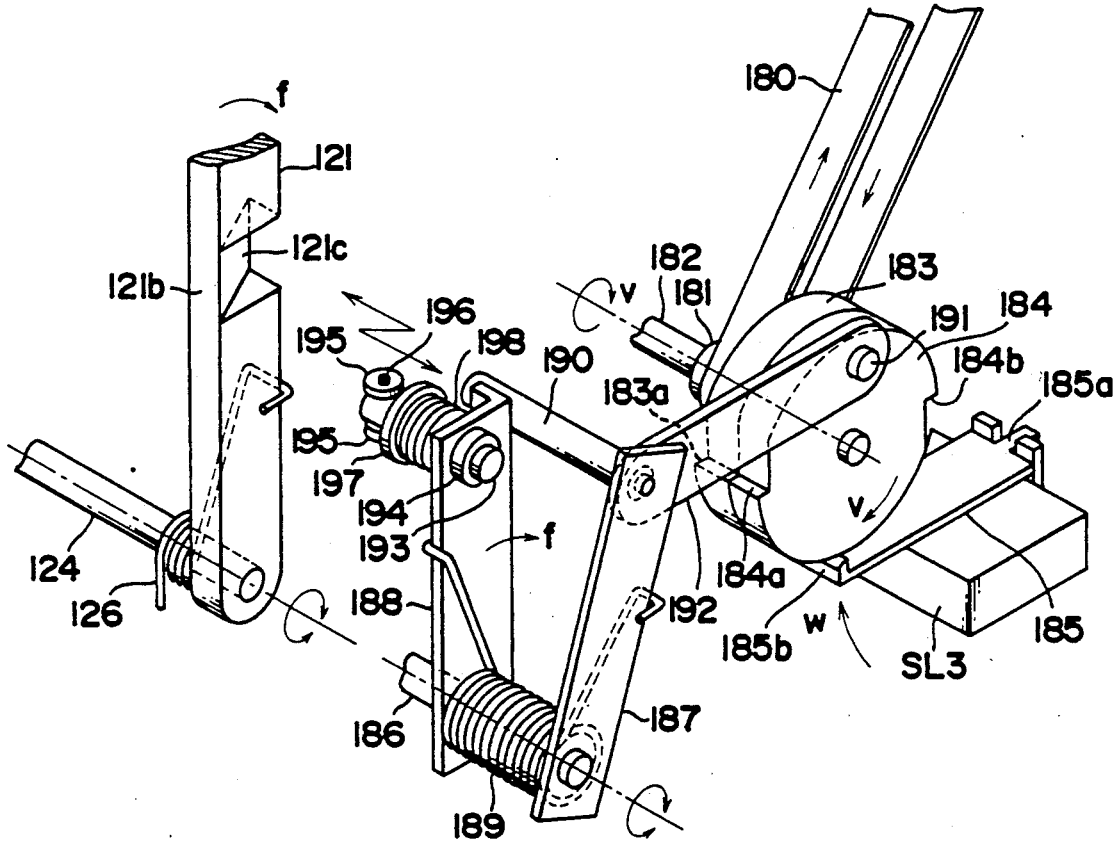
FIG. 6 is a perspective view showing a drive mechanism for the pressure mechanism.

The following describes the drive mechanism of the pressure mechanism 120 with reference to FIG. 6.

The drive source is the main motor for driving the sheet transporting mechanism in the storing/refeeding unit 40. The rotation force of the main motor is transmitted to a pulley 181 by means of a timing belt 180, whereby the pulley 181 is driven to rotate in the direction of arrow (v). A ratchet wheel 183 and a cam 184 are mounted around a shaft 182 and capable of rotating together with the pulley 181 via a spring clutch not shown in the drawings. Recesses 183*a*, 183*b*, 184*a* and 184*b* are formed on the peripheries of the ratchet wheel 183 and the cam 184 respectively. Incidentally, the recess 183*b* is not shown in FIG. 6. A solenoid SL3 has a lever 185 which is capable of pivoting on its one end 185*a*. In the off condition, the lever 185 is pivoted in the direction of arrow (w), and a pawl 185*b* comes into engagement with the recesses 183*a* and 184*a* or the recesses 183*b* and 184*b* to stop the rotation of the ratchet wheel 183 and the cam 184. Only when the pressure mechanism 120 is driven, the solenoid SL3 is momentarily turned on to rotate the ratchet wheel 183 by an angle of 180 degrees.

The lower edges of drive plates 187 and 188 are fitted to a shaft 186 located on the same axis as the shaft 124 of the pressure mechanism 120, and the drive plates 187 and 188 are capable of turning on the shaft 186. The drive plates 187 and 188 are urged in the direction for reducing the distance between them by means of a torsion coil spring 189 wound around the shait 186, and a pin 190 fitted to the tip portion of the drive plate 187 abuts against the side of the tip portion of the other drive plate 188. The drive plate 187 is connected to the periphery of the cam 184 via a link member 192 whose both ends are linked with pins 190 and 191. A sliding pin 193, which is fitted to the tip portion of the drive plate 188 via bearing 194, slides along the axial direction. A pin 196 pierces through the sliding pin 193 at the end at a right angle, and rollers 195 are rotatably fitted to both ends of the pin 196. A compressing coil spring 198 is wound around the sliding pin 193 between the drive plate 188 and a flange 197. With the elasticity of the spring 198, the sliding pin 193 and rollers 195 are biased toward the arm 121, while the rollers 195 are placed at the rear of the arm 121.

With the above construction, when the recess 184*a* of the cam 184 engages with the pawl 185*b* of the lever 185, the drive plates 187 and 188 are turned in the opposite direction of arrow (f) and positioned. The pressure mechanism 120 is urged in the opposite direction of arrow (f) by the elasticity of the torsion coil spring 126 to be in the position where the rear portion 121*b* of the arm 121 abuts against the rollers 195, i.e. the home position. When the solenoid SL3 is turned on to allow the lever 185 to disengage the pawl 185*b* from the recess 184*a*, the cam 184 is rotated in the direction of arrow (v) by angle of 180 degrees. At the same time, the drive plate 187 is forced to pivot in the direction of arrow (f), and accoringly the drive pate 188 that is connected to the plate 187 via the torsion col spring 189 pivots in the direction of arrow (f). Simultaneously, the rear portion 121*b* of the arm 121 is pressed by the rollers 195, and the pressure mechanism 120 is pivoted in the directonof arrow (f) to pres the trailing portion of the sheet transported to the intermediate storing section 90 against the base plate 100. The pressing position can be maintained by the engagement of the pawl 185*b* of the lever 185 with the recess 184*b* of the cam 184. Then the subsequent turning-on of the soldnoide SL3 puts the drive plates 187a nd 188 back to the home positions. Namely, the pressure mechansim 120 is set at the pressign positon or the home position, each time the soldinoid SL3 is turned on. It is noted that the main motor must be kept in a rotating condition for supplying the drive force during the above-mentioned operations.

To assure the above-mentioned operations, the elasticity of the torsion coil spring 189 for giving a combining force to the drive plates 187 and 188 is designed to be greater than that of the torsion coil spring 126 for giving a restoring force to the pressure mechanism 120. Furthermore, the elasticity of the torsion coil spring 189, which exerts a pressure onto the upper end portion of the sheets via the pressure mechanism 120 at the timeof sheet refeeding process as described in detail later, must be controlled. Therefore, the elasticity is determined in consideration of the reaction force of the restoration torsion coil spring 126 to exert an appropriate pressure onto the upper end portionn of the sheets against the refeeding roller 161, whereby ensuring the sheet refeeding. When the amount of sheets in the intermediate storing section 90 increases, the travel of the pressrue mechanism 120 in the directon of arow (f) is gradually reduced. At this time, the distance between the pin 190 and the drive plate 188 is increased and the elasticty of the torsion coil spring 189 increases to consequently increase the pressure of the pressrue mechanism 120 on the sheets.

The gradual reduction of the travel of the pressure mechanism 120 in proportion to the amount of stored sheets and the consequent increase or of the pressure assures a constant load, and an excellent sheet refeed is attained by virtue of the automatic adjustment of the sheet refeed pressure in accordance with the amount of stored sheets as described in detail below. Namely, when the sheets store in an approximate vertical stand position are fed one after another separately, the greater the amount of the stored sheets is, the greater the resistance against the sheet feed is assured. However, the torsion coil spring 189 exerts an increasing pressure onto the refeeding roller 161 in accordance with the increase of the stored sheets in amount, therefore an appropriate sheet feeding pressure is assured in conformity with the amount of the sheets.

As shown in FIG. 5, the pressure mechanism 120 can pivot in the directon of arrow (j) together with the guide frame 95 to open the intermediate storing section 90. While the section 90 is opened, the rear portion 121*b* of the arm 121 presses the rollers 195 to put the roller closer to the drive plate 188 together with the sliding pin 193 against the elasticty of the compression coil spring 198. With this operation, the engagement between the arm 121 and the rollers 195 is automatically released. When the pressure mechanism 120 is closed, therollers 195 slide along the inclined surface 121*c* formed on the arm 121 to engage with the rear portion 121*c*. To ensure the reengagement, thesolenoid SL3 is turned on when the presure mechanism 120 is closed together with the guide farme 95. With this arrangement, even when the reengagement is incomplete, the rollers 195 are securely moved to the rear portion along 121*b* the incilned surface 121*c*.

At the entrance of the intermediate storing sectoin 90, a separator 93 mounted to the guide frame 91 and a brush 99 for removing the electrostatic charge are arrangd. The separtor 93 is pivoted on a shaft to the frame 91 as hanging down perpendicularly by its own gravity force. The separtor 93 guides both sides of the sheet being transported into the storing section 90, and regulates the trailing end of the sheet in the storing direction (the upper end portion in the stored conditoin) toward the base plate 100 to prevent possible sheet jam at the entrance of the storing section 90. For this purpose, as shown in FIG. 3, the separtor 93 is placed between the storing rollers 116. The pressure plte 122 is formed with a notch 122*a* at the portion facing the separator 93 to prevent mutual interference.

As shown in FIG. 3, the side regulation plates 105 are movable on the support plate 110 in the laeral directin of the sheet, and connected to the reversible stepping motor M1 at the rear of the support plate 110. Namely, the side regulation plates 105 can bemoved in the lateral direction of the sheet by driving the steppign motor M1 forward and backward. The plates 105 have their home positions slightly outward at both sides of the sheet in a maximum size, and are moved from the position to the side regulation position corresponding to the sheet size.

The mounting position of the support plate 110 for supporting the side regulation plates 105 can be finely adjusted in the lateral direction of the sheet with respect to the base plate 100. Namely, the support plate 110 is formed with a slit 111 extending in the lateral directon of the sheet for fastening the screw 112. Within the slit 111 the fixing position of the plates 105 is finely adjusted in the lateral direction, and following this operation, the positions of the side regulation plates 105 are finely adjusted. This adjustment is for correcting the possible shear between the first copying image and the second copying image in the lateral direction of the sheet. This arrangement is effectrive particularly to the composite copying where two images are formed onto the identical surface of the sheet.

The following describes the sheet storing operation.

First, for the preparatory operation, the lower regulation plate 140 is moved to the positoin corresponding to the sheet size to be stored, and the side regulation plates 105 are moved to the position corresponding to both sides of the sheet. At the same time, the pressure mechanism 120 is set to the position as illustrated by the solid line in FIGS. 2 and 11*a*, while the storing rollers 116 and the paddle wheel 117 are started to rotate.

The sheet diverting section 60 selects the transport path for the sheet. The sheet transported from the transport roller 76 downward is provided withtravel force by the storing rollrs 116 to be transported into the intermedaite storing sectoin 90 as being erased of electrostatic charge by the electrostatic erase brush 99. When the leading end of the sheet is detected by the photosensor SE2, the side regulation plates 105 retreat slightly outward from teh side regulation positoin of the sheet. The sheet is transported into the intermediate storing section 90 as being guided by the separator 93 (refer to FIG. 11*a*). When a certain period has passed since the trailing end of the sheet being transported to the storing section 90 was detected by the photosensor SE2, the side regulation plates 105 are moved to the position corresponding to both sides of the sheet to align the sheet in the lateral direction. Then the pressure mechanism 120 is pivoted to the position as illustrated by the dashed line in the direction of arrow (f) to press the trailing portion of the sheet against the base plate 100 (refer to FIGS. 11*b* and 11*c*). At this time, as shown in FIG 11*b*, the trailing end of the sheet pivots the separator 93 in the direction of arrow (c), i.e. moves into the base plate 100 by pushing the separator 93 aside. The separator 93 is turned in the diretion of arrow (c') by means of its own force of gravity immediately after the trailing end of the sheets departs therefrom, and is returned to the vertical position by way of the notch 122*a* of the presure plate 122.

The timing of the side regulation plates 105 moving toward the side regulation position of the sheet is designed to be slightly delayed with respect to the timing of the leading end of the sheet reaching onto the upper surface of the lower regulation plate 140. The timing of the pressure mechanism 120 pressing the trailing portion of the sheet (reaching the position as illustrated by the chain line) is designed to be slightly delayed with respect to the timing of the side regulation plates 105 reaching the side regulation position of the sheet. With the timing control above, sheets are first aligned in the longitudial direction, and second aligned in the lateral direction. Finally the trailing end portion is moved toward the base plate 100, whereby a satisfactory sheete alignment can be achieved. Further every time a sheet is stored into the intermediate storing section 90 linking with the pressing operation, the middle portion of the arm 125 placed at the center position of the pressure mechanism 120 pushes the sheet to the support plate 110 and eliminates sheet bending to keep the sheets in a well-regulated condition.

After the first sheet is stored, first, the pressure mechanism 120 is put back to a position as illustrated by the solid line. When the leading end of the next sheet is detected by the photosensor SE2, the side regulation plats 105 are moved outward again, and the side regulation plates 105 and the pressure mechanism 120 are subsequently driven in the same timing as for storing the first sheet.

The procedure for controlling the above-mentioned operation is described in detail hereinafter.

As shown in FIG. 11*a*, when the pressure mechanism 120 is placed in the retreating position from the pressing position, the trailing end of the stored sheet is regulated by the separator 93 to prevent a sheet jam at the entrance of the intermediate storing section 90. This arrangement eliminates the fear of a sheet jam which may be caused by a collision between the sheet already stored and the sheet subsequently transported and also prevents an insertion of a sheet into the stored sheets which may result in disorder of paging. The separator 93 also functions as a guide plate at the time of storing sheets as mentioned to guarantee ensured sheet storing even when the sheets are curled. Therefore, there is no need to provide a large space above the intermediate storing section 90 in preparation for curled sheets.

Furthermore, in this embodiment, the side regulation plates 105 are also provided with side stoppers 106 having the same function as that of the separator 93. As shown in FIG. 3, each of the side stoppers 106 comprises an inclined surface 106*a*, a regulatin surface 106*b*, and a protrusion 106*c*, and is pivoted on a pin 107 at a notch formed on an upper portion of the correspondig side regulation plate 105. Each of the stoppers 106 is urged in the direction of arrow (g) by a spring member not shown in the drawings, and it is positioned by the pressure of the protrusion 106*c* on the corresponding side regulation plate 105 from outside.

In storing a sheet, the sheet passes along the inclined surface 106*a* of each side stopper 106 and when the pressure mechanism 120 is pivoted in the directon of arrow (f) to press the trailing portion of the sheet against the inclined surfaces 106*a*, the side stoppers 106 are moved in the opposite direction of arrow (g), whereby the trailing end of the sheet surpasses the side stoppers 106 to move toward the support plate 110. Immediately after the sheet has surpassed the side stoppers 106, the stoppers 106 are pivoted in the direction of arrow (g) by the elasticity of the spring member to be restored, and then regulate the trailing end of the stored sheet with the regulation surfaces 106*b*.

Figure 4:
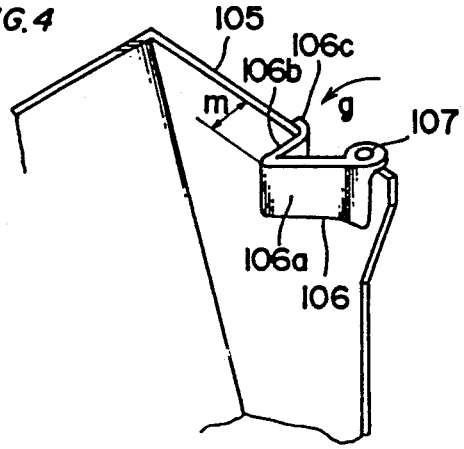
FIG. 4 is an enlarged perspective view showing a side stopper.

As shown in FIG. 4, assuming that the reciprocal travel distance of the side regulation plates 105 at the sheet storing time is (n), and the adjustment range oi the support plate 110 by means of the slit 111 is (1), the length (m) corresponding to the lateral direction of the regulation surface 106*b* of the sheet of each stopper 106 is designed to satisfy the equation:

$$m > (n+1)/2.$$

With this arrangement, even wben the support plate 110 is moved within the range (1) and the position of the side regulation plates 105 are finely adjusted, both sides of the stored sheet engages with the regulation surfaces 106*b* when the side regulation plates 105 are moved outward for storing sheets. For this reason, the sheet does not return to the inclined surfaces 106*a*, i.e. the trailing end of the sheet does not clog the sheet entrance The above-mentioned function is attained even by either the separators 93 or the stoppers 106. However, the combined use of the two as in this embodiment ensures the storing of sheets in a variety of size as well as sheets curled randomly.

(Constitution and Operation of the Reieeding Section)

The sheet refeeding section 160 is installed to feed sheets which got an image on their first surfaces and have been stored in the intermediate storing section 90 to the refeeding path 30 in the copying machine 1 one after another in the same order as being transported to the intermediate storing section 90 when a sheet refeeding signal is generated. More specifically, as shown in FIG. 2, the sheet refeeding section 160 comprises the base plate 100 which is also used as a receiving surface in the intermediate storing section 90, a refeeding roller 161 and separation roller 163 intermittently driven by a clutch to rotate, a separation pad 165 made of urethane rubber to be abutted to the separation roller 163, pairs of register rollers 170 intermittently driven by a clutch to rotate, etc. The sheet path to the refeeding path 30 comprises a guide surface 91b of the guide frame 91 and a guide plate 94. In front of the register rollers 170, a photosensor SE3 having an actuator 179 is installed. Further, the guide frame 91 is made pivotal in the direction oi arrow (i) to open the sheet path for removing jammed sheets, etc.

Each sheet is provided with transport force produced by the frictions between the sheet and the refeeding roller 161 and between the sheet and the separation rolIer 163. The pressure of the separation pad 165 on the separation roller 163 prevents a feed of a plurality of sheets in a body by the following reason. The friction $\mu 1$ between the separation roller 163 and each sheet is set greater than the friction $\mu 2$ among sheets. The friction $\mu 3$ between the separation pad 165 and each sheet is set greater than the friction $\mu 2$ among sheets but smaller than the friction $\mu 1$. These relations are expressed as follows:

$$\mu 1 > \mu 2$$

$$\mu 1 > \mu 3 > \mu 2$$

Now, the sheet refeeding operation will be explained with reference to FIGS. 12*a* through 12*d*.

Figure 12A:
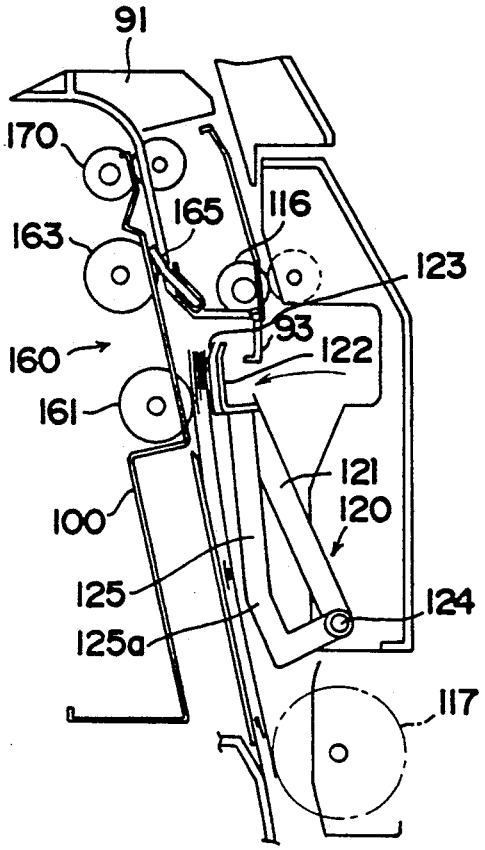
FIGS. 12*a*, 12*b*, 12*c* and 12*d* are explanatory drawings sbowing a sheet refeeding operation.
Figure 12B:
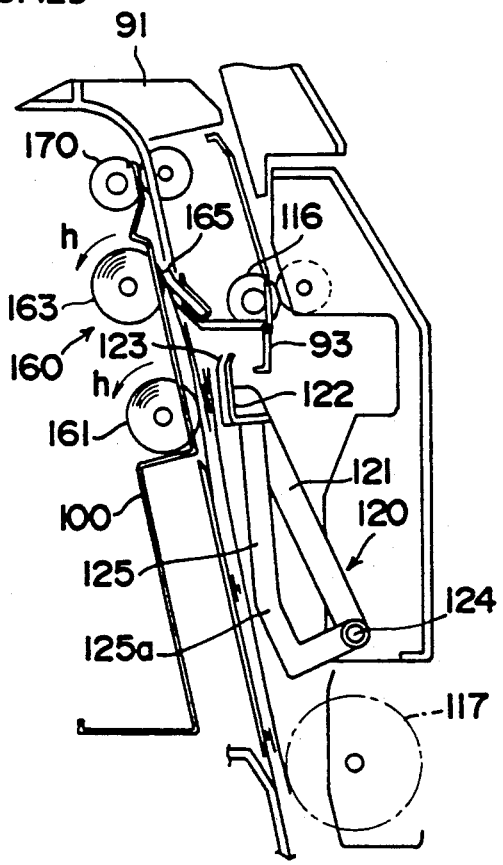
Figure 12C:
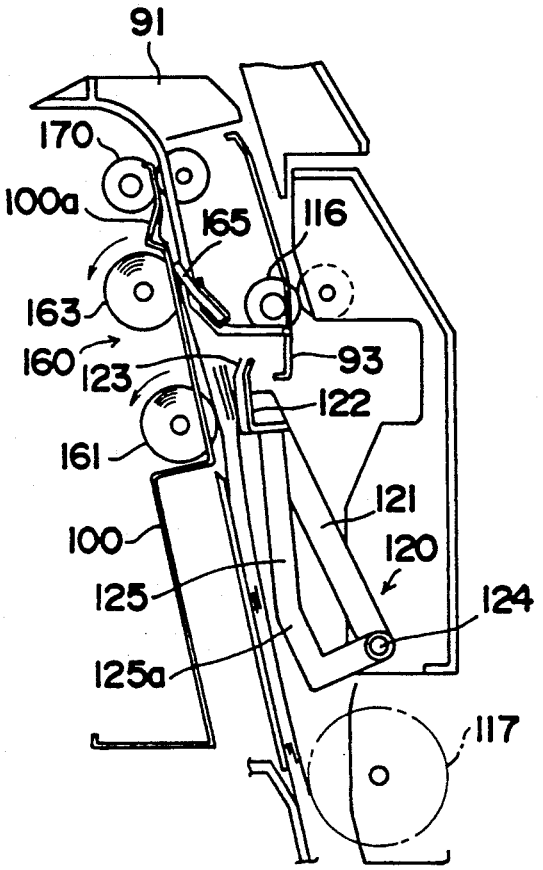
Figure 12D:
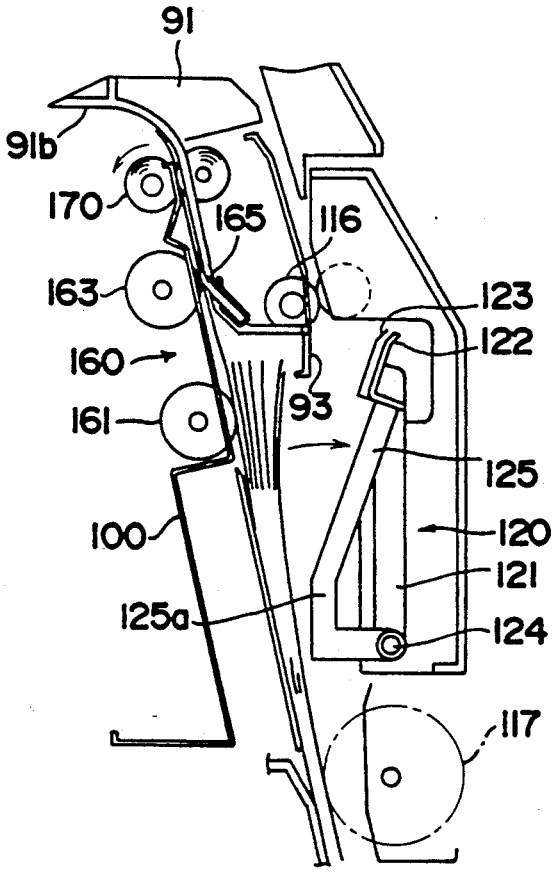

When a copying signal is generated to require sheet refeeding, first, the pressure mechanism 120 is driven to press the upper portion of the sheets (refer to FIG. 12*a*). After a moment has passed from the sheet pressing timing, the refeeding roller 161 and the separation roller 163 are started to rotate in the direction of arrow (h) to refeed upward the sheet being in contact with the refeeding roller 161 (refer to FIG. 12*b*). The sheet that has reached to the nip portion of the separation roller 163 and the separation pad 165 is fed to the register rollers 170. At this time, when a plurality of sheets are fed simultaneously, only one of the sheets being in contact with the separation roller 163 is fed to the register rollers 170 by virtue of the above-mentioned frictional forces. When a certain period has passed since the leading end of the sheet was detected by the photosensor SE3, the register rollers 170 is driven to rotate. Until the register rollers 170 are driven to rotate, the leading end of the sheet is pressed against the nip portion of the rollers 170 to be formed into a tiny loop (refer to FIG. 12*c*). For this purpose, the base plate 100 is provided with a dented portion 100*a* at the upper portion. The pressure mechanism 120 is moved backward when the leading end of the sheet is detected by the photosensor SE3, whereby the sheet remaining at the nip portion of the separation roller 163 and the separation pad 165 falls down to be put back to the original storing position (refer to FIG. 12*d*).

After the register rollers 170 are driven to rotate at the above-mentioned timing, the sheet is fed upward by the rollers 170, and then guided by the guide surface 91*b* and the guide plate 94 to the refeeding path 30 in the copying machine 1. The rotation of the refeeding roller 161 and the separation roller 163 are once stopped, a moment after the register rollers 170 was started to rotate. It is noted that the rollers 161 and 163 rotate following the feeding motion of the sheet because they are fitted around the shafts via one-way bearings.

The sheet refeeding operation for the second and subsequent sheets is performed by first detecting by means of the photosensor SE3 the leading end of the sheet. After a certain sheet feeding period corresponding to the sum of the sheet length and a certain length (margin length) has passed, the pressure mechanism 120 is driven to operate again to press the leading portion of the sheet. When the trailing end of the sheet being refed is detected by the photosensor SE3, the refeeding roller 161 and the separation roller 163 are driven to rotate again to repeat the same operation as for the first sheet as described above.

When it is detected by the photosensor 8E4 that all the sheets in the intermediate storing section 90 have been refed out thereof, the lower regulation plates 140 and the side regulation plates 105 are put back to the respective home positions.

The control method for the operation is hereinafter described in detail.

[Control Circuitry]

Figure 19:
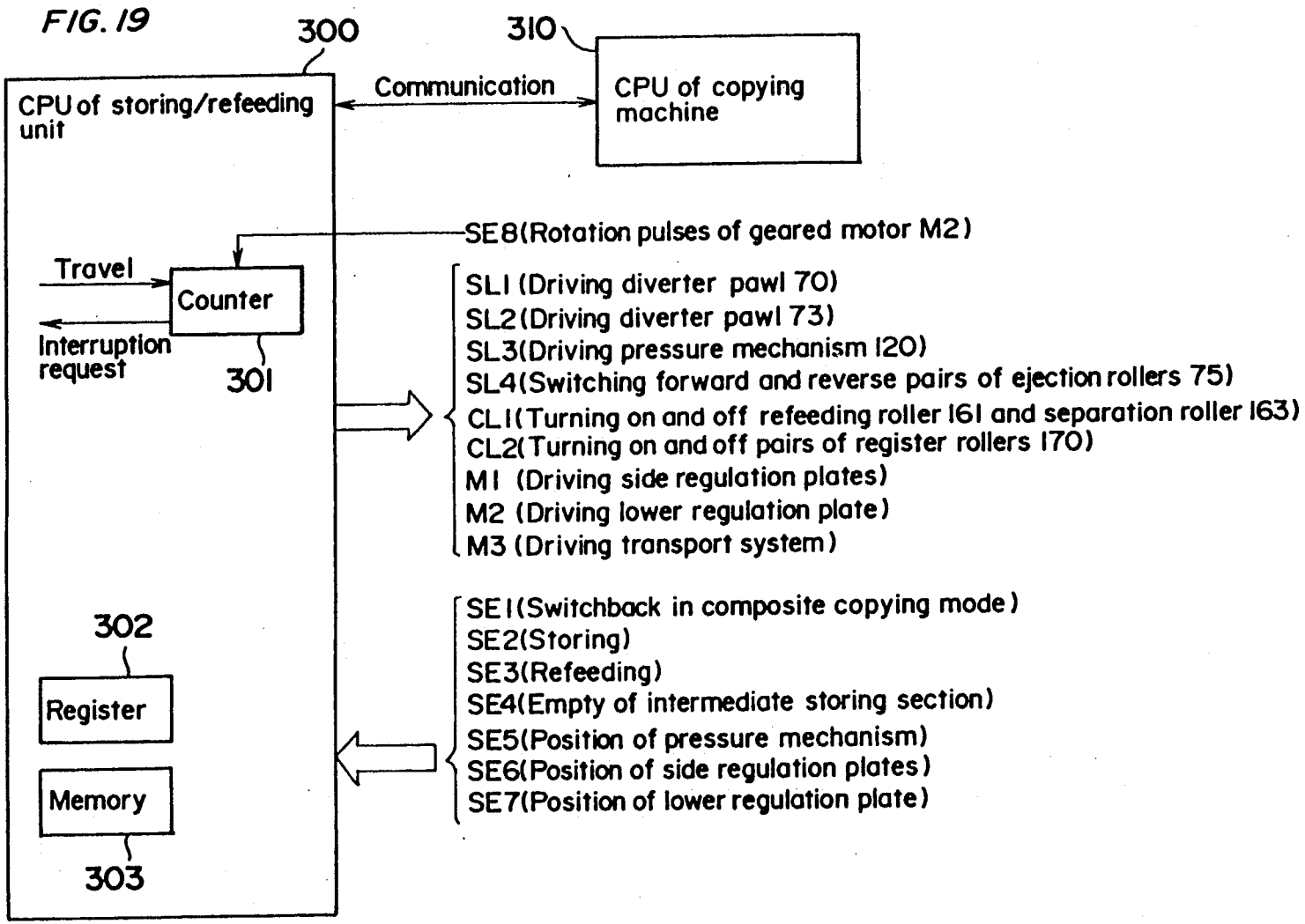
FIG. 19 is a diagram showing a control circuitry.

A control circuitry for the storing/refeeding unit 40 having the above-mentioned constitution and operation is explained referring to FIG. 19.

The system control is performed mainly by a computer 300 (which is hereinafter referred to as CPU). The CPU 300 comprises a counter 301, a register 302, a memory 303, etc and it is communicable with a CPU 310 for the copying machine 1. The counter 301 receives a count signal of the rotation pulses of the geared motor M2 from the photosensor SE8 and used for controlling the movement of the lower regulation plate 140.

On and off signals from the sensors SEl through SE7 are entered into each input port. The optical axes of the sensors SEl through SE4 are disturbed by respective actuators to produce off signals when the sensors detect no sheet, and the off signals are changed to on signals when the sensors detect a sheet. The sensors SE5, SE6 and SE7 produce the on signals when the optical axes are disturbed by the respective detector, and the off signals are changed to the on signals when the disturbance of the optical axes are removed.

From each output ports, on and off signals are sent to the solenoids, clutches, motors for driving each member. The solenoid SLl puts the diverter pawl 70 in the position as illustrated by the dashed line when it receives the on signal. The solenoid SL2 puts the diverter pawl 73 in the position as illustrated by the solid line when it receives the on signal. The solenoid 3L3 drives the pressure mechanism 120 into the sheet pressing position or the retreating position (home position) every time it receives the on signal. The solenoid SL4 puts the ejection rollers 75 in the reverse rotation when it receives the on signal. Further, the clutch CLl transmits drive force to the refeeding roller 161 and the separation roller 163 in the on condition. The clutch CL2 cuts off the drive force to the register rollers 170 in the on condition.

[Control Procedure]

The following describes the control procedure for the storing/refeeding unit 40 performed by the CPU 300 with reference to FIGS. 20 through 37.

In the following paragraphs, the term 'on-edge' is defined as a change in status, where the switch, sensor, signal or the like changes from the off status to the on status. In contrast, the term 'off-edge' represents a change in status, where the switch, sensor, signal or the like changes from the on status to the off status.

Figure 20:
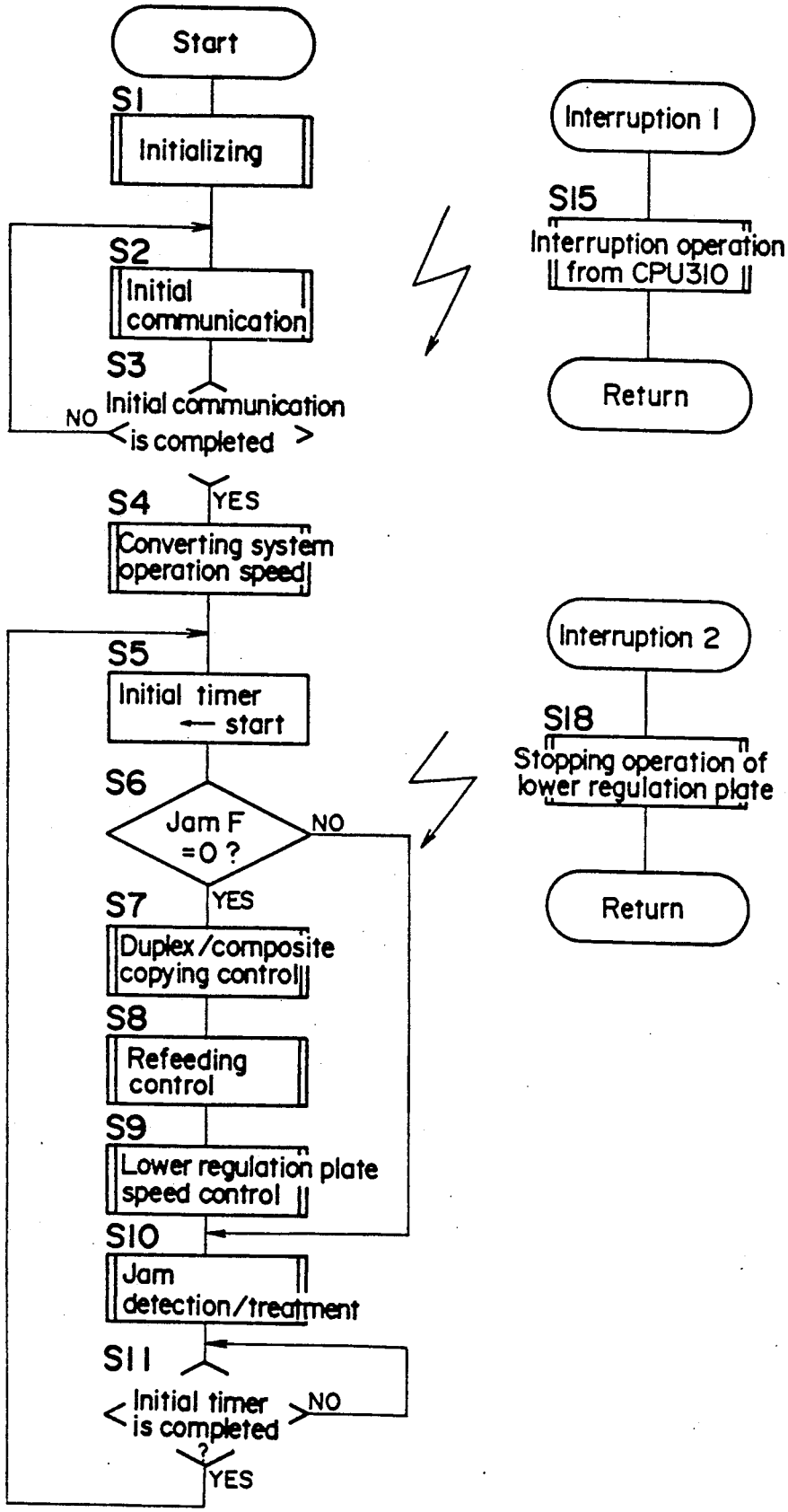
FIG. 20 is a flow chart showing a main routine carried out by a microcomputer for the sheet storing-/refeeding unit.

FIG. 20 is a flow chart showing the main routine carried out by the CPU 300.

When the CPU 300 is reset to start the program, the data in a random access memory 303 is cleared, the register 302, etc. are initialized, and an initial setting is performed for putting each device back to the initial mode at step Sl. Then an initial communication with the CPU 301 for the copying machine 1 is performed at step S2. When it is confirmed at step S3 that necessary communication data for the control of the storing/refeeding unit 40 is received, a subroutine for converting the system operation speed is performed at step S4. At this step S4, the system operation speed of the copying machine 1 transmitted from the CPU 301 at step S2 is read in order to convert the data to the value of sheet transport per one count of an internal timer.

Then, the internal timer is driven to operate at step S5. The internal timer was already set at step Sl to determine the processing time of the main routine by the CPU 300, and it becomes a reference for one count of the timer at each subroutine as described later.

Then it is judged at step S6 whether a jam flag is "0" The jam flag is set to "1" when a sheet jam takes place in the storing/refeeding unit 40 (refer to step S346). Therefore, when the jam flag indicates "1", the processing directly goes to step SlO. When the jam flag is reset to "0", each of subroutines S7 through S10 are called successively. When the processing in all the subroutines are completed, the processing returns to step S5 after the completion of the internal timer operation at step S11.

When an interruption demand is generated from the CPU 310 for the copying machine 1, an interruption operation is performed according to the data transmIted at step S15. When an interruption demand is generated from the internal counter 301, the operation of the lower regulation plate 140 is stopped at step S18. The stop operation will be described later.

Figure 21:
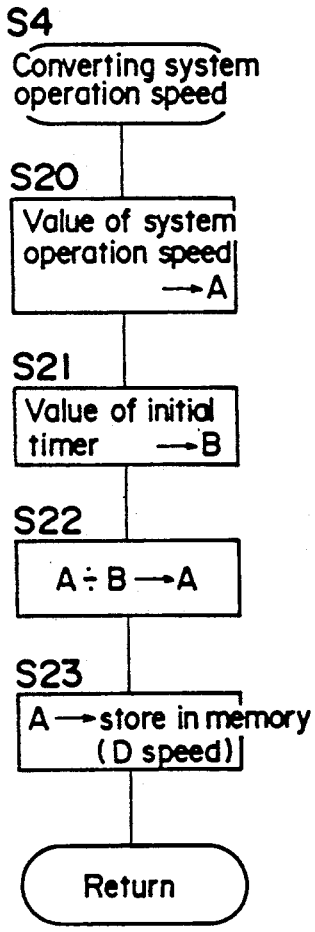
FIG. 21 is a flow chart showing a subroutine for converting the system operation speed.

FIG. 21 is a flow chart showing a subroutine for converting the system operation speed to be periormed at step S4.

At this step, in view of the fact that copying machines differ in operation speed and the sheet transporting speed of the storing/refeeding unit 40 which is provided for a copying machine should be adjusted to the system operation speed of the copying machine, a conversion calculation is performed for synchronizing the control timing in the storing/refeeding unit 40 with the sheet transporting speed.

More specifically, the value of the system operation speed of the copying machine 1 is set to "A' at step S20, and the value of the internal timer of the CPU 300 is set to 'B' at step S21. Then a value 'A/B' is calculated at step S22, and the resulting value is stored in a memory as data of 'D speed'. Assuming now that the value 'B' of the timer is 1 msec. constant and the value 'A' of the main system operation speed is 100 mm/sec., the data 'D speed' is calculated to be 0.1 mm/count, which means that a sheet moves by 0.1 mm every count of the timer.

Figure 22:
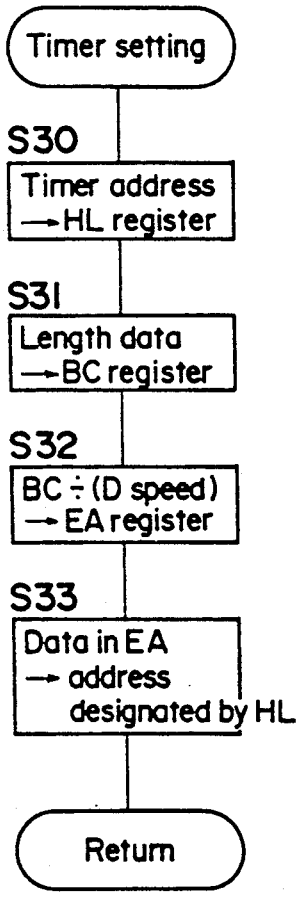
FIG. 22 is a flow chart showing a subroutine for timer setting.

The following describes the process for setting the timer of each subroutine based on the reference value 'D speed' referring to FIG. 22. The processing at this stage is performed for setting all the timers in the subroutines.

First, a timer address is entered into an HL register at step S30. The term 'address' indicates the address in the memory where the value of the timer to be set at this stage is stored. Then a length data corresponding to the change is entered into a BC register at step S31, the value of the data stored in the BC register is divided by the value 'D speed' at step S32, and the resulting value is entered into an EA register. For example, when the length to be changed is 100 mm and the value 'D speed' is 0.1 mm/count as mentioned above, the data to be entered into the EA register is 1000. This means that the 1000 counts of the timer corresponds to the transport of the sheet by 100 mm. Then the data in the EA register is stored in the address designated by the HL register at step S33

(Control for Sheet Storing)

Figure 23:
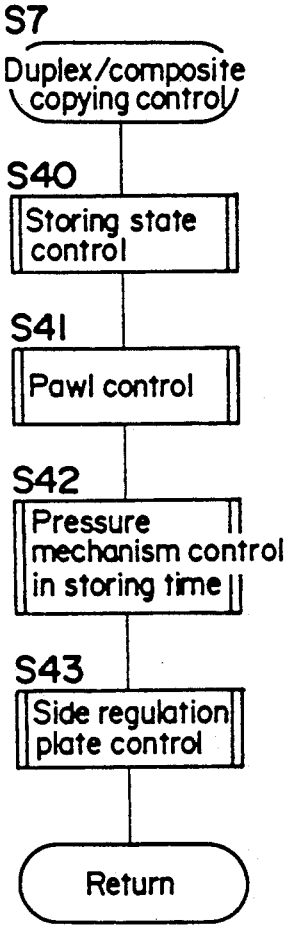
FIG. 23 is a flow chart showing a subroutine for duplex/composite copying control.

FIG. 23 is a flow chart showing a subroutine for duplex/composite copying control to be performed at step S7.

In the subroutine, the pawls 70 and 73, the lower regulation plate 140, the side regulation plates 105, etc. are controlled in accordance with the duplex copying mode or the composite copying mode, and sheets which have got an image on their first surfaces are ejected one after another from the copying machine 1 to the intermediate storing section 90.

The subroutine includes the subroutines S40 through S43. At step S40, the condition of stand-by, start and stop are controlled in accordance with the count value of a sheet storing state counter. The operation of the pressure mechanism 120 is controlled at step S42, and the operation of the side regulation plates 105 is controlled at step S43 no detailed description of the subroutines for the pawl control at step S41 and the side regulation plate control at step S43 is provided here.

Figure 24:
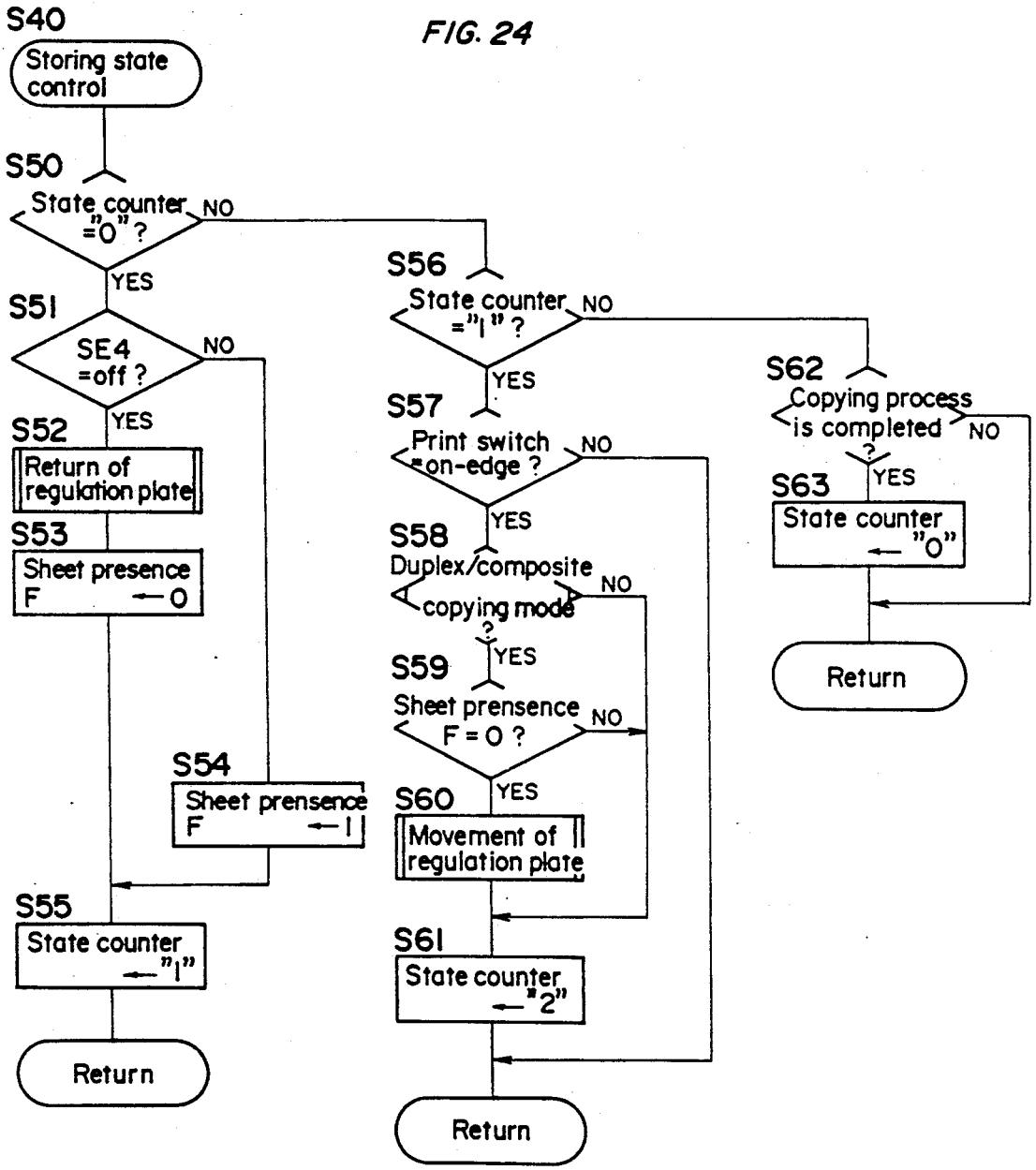
FIG. 24 is a flow chart showing a subroutine for controlling the sheet storing state.

FIG. 24 is a flow chart showing a subroutine for controlling the storing state to be performed at step S40.

First, the count value of the storing state counter is checked at step S50. The counter is reset to "0" at the initial stage. When the value is "0", it is judged at step S51 whether the photosensor SE4 is off, i.e. sheets are remaining in the intermediate storing section 90. When the photosensor SE4 is off and there is no sheet remaining, the regulation plates 105 and 140 are put back to their home positions at step S52, and a sheet presence flag is reset to "O" at step S53. Then the processing goes to step S55. When the photosensor SE4 is on and there are sheets remaining in the intermediate storing section 90, the sheet presence flag is set to "1" at step S54, and then the processing proceeds to step S55 to set the storing state counter to the value "1".

When it is judged at step S56 that the value of the storing state counter is set at "1", then it is judged at step S57 whether the print switch signal is on-edge. The on signal generated from the print switch is transmitted from the CPU 310 to the CPU 300 in the interruption operation. When the print switch signal is on-edge, it is judged at step S58 whether the copying mode to be performed at the time is the duplex copying mode or the composite copying mode. When neither of the modes takes place, no sheet storing operation is performed, and then the processing goes to step S61. When either of the duplex copying mode or the composite copying mode is selected to be performed, after confirming at step S59 that the sheet presence flag has been reset to "0", the regulation plates 105 and 140 are driven to move into the positions corresponding to the sheet size. Then, the processing proceeds to step S61 to set the storing state counter to the value "2".

When the results at steps S50 and S56 are both negative, it is judged at step S62 whether the image copying process has been completed. A copying completion signal is transmitted to the CPU 300 in the interruption operation. When the copying has been completed, the storing state counter is reset to "O" at step S63, and the subroutine is terminated.

Figure 25:
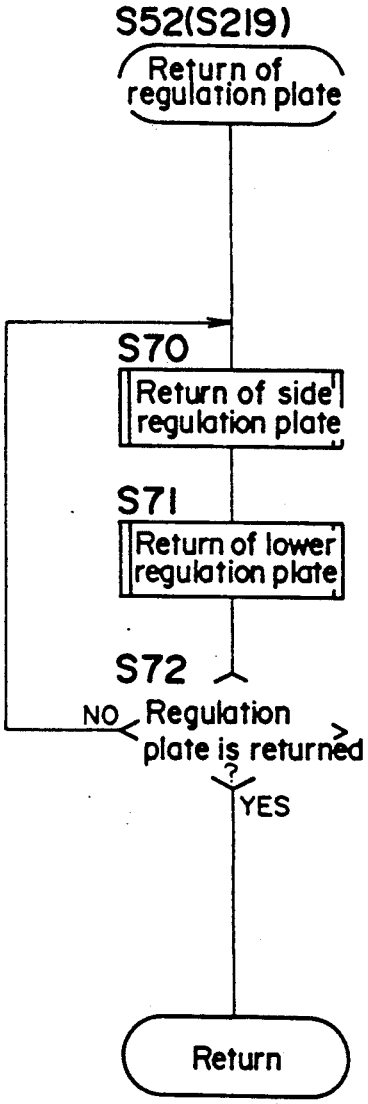
FIGS. 25 and 26 are flow charts showing a subroutine for putting the regulation plates back to the initial positions.

FIG. 25 is a flow chart showing a subroutine for putting the regulation plates 105 and 140 back to the initial positions to be performed at step S52.

In the subroutine, the side regulation plates 105 are returned to the initial positions at step S70, and the lower regulation plate 140 is returned to the initial position at step S71. When it is confirmed at step S72 that the regulation plates 105 and 140 are returned to the initial positions respectively, and the subroutine is completed.

The process for returning the lower regulation plate 140 at step S71 is described in detail with reference to FIG. 26. The process for returning the side regulation plates 105 is not described in detail here, and it is basically the same operation as shown in FIG. 26.

Figure 26:
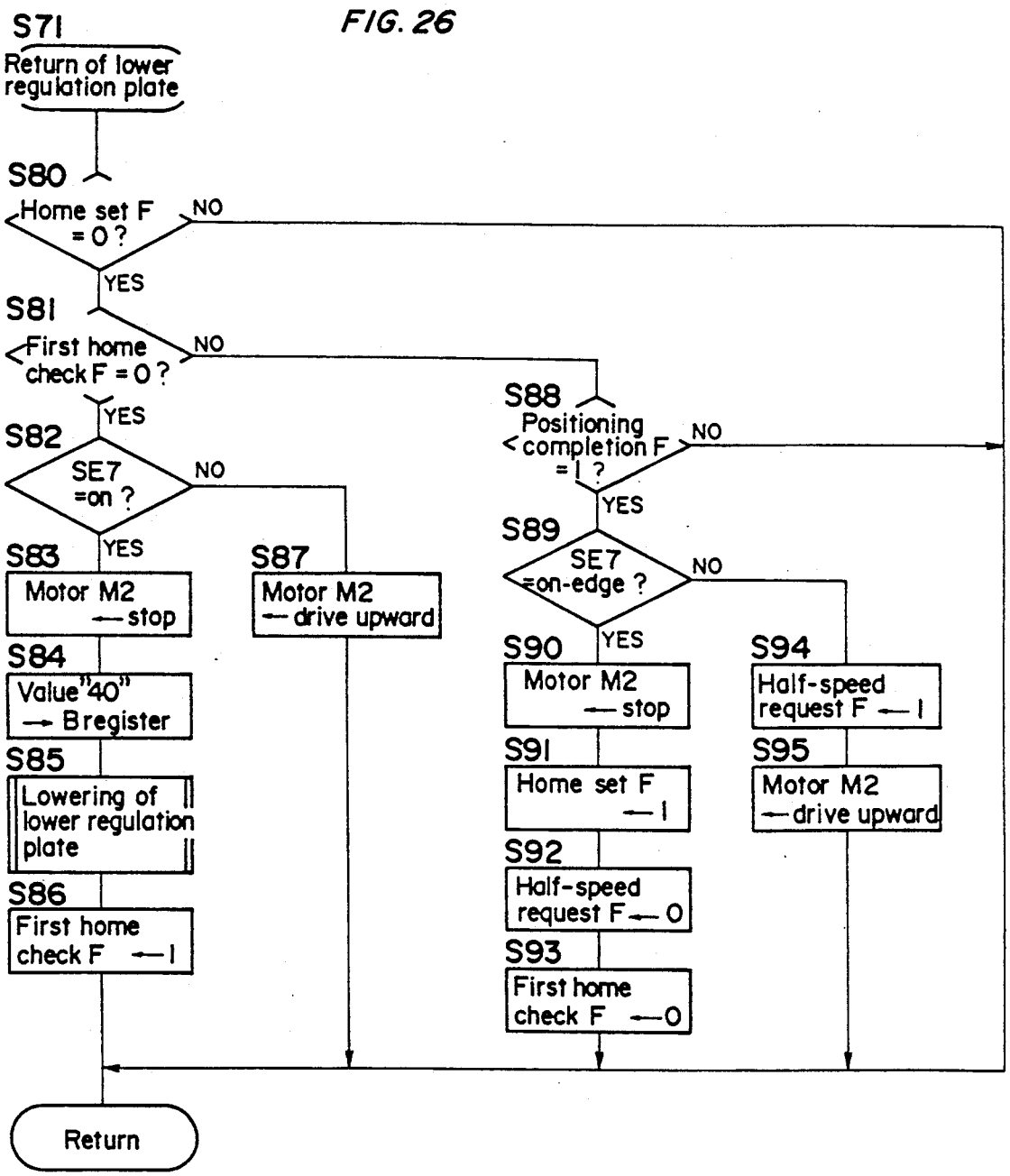

Now, the following describes the lower regulation plate return process at step S71 with reference to FIG. 26. At the steps, first, the lower regulation plate 140 is raised to the home position at a first sPeed, and second, the plate 140 is lowered from the home position at a second speed that is half the first speed, and finally the plate 140 is put back to the home position at the second speed.

First, it is judged at step S80 whether a home set flag is "0", and then it is judged at step S81 whether a first home check flag is "0". The home set flag is set to "1" when the lower regulation plate 140 is set to the home position finally, and the first home checkflag is set to "1" when the lower regulation plate 140 is once put back to the home position. When the results at steps S80 and S81 are both positive, it is judged at step S82 whether the photosensor SE7 is on, i.e. whether the lower regulation plate 140 is in the home position. When the photosensor SE7 is off, the motor M2 is driven to raise the lower regulation plate 140 at step S87. When it is confirmed that the photosensor SE7 is turned on and the lower regulation plate 140 is once put in the home position, the motor M2 is stopped at step S83, and a value "40" is entered into the BL register at step S84. In this place, the value "40" to be entered into the BL register is the count value of the photosensor SE8 for detecting the motor rotation pulses. Then the subroutine for lowering the lower regulation plate 140 is perfomred at step S85, and the first home check flag is set to "1" at step S86.

Next, when it is judged at step S81 that the first home check flag is "1", it is judged at step S88 whether a positioning completion flag is "1". The positioning completion flag is set to "1" when the lower regulation plate 140 is lowered by a certain amount from the home position in an interruption operation as described later (refer to step S135). Therefore, when the positioning completion flag has been set to "1", after confirmign at step S89 that the signal from the photosensor SE7 is not on-edge, a half-speed request flag is set to "1" at step S94 adn the motor M2 is driven to rotate for the upward movement at step S95. With these operations, the lower regulation plate 140 is raised toward the home positions at the second speed (lower speed). When it is judged at step S89 that the signal from the photosensor SE7 is on-edge, the motor M2 is stopped at step S90. At the same time, the home set flag is set to "1" at step S91 to inhibit the performance of the subroutine (step (S71), the half-speed request flag is reset to "O" at step S92, and the first home check flag is reset to "0" at step S93.

Figure 27:
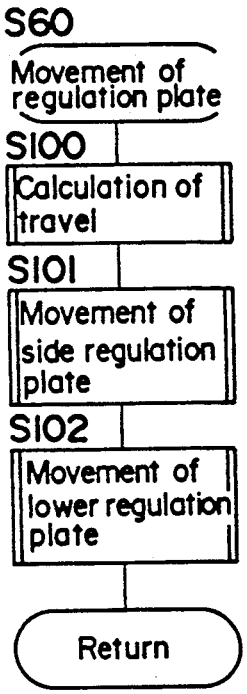
FIGS. 27, 28 and 29 are flow charts showing a subroutine for a regulation plate driving process.

FIG. 27 is a flow chart showing a subroutine for the regulation plate driving process to be performed at step S60. In the subroutine, the side regulation plates 105 and the lower regulation plate 140 are moved from the ome positions to the positions corresponding to the selected sheet size.

First, the travel of each of the regulation pates 105 and 140 is calculated based on the sheet size at step S100. More specifically, the necessary travel is divided by the pulse pitches of the motors M1 and M2 to obtain the count value corresponding to the travel. Then the side regulation plates 105 are moved to the positions corresponding to the selected sheet size at step S101, and the lower regulation plate 140 is moved to the position corresponding to the selected sheet size at step S102.

Figure 28:
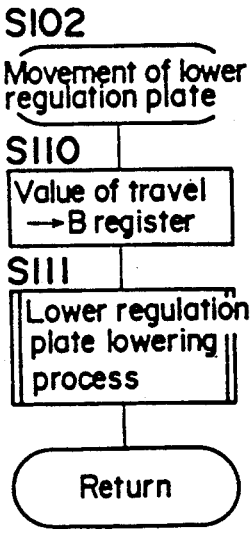
Figure 29:
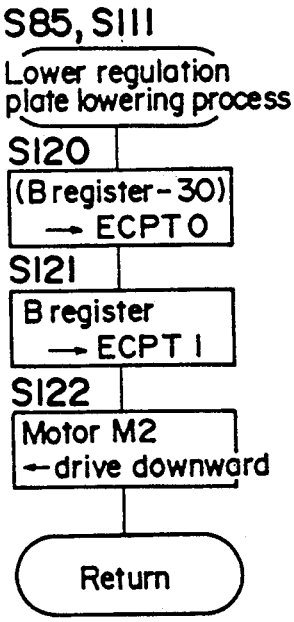

The process for moving the lower regulation plate 140 at step S102 is described in detail in FIGS. 28 and 29. The process for moving the side regulation plates 105 is not described in detail here, because the process is the same as that described in FIGS. 28 and 29.

As shown in FIG. 28, the process for moving the lower regulation plate 140 begins with entering the value of the travel obtained at step S100 into the B register at step S110, and then the subroutined for lowering the lower regulation plate is performed at step S111.

As shown in FIG. 29, the lower regulatin plate lowering process at step S111 is performed as being common to the process at step S85 in the subroutine for returning the lower regulation plate to the initital position. Namely, a value corresponding to "30" counts is subtraced from the value of the B register, and the resulting value is entered into a register ECPTO at step S120, and the value of the B register is entered into a register ECPT1 at step S121. Then the motor M2 is driven to lower the lower regulation plate 140.

Figure 30:
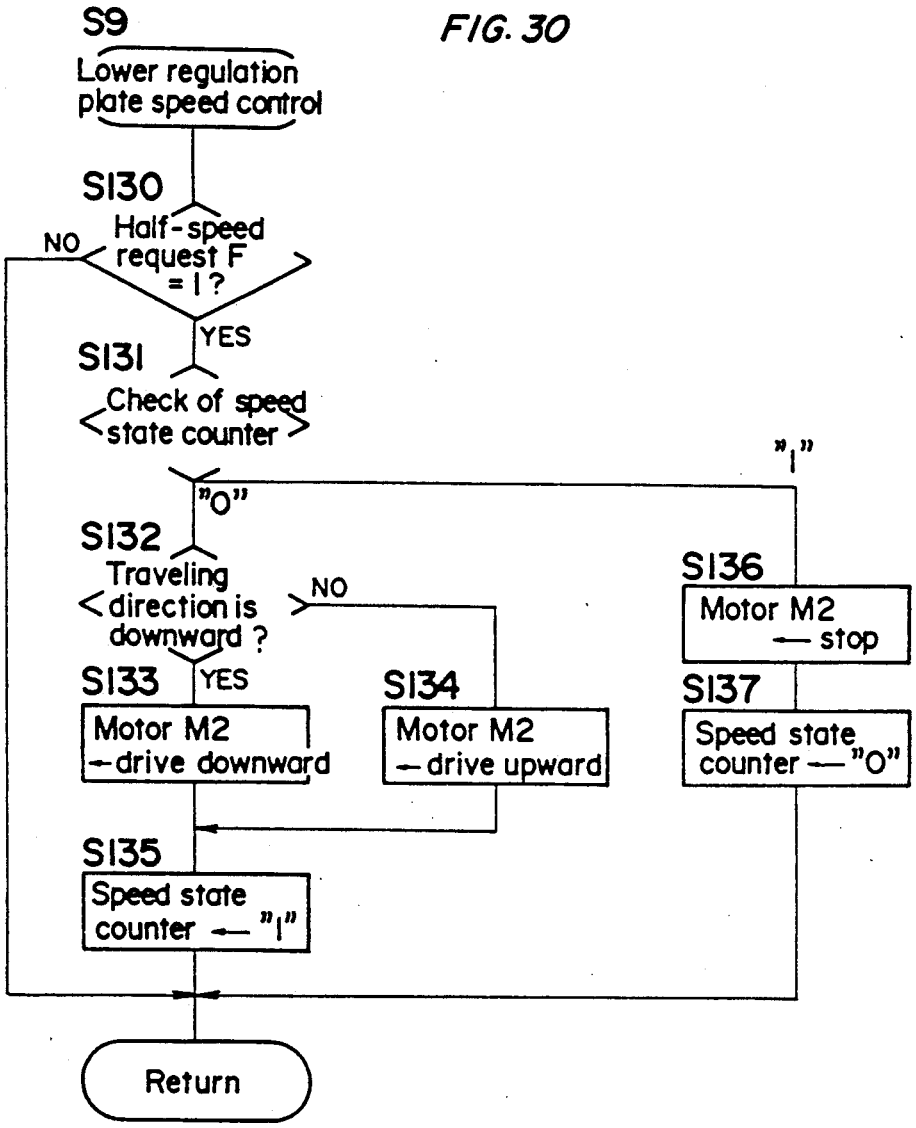
FIG. 30 is a flow chart showing a subroutine for controlling the speed of the lower regulation plate.

FIG. 30 is a flow chart showing a subroutine for controlling the speed of the lower regulation plate to be performed at step S9.

In the subroutine, the travel speed of the lower regulation plate 140 is changed to the second speed (lower speed) when the half-speed request flag is set to "1". Namely, it is judged at step S130 whether the half-speed request flag is "1". When the half-speed request flag has been reset to "0", the subroutine is completed. When the request flag has been set to "1", the count value of the speed state counter is checked at step S131. When the state count value "0", it is judged at step S132 whether the present traveling direction is downward. When the traveling direction is downward, the motor M2 is driven for the downward movement at step S133, and the processing proceeds to step S135. When the traveling direction is upward, the motor M2 is driven for the upward movement at step S134, and the processing proceeds to step S135 to set the speed state counter to the value "1".

When the speed state counter is at "1", the motor M2 is stopped at step S136, and the state counter value is reset to "0". In detail, when the half-speed request flag has been set to "1", the operation of the motor M2 is changed between on and off conditions every time the processes at steps S131 through S137 are repeated. Therefore, the motor M2 consumes a half of the electric power without reducing the supply voltage to a half, which consequently results in reducing the rotation of the motor to a half.

Figure 31:
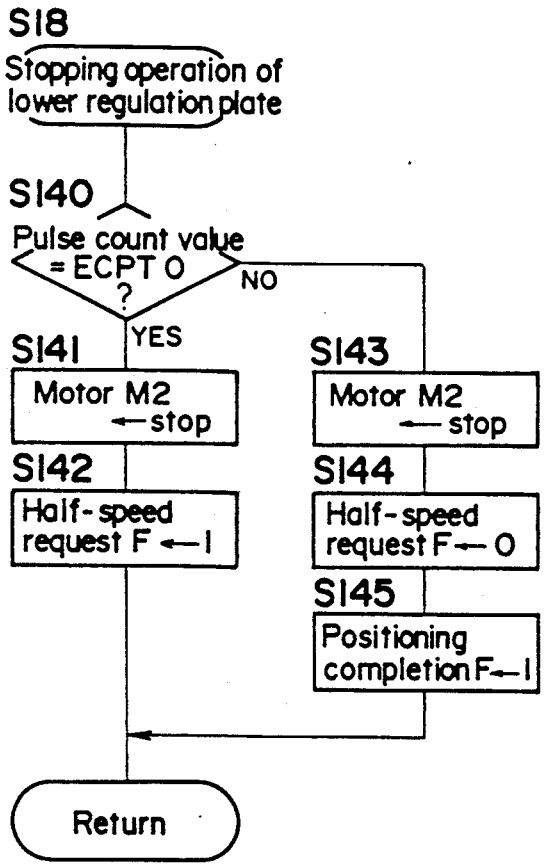
FIG. 31 is a flow chart showing a subroutine for stopping the lower regulation plate at a home position or a sheet regulation position.

The following describes a subroutine for the interruption operation at step S18 with refernce to FIG. 31. The interruption operation is for stopping the lower regulation plate 140 at the home position or the sheet regulation position. The rotation pulses of the motor M2 from the photosensor SE8 are counted, and the process is performed when the count value coincides with the value in the registers ECPTO or ECPT1 (refer to steps S121 and S122).

More specifically, it is judged at step S140 whether the pulse count value coincides with the value in the register ECPTO. When the values coincides, the motor M2 is stopped at step S141, and the half-speed request flag is set to "1" at step S142. When the pulse count value does not coincide with the value in the register ECPTO, i.e. the value cioncides with the value in the register ECPT1, the motor M2 is stopped at step S143, the half-speed request flag is reset to "0" at step S144, and the positioning completion flag is set to "1" at step S145.

Figure 32A:
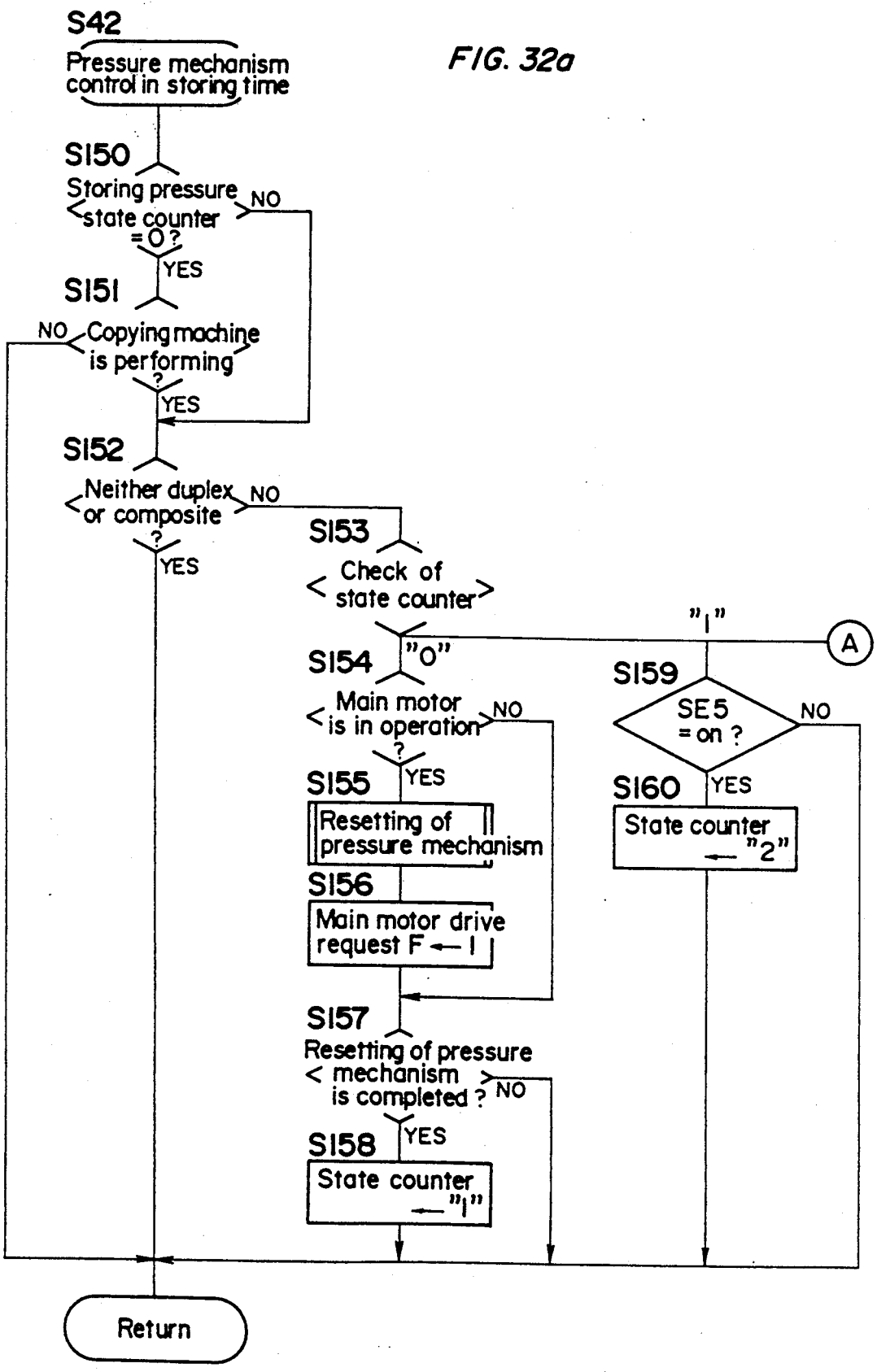
FIGS. 32*a*, 32*b* and 32*c* are flow charts showing a subroutine for controlling the pressure mechanism at the sheet storing time.
Figure 32B:
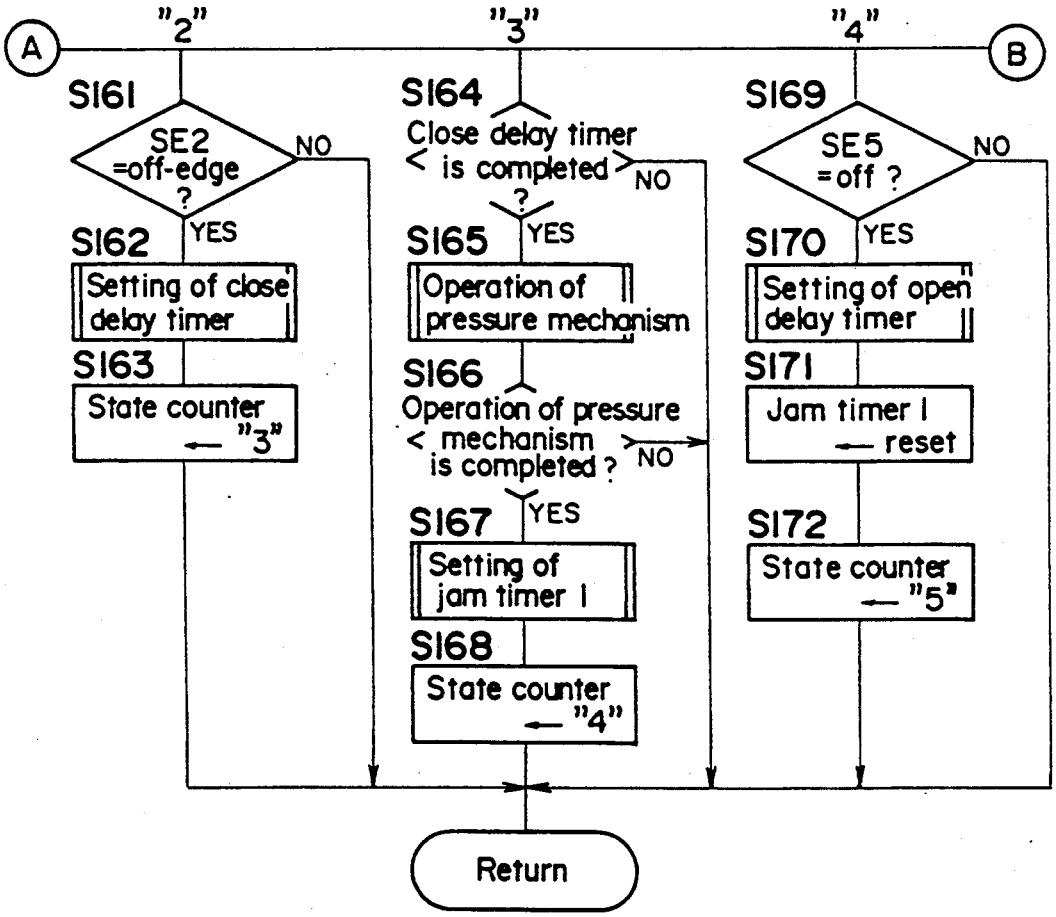
Figure 32C:
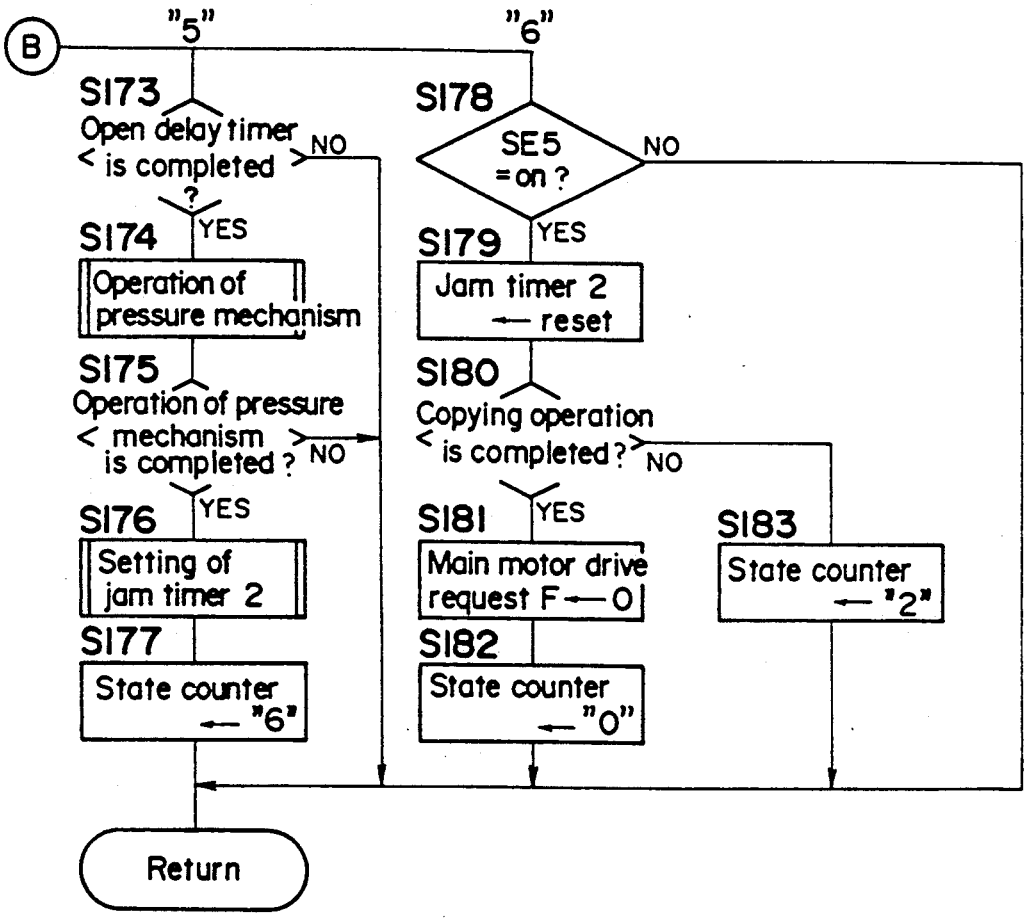

FIGS. 32*a*, 32*b* and 32*c* are flow charts showing subroutines for controlling the pressure mechanism at the sheet storing time to be performed at step S42.

In the subroutine, the following processes are performed in accordance with the count value of a storing pressure state counter. The state counter indicates the judgment condition for controlling the pressure mechanism 120 in accordance with the image copying condition and the sheet trasportiong condition.

First, it is judged at step S150 whether the count value of the storing pressure state counter is "0". When the count value is rest to "0", it is judged at step S151 whether the copying machine 1 is in operation. When the copying machine 1 is performing a copying operation is performed in the duplex/composite copying modes. When the copying operation is performed in neither copying mode, the present subroutine is completed immediately. When the copying operation is performed in either of the copying modes, the count value of the storing pressure state counter is checked at step S153.

When the count value of the state counter is "0", after confirming at step S154 that the main motor M3 is in operation, the pressure mechanism 120 is reset to the home position at step S155, and a main motor drive request flag is set to "1" at step S156. The request flag functions to continue the operaton of the main motor M3 when it is set to "1". Then it is judged at step S157 whether the resetting of the pressure mechanism 120 has been completed. When the resetting is completed, the count value of the counter is set to "1" at step S158.

It is noted here that the resetting of the pressure mechanism 120 at step S155 is performed by turning on the solenoid SL3. Therefore, even when the arm 121 and the roller 195 are disengaged with each other, the roller 195 can be securely guided by the inclined surface 121*c* to the rear portion 121*c*.

When the count value of the state counter is "1", it is judged at step S159 whether the photosensor SE5 is on. Namely, it is judged whether the resetting of the pressure mechanism 120 at above-mentioed step S155 has been performed securely by means of the on and off status of the photosensor SE5. When the photosensor SE5 is on and the resetting is confirmed, the count value of the storing pressure state counter is set to "2" at step S160.

When the count value of the state counter is "2", it is judged at step S161 whether the output signal of the sheet presence detection sensor SE2 is off-edge, i.e. the trailing end of the sheet has passed the detection piont of hte photosensor SE2. When the output signal of the photosensor SE2 is off-edge, a close delay timer is set at step S162, and the count value of the state counter is set to "3". The close delay timer is for determining the pressing timing of the pressure mechanism 120, and designed to make the pressure mechanism 120 press the trailing end of the sheet after a moment from the time the leading end of the sheet to be stored reaches the lower regulation plate 140.

When the count value of the state counter is "3", after confirming at step S164 that the close delay timer operation has finished, the pressure mechanism 120 is driven at S165. With this operation, the pressure mechanism 120 presses the trailing end portion of the stored sheet and the operation once stops in this condition. Then it is judged at step S166 whether the turning on and off operation of the solenoid SL3 to perform the operation has been completed. When the turning on and off operation has been completed, a jam timer 1 for the pressure mechanism 120 is set at step S167, and the count value of the storing pressure state counter is set to "4". In this place, the jam timer 1 is used for detecting the possible sheet jam at the entrance portion of the sheet intermediate storing section 90 when the pressure mechanism 120 does not operate in spite of the fact that the turning on and off operation of the solenoid SL3 has already performed.

When the count value of the state counter is "4", it is judged at step S169 whether the photosensor SE5 is off. Namely, it is judged by the on or off status of the photosensor SE5 whether the drive of the pressure mechanism 120 at step S165 has been securely performed. When it is confirmed that the photosensor SE5 is off and the pressure mechanism 120 is in the pressing position, an open delay timer is set at step S170. The open delay timer is for holding the presure mechanism 120 in the sheet pressing position for a certain period. Since the drive of the pressure mechanism 120 has been performed securely, the jam timer 1 for the pressure mechanism 120 is reset at step S171, and the count value of the storing pressure state counter is set to "5".

When the count value of the state counter is "5", after confirming the completion of the open delay timer operation at step S173, the pressure mechanism 120 is driven at step S174. With this operation, the pressure mechanism 120 retreats from the sheet pressing position. Then it is judged at step S175 whether the drive has been completed. When the drive has been completed, a jam timer 2 for the pressure mechanism 120 is set at step S176, and the value of the storing pressure stae counter is set to "6" at step S177. In this place, the jam timer 2 is used for detecting a possible sheet jam at the portion when the pressure mechanism 120 has been driven but is not returned to the home position.

When the count value of the state coutner is "6", the photosensor SE5 has beenn already turned on at step S178. Then it is confirmed that the pressure mechaism 120 has been securely returned, and the jam timer 2 for the pressure mechanism 120 is reset at step S179. Then it is judged at step S180 whether the copying operation has been completed. When the operation has not been completed, the value of the storing pressure state counter is set to "2" at step S183. When the image copying operation is completed, the main motor drive request flag is reset at step S181 and the value of the storing pressure state counter is reset to "0" at step S182.

(Control for Sheet Refeeding)

Figure 33:
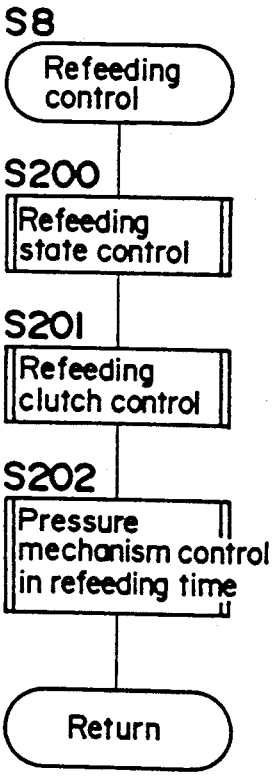
FIGS. 33 and 34 are flow charts showing a subroutine for controlling the sheet refeeding state.

FIG. 33 is a flow chart showing a subroutine for the sheet refeeding control to be performed at step S8.

In the subroutine, the refeeding roller 161, the register rollers 170, the pressure mechanism 120, etc. are controlled based on a sheet refeeding signal, and the process of feeding sheets each of which already got an image on its first surface and has been stored in the intermediate storing section 90 to the copying machine 1 one after another is performed.

The subroutine comprises each of the subroutines S200, S201 and S202. At step S200, the stand-by, starting and stopping of the sheet refeeding operation are controlled bin accordance with the count value of a sheet refeeding state counter. At step S231, the refeeding roller 161 and the register rollers 170 are controlled by turning on and off the clutches CL1 and CL2. At step S202, the pressure mechanism 120 is controlled.

Figure 34:
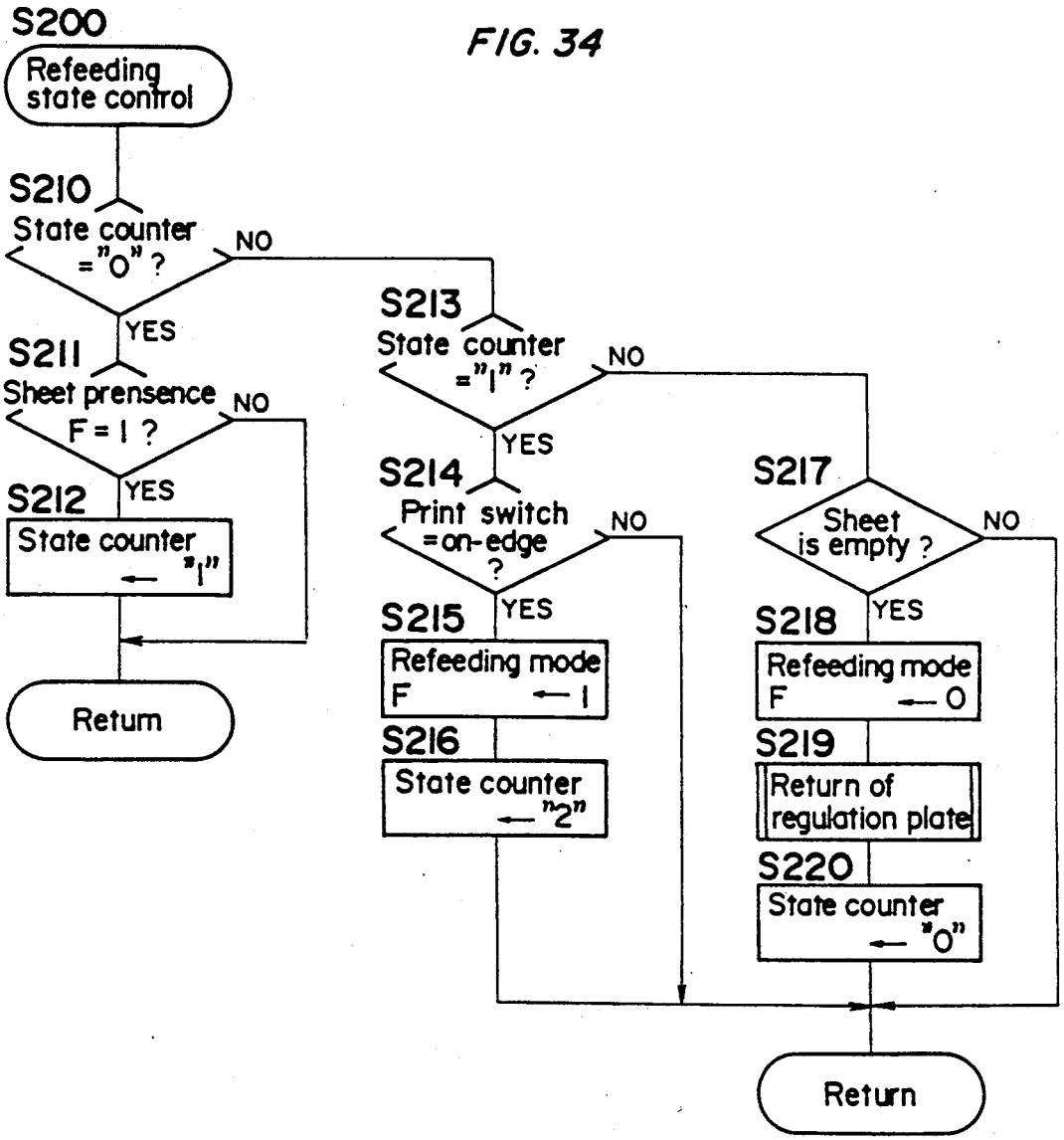
Figure 35A:
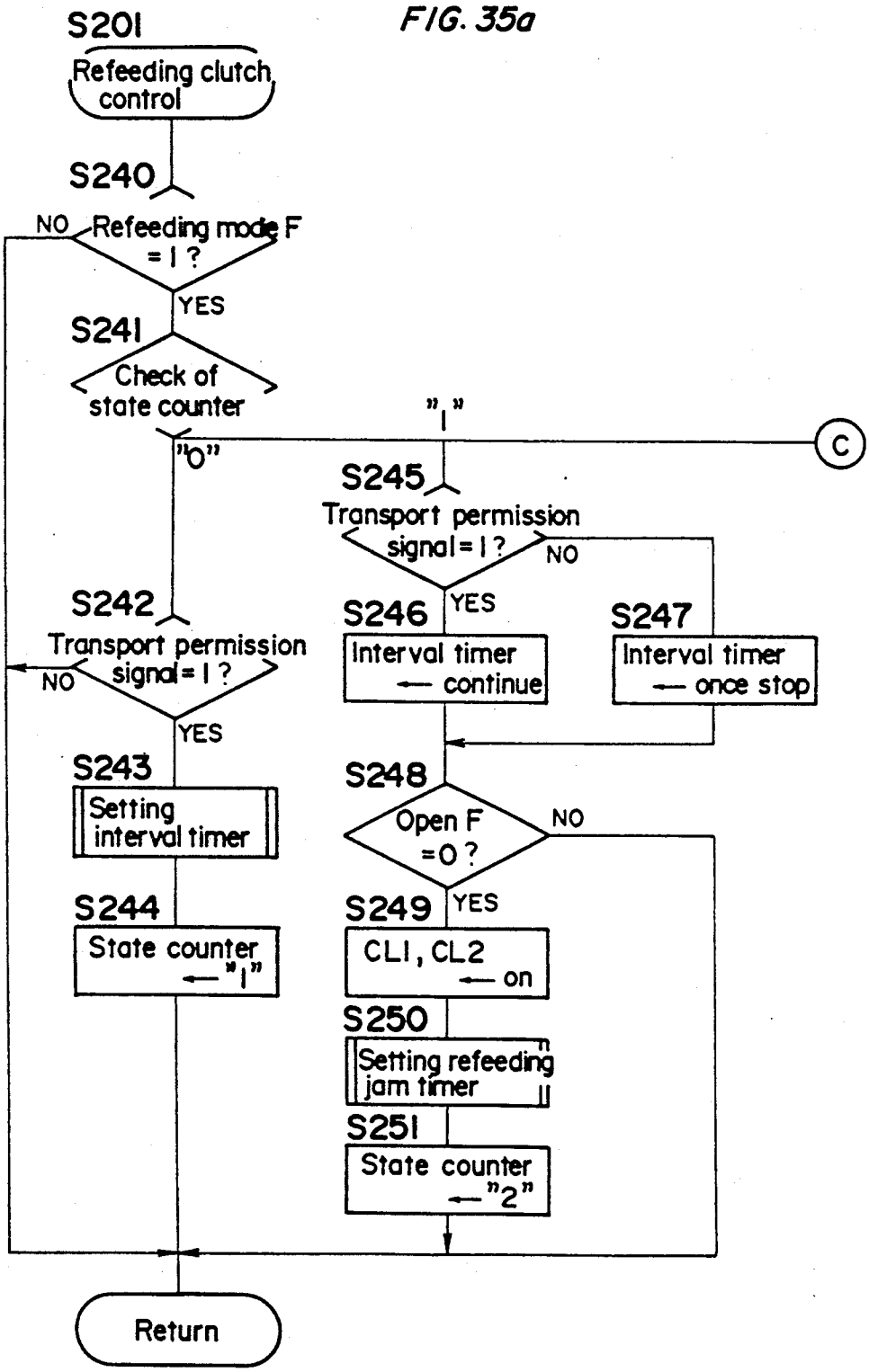
FIGS. 35*a*, 35*b*, 35*c* and 35*d* are flow charts showing a subroutine for controlling refeeding clutches.
Figure 35B:
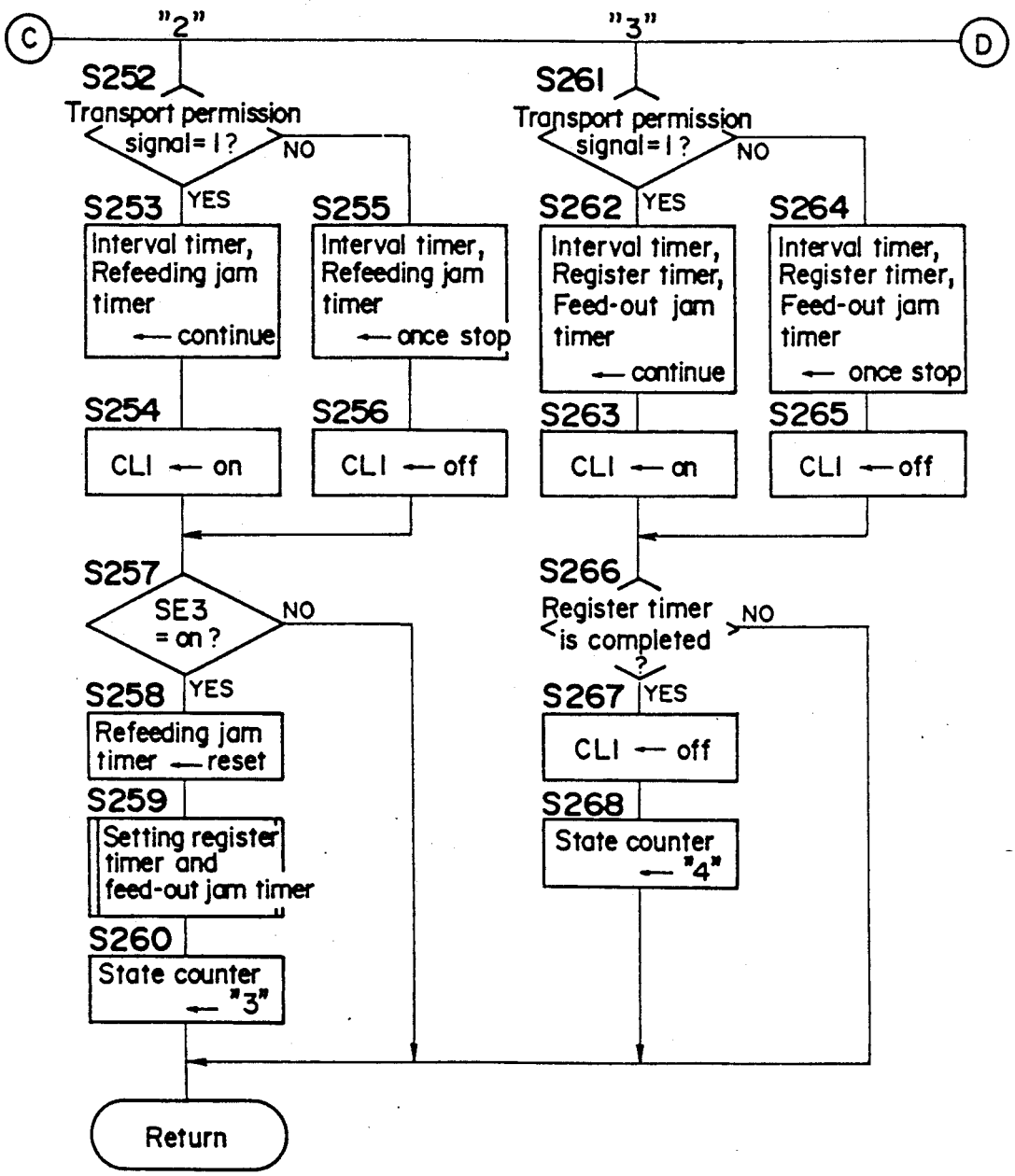
Figure 35C:
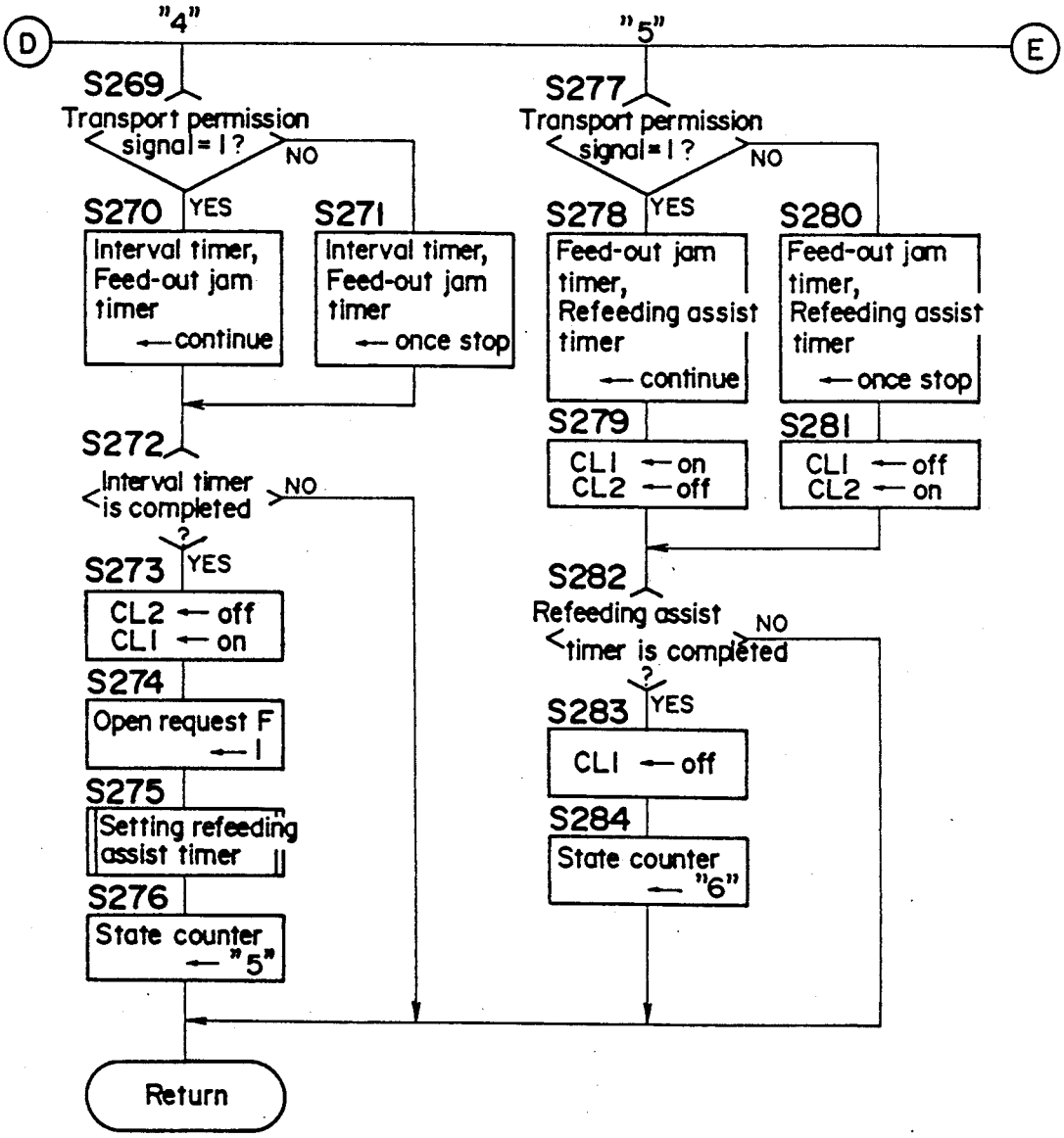
Figure 35D:
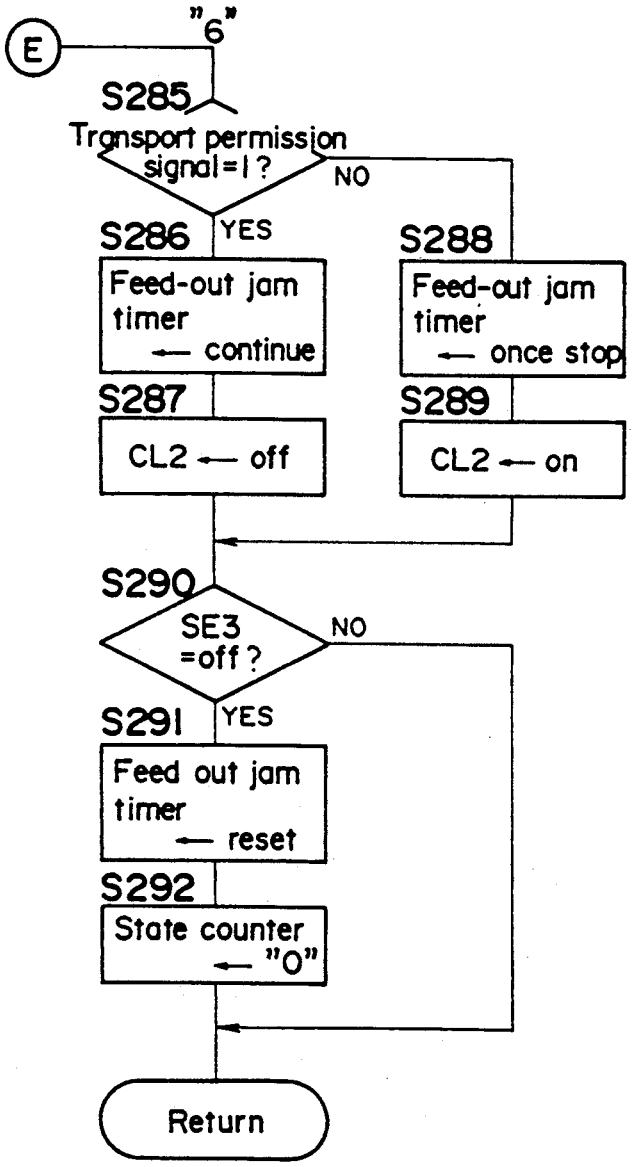

FIG. 34 is a flow chart showing a subroutine for controlling the sheet refeeding state to be performed at step S200.

First at step S210, the count value of the refeeding "0" at the time of initialization. When the count value is "0" at the tie of initialization. When the count value is "0", it is judged at step S211 whether the sheet presence flag is "1". When the sheet presence flag has been set to "1", i.e. there are sheets stored in the intermediate storing section 90, the refeeding state counter is set to "1" at setp S212.

When it is judged at step S213 that the counter is set to "1", it is judged at step S214 whether the print switch signal is on-edge. When the switch signal is on-edge, a refeeding mode flag is set to "1" at step S125. When the refeeding mode flag is "I", it indicates that the sheet refeeding is being performed. Then the refeeding state counter is set to "2" at step S216.

When the results at steps S210 and S213 are both negative, it is judged at step S217 whether the intermediate storing section 90 is empty. In this stage, the absence of sheets is judged by the off timing of the photosensor SE4 for detecting sheet empty and a timer. When the intermediate storing setion 90 is emtpy, i.e. all the sheets stored therein have been fed out, the refeeding mode flag is reset to "0" at step S218, and the regulation plates 105 and 140 are put back to the home positions respectively at step S219, and the refeeding state counter is reset to "0".

It is noted that the subroutine for setting the initial positions of the regulation plates to be performed at step S219 is the same as the process at step S52 described before (refer to FIGS. 25 and 26).

FIGS. 35*a*, 35*b*, 35*c* and 35*d* are flow charts showing a subroutine for controlling refeeding clutches to be performed at step S201.

In the subroutine, the following processes are performed in accordance with the count value of a clutch state counter. The state counter represents the judgement conditions for controlling the clutches CL1 and CL2 for the refeeding roller 161, the separation roller 163 and the register rollers 170 in accordance with the refeeding condition.

First, it is judged at step S240 whether the refeeding mode flag is "1". Only when the flag has been set to "1", the following steps are perfomed. More specifically, the count value of the clutch state coutner is checked at step S241. When the count value of the state counter is "0", it is judged at step S242 whether a sheet transport permission signal represents "1". While a refed sheet is subjected to a register process by the register rollers 23 in the copying machine 1, the refeeding of the next sheet should be discontinued. For that purpose, the sheet transport permission signal is used. When the signal is "1", the sheet refeeding is permitted, and when it is "0", the sheet refeeding is inhibited. The signal is transmitted from the CPU 310 for the copying machine 1 to the CPU 300 in the interruption operation. Therefore, when the sheet transport permission signal has been set to "1", an interval timer is set at step S243, and the cltuch state counter is set to "1" at step S244. The interval timer determines the timing for refeeding a sheet from the register rollers 170.

When the count value of the state counter is "1", it is judged at step S245 whether the sheet transport permission signal is "1". When the signal has been set to "1", the counting operation of the interval timer is continued at step S246. When the signal has been reset to "0", the counting operation of the timer is once stopped at step S247.

Next, it is judged at step S248 whether an open flag for the pressure mechanism 120 is "0". The open flag is set and reset in the subroutine for refeeding pressure mechanism control as described below. The reset conditon of the open flag indicates that the pressure mechanism 120 presses the upper portion of the sheets, while the set condition of the open flag indicates that the pressure mechanism 120 is at the home position. Therefore, when the open flag for the pressure mechanism 120 is reset to "0" (the pressure mechanism 120 is in the pressing position), the clutches CL1 and CL2 are turned on at step S249. With this operation, the refeeding roller 161 and the separation roller 163 are driven to rotate, while the rotation of the register rollers 170 stops.

Then a refeeding jam timer is set at step S250, and the clutch state counter is set to "2" at step S251. In this place, the refeeding jam timer is used for detecting the occurrence of a sheet jam near the refeeding roller 161 and the separation roller 163 in combination with the photosensor SE3.

When the count value of the state counter is "2", it is judged at step S252 whether the sheet transport permission signal is "1". When the signal has been set to "1", the counting operations of the interval timer and the refeeding jam timer are continued at step S253, and the refeeding clutch CLl is continued to operate at step S254. When the sheet transport permission signal has been reset to "0", the counting operations of the interval timer and the refeeding jam timer are once stopped at step S255, and the refeeding clutch CLl is turned off at step S256.

Next, it is judged at step S257 whether the photosensor SE3 is on, i.e. the leading end of the refed sheet has reached the detection piont of the photosensor SE3. When the photosensor SE3 has been turned on, the refeeding jam timer is reset at step S258, and a register timer and a feed-out jam timer are set at step S259. Then the clutch state counter is set to "3". In this stage, the register timer is used for preventing a swerving run of the sheet by forming a tiny loop at the leading portion of the sheet before the register rollers 170. The feed-out timer detects the occurrence of a sheet jam at the detection piont of the photosensor SE3 in combination witb the photosensor SE3 when the sheet does not pass through the detection point of the photosensor SE3 within a certain period (corresponding to the sum of the sheet length and a margin length).

When the count value the state counter is "3", it is judged at step S261 whether the refeeding permission signal is "1". When the signal has been set, the counting operations of the interval timer, the register timer and the feed-out jam timer are continued at step S262, and the on condition of the refeeding clutch CLl is continued at step S263. Meanwhile, when the refeeding permission signal has been reset to "0", the counting operations of the interval timer, register timer and the feed-out jam timer are once stopped at step S264, and the refeeding clutch CL1 is turned on at step S265.

After the completion of the register timer operation is confirmed at step S266, the refeeding clutch CL1 is turned off at step S267. With this operation, the leading end of the refed sheet is subjected to the register process by means of the register rollers 170, and then the sheet is put in the standby condition as being formed with a tiny loop. Then the clutch state counter is set to "4" at step S268.

When the count value of the state counter is "4", it is judged at step S269 whether the refeeding permission signal is "1". When the signal has been set to "1", the counting operations of the interval timer and the feed-out jam timer are continued at step S270. When the refeeding permission signal has been reset to "0", the counting operations of the interval timer and feed-out jam timer are once stopped at step S271. Subsequently, when the completion of the interval timer operation is confirmed at step S272, the clutch CL2 is turned off and the clutch CLl is turned on at step S273. With the turning-off of the clutch CL2, the register rollers 170 are started to rotate, while with the turning-on of the clutch CLl, the refeeding roller 161 and separation roller 163 are started to rotate. With these operations, the sheet is fed out from the register rollers 170 to the refeeding path 30 in the copying machine 1. In addition, It is noted that the simultaneous rotation of the rollers 161 and 163 together with the register rollers 170 is for securely feeding the leading end of the sheet into the nip portion of the register rollers 170.

Then a pressure mechanism open request flag is set to "I" at step S274, a refeeding assist timer is set at step S276. In this place, the pressure mechanism open request flag designates the pressure mechanism 120 to retreat from the pressing position to the home position when the flag is set to "1". The refeeding assist timer obtains the timing for stopping the refeeding roller 161 and the separation roller 163 after the sheet is securely refed.

When the count value of the state counter is "5", it is judged at step S277 whether the feeding permission signal is "1". When the signal has been set to "1", the counting operations of the refeeding jam timer and the refeeding assist timer are continued at step S278, and the turning-on of the refeeding clutch CLl and the turning-off of the register clutch CL2 are continued at step S279. When the refeeding permission signal has been reset to "0", the counting operations of the refeeding jam timer and the refeeding assist timer are once stopped at step S280, and the refeeding clutch CLl is turned off and the register clutch CL2 is turned on at step S281.

Subsequently, when the completion of the assist timer operation is confirmed at step S282, the refeeding clutch CLl is turned off at step S283. With this operation, the rotations of the refeeding roller 161 and the separation roller 163 are stopped, and the sheet is fed out from the intermediate storing section 90 by the rotation of the register rollers 170. In addition, it is noted that each of the rollers 161 and 163 rotate following with the feeding of the sheet by the operation of the one-way bearings. Then the clutch state counter is set to "6" at step S284.

When the count value of the state counter is "6", it is judged at step S285 whether the refeeding permission signal is "1". When the signal has been set to "1", the counting operation of the refeeding jam timer is continued at step S286, and the turning-off of the register clutch CL2 is continued at step S287. When the refeeding permission signal has been reset to "0", the counting operation of the refeeding jam timer is once stopped at step S288, and the register clutch CL2 is turned on at step S289 to once stop the sheet refeed.

Then is judged at the S290 whether the photosensor SE3 is off, i.e. the trailing end of the refed sheet has passed the detection point of the photosensor SE3. When the photosensor SE3 has been turned on, the refeeding jam timer is reset at step S291, and the clutch state counter is reset to "0" at step S292.

Figure 36A:
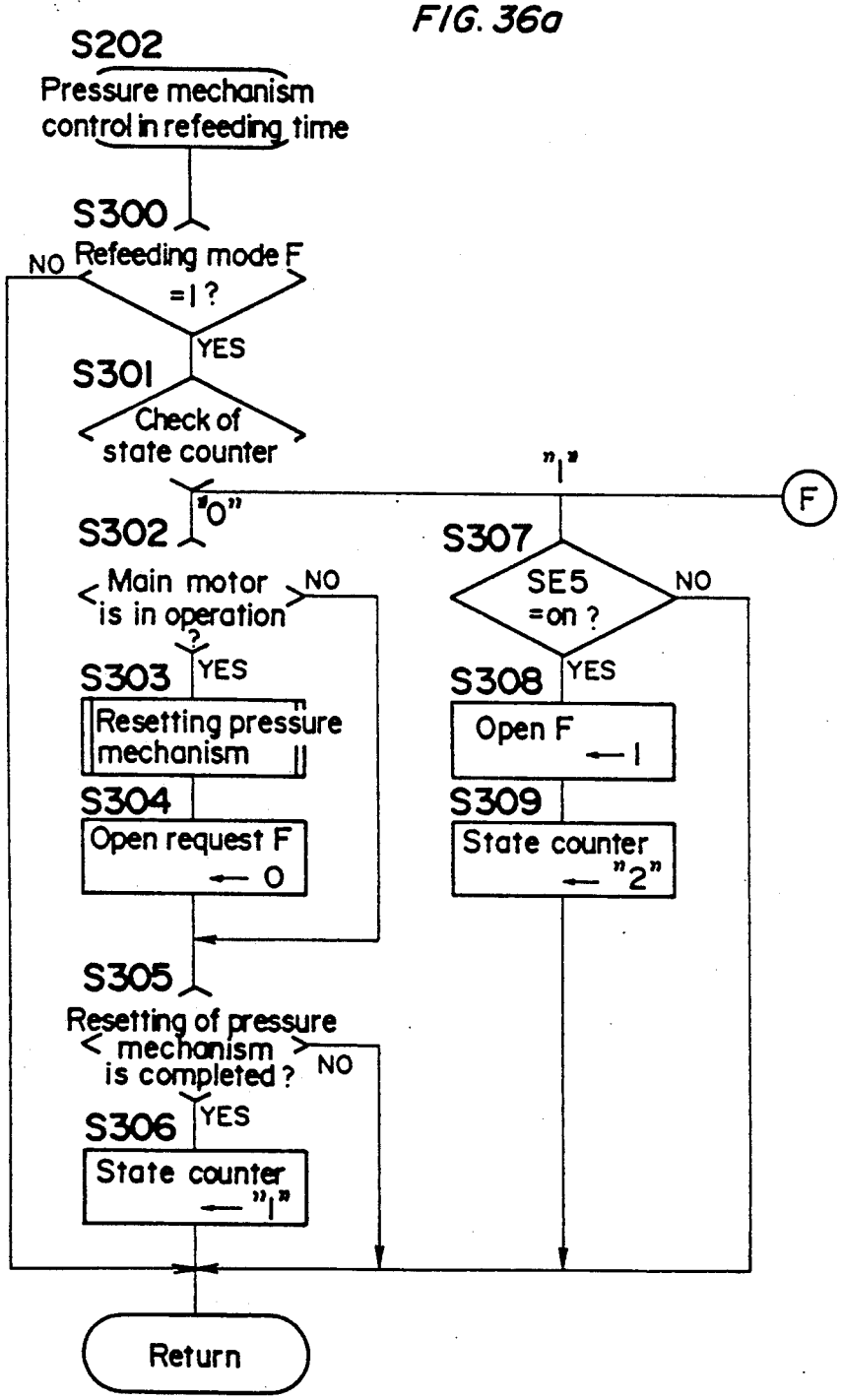
FIGS. 36*a*, 36*b* and 36*c* are flow charts showing a subroutine for controlling the pressure mechanism at the sheet refeeding time.
Figure 36B:
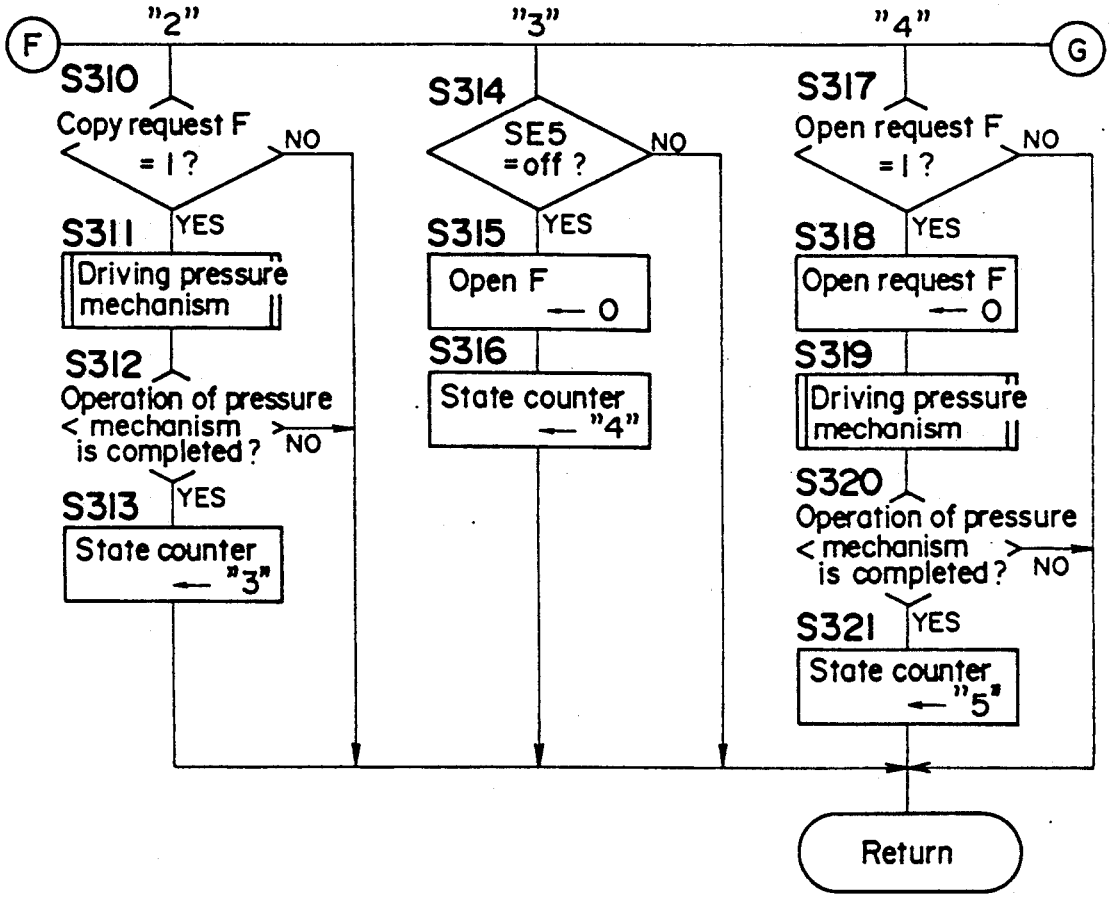
Figure 36C:
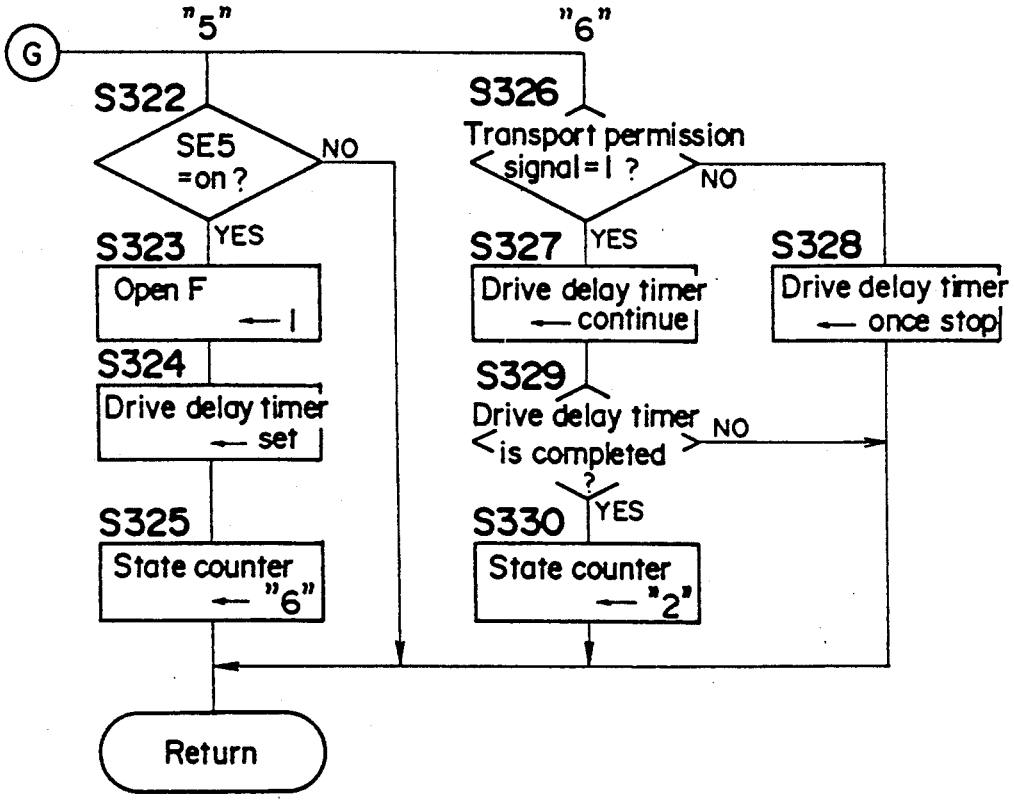

FIGS. 36*a*, 36*b* and 36*c* are flow charts showing a subroutine for controlling the pressure mechanism at the sheet refeeding time to be performed at step S202.

In this subroutine, the following processes are performed in accordance with the count value of the refeeding state counter for the pressure mechanism 120. The state counter represents the judgment condition for controlling the operation of the pressure mechanism 120 in accordance with the copying condition and the sheet refeeding condition. It is noted that the control in this subroutine is basically the same as the control in the subroutine for the pressure mechanism 120 at step S42 as shown in FIGS. 32*a*, 32*b* and 32*c*.

First, it is judged at step S300 whether the refeeding mode flag is "1". When the flag has been reset to "0", the subroutine is terminated at once, and when the flag has been set to "1", the count value of the state counter is checked at step S301.

When the count value of the state counter is "0", after confirming at step S302 that the main motor M3 is in operation, the pressure mechanism 120 is reset to the home position at step S303. Then the pressure mechanism open request flag is reset to "0" at step S304, and it is judged at step S305 whether the resetting of the pressure mechanism 120 has been completed. When it has been completed, the refeeding pressure state counter is set to "1"at step S306.

When the count value of the state counter is "1", it is judged at step S307 whether the photosensor SE5 is on. When the photosensor SE5 is on, i.e. the reset process at step S304 has been securely performed, the pressure mechanism open flag is set to "1" at step S308. Then the refeeding pressure state counter is set to "2" at step S309.

When the count value of the state counter is "2", it is judged at step S310 whether a copy request flag is "1". The copy request flag is set to "1" when the sheet refeeding signal is transmitted from the CPU 310 for the copying machine 1 to the CPU 300. Wben the copy request flag has been set to "1", the pressure mechanism 120 is driven at step S311. With this operation, the pressure mechanism 120 presses the leading end portion of the sheet in the intermediate storing section 90 and the operation is stopped once in this condition. Then it is judged at step S312 whether the above operation has been completed. Wben it has been completed, the refeeding pressure state counter is set to "3" at step S313.

When the count value of the state counter is "3", it is judged at step S314 whether the photosensor SE5 is off. Namely, it is judged by the on or off condition of the photosensor SE5 whether the drive of the pressure mechanism 120 at step S311 has been securely performed. When the photosensor SE5 is off, i.e. it is confirmed that the drive of the pressure mechanism 120 has been performed securely, the pressure mechanism open flag is reset to "0" at step S315, and the refeeding pressure state counter is set to "4" at step S316.

When the count value of the state counter is "4", it is judged at step S317 whether the pressure mechanism open request flag is "1". When the flag is set to "1", after resetting the flag to "0" at step S318, the pressure mechanism 120 is driven at step S319. With these operations, the pressure mechanism 120 retreats from the sheet pressing position.

In this procedure, a purpose of canceling the sheet pressing operation of the pressure mechanism 120 on the sheet is to prevent the increase of friction in refeeding sheets when the pressure mechanism 120 is placed in the sheet pressing position during the sheets are fed out from the intermediate storing position 90 by means of the register rollers 170. Another purpose is to put the subsequent sheets that have been unwillingly fed together with the present sheet and staying at the nip portion of the separation roller 163 and the separation pad 165 back into the stored position by its own gravity force. Subsequently, it is judged at step S320 whether the above-mentioned operation has been completed. When it has been completed, the refeeding pressure state counter is set to "5" at step S321.

When the count value of the state counter is "5", the photosensor SE5 is on at step S322. After it is confirmed at step S322 that the pressure mechanism 120 has been securely returned to the home position, the pressure mechanism open flag is set to "1" at step S323. Then a pressure mechanism drive delay timer is set at step S324, and the refeeding pressure state counter is set to "6" at step S325. The delay timer is in cbarge of a time control for setting the pressure mechanism 120 to the sheet pressing position before the refeeding roller 161 is driven to rotate for the refeeding of the next sheet.

When the count value of the state counter is "6", it is judged at step S326 whether the refeeding permission signal (as described in the clutch control subroutine for refeeding sheets) is "1". When the signal has been set to "1", the counting operation of the pressure mechanism drive delay timer is continued at step S327. When the signal has been reset to "0", the counting operation of the delay timer is stopped once at step S328. Then when the completion of the delay timer is confirmed at step S329, the refeeding pressure state counter is set to "2" at step S330, and the above processes are repeated.

Figure 37:
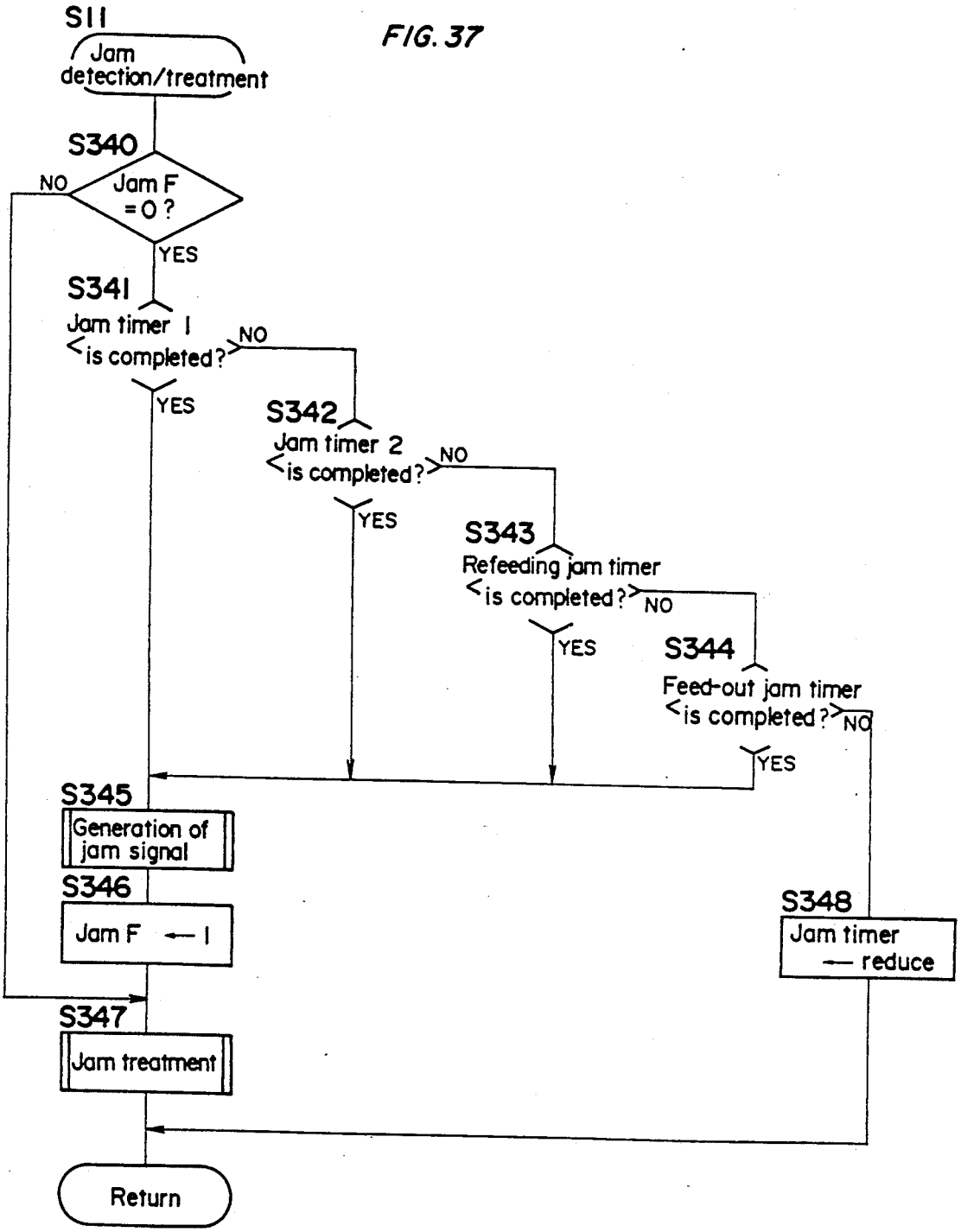
FIG. 37 is a flow chart showing a subroutine for detecting/treating a sheet jam.

FIG. 37 is a flow chart showing a subroutine for detecting and treating a sheet jam to be performed at step S11. In this subroutine, when a sheet jam is detected occurring in any section of the storing/refeeding unit 40, a warning and a designation ior removing the jammed sheet are dispatched.

First, it is judged at step S340 whether the jam flag is "0". The jam flag represents the occurrence of a sheet jam when it is set to "1". Therefore, when it has been set to "1", the processing immediately proceeds to step S347. When the jam flag is reset to "0", it is judged at steps S341 through S344 whether there occurred a sheet jam in each section. Namely, it is judged at steps S341 and S342 by the completion of the corresponding timer count whether a sheet jam occurred at the entrance section (refer to steps S167 and S176) in transporting sheets to the storing/refeeding unit 40. It is also judged at steps S343 and S344 by the completion of the corresponding timer count whether a sheet jam occurred at the exit section (refer to steps S250 and S259) in refeeding sheets. When a sheet jam takes place at any section, a jam signal is generated at step S345. In this procedure, the jam signal detected at steps S341 through S344 is transmitted to the CPU 310 for the copying machine 1.

Then the jam flag is set to "1" at step S346, and the subroutine for treating a sheet jam is performed at step S347.

Particularly, in this embodiment, when sheets are entering the intermediate storing section 90, the occurrence of a sheet jam at the entrance is found out by comparing an output signal of the photosensor SE5 for detecting the position of the pressure mechanism 120 with an output signal of the photosensor SE2 for detecting the condition of the sheet transport. Therefore, the occurrence of any sheet jam can be detected at an early stage, and this arrangement minimizes sheet waste and prevents the abnormal operation load on the copying machine 1.

Although the present invention has been described in connection with the preferred embodiment thereof, it is to be noted that various changes and modifications are apparent to those who are skilled in the art. Such changes and scope of the present invention as defined by the appended claims, unless they depart therefrom.

For example, the above-mentioned embodiment comprises the function of refeeding sheets, but there may be an alternative function of binding sheets with a stapler or a clip, or of merely storing sheets in a stack.

The stored posture of the sheets may be approximately horizontal instead of aforesaid approximately vertical condition. Generally, in a horizontal type of sheet storing/refeeding apparatus wherein sheets are stored one upon another, sheets fall down onto a sheet stack from the entrance. Accordingly, the separator 93 needs to be fitted horizontally and to regulate sheets so that the trailing end of each sheet entering the intermediate storing section will not cover the entrance. Therefore, in this case, the separator 93 is urged by a coil spring or the like so as to be set horizontally all the time.

In the above-described embodiment, a sorter 200 is mentioned as a sheet handling apparatus to be attached to the sheet storing apparatus downstream thereof. However, there may be alternatives such as a finisher unit having a function of stapling the stored sheets with a stapler or a clip, a stacker having a large capacity and so on. Further, there are various mechanisms for fitting and removing the diverter pawl 73 and the sheet tray 80 besides the one adopted in the embodiment above. It goes without saying that the sorter 200 and the diverter pawl 73 may be made in a fixed type In the embodiment above, an apparatus wherein sheets are transported making a switchback in the composite copying mode, but upon review of the constitution of the copying machine for which a storing/refeeding apparatus is provided, the apparatus may be so made that the switchback transportation of sheets are performed in the duplex copying mode. Although in the apparatus adopted to the embodiment, sheets are once stored in the intermediate storing section and then fed back to the copying machine, the apparatus may be so made that sheets are directly fed back to the copying machine without being stored.

Also, There are various kinds of processes of calculating a constant of the sheet storing apparatus from the system speed of the copying machine and adjusting the reference value of timing in accordance with the calculated constant besides the process described in the embodiment above.

What is claimed is:

1. A sheet storing apparatus attachable to an image forming apparatus, wherein sheets ejected from said image forming apparatus are stored, said sheet storing apparatus having a plurality of sections and comprising:

a sheet path through which sheets are tranpsorted;

means for detecting a sheet traveling in said sheet path; and control means for controlling the driving of each section in said sheet storing apparatus in accordance with an output of said detecting means, said contorl means comprising timer means for setting the timing of driving each section, input means for entering the speed of sheet transportion in said image forming apparatus, and means for adjusting the timing set by said timer means in accordance with the speed of the sheet transportation in said image forming apparatus entered by said input means.

2. A sheet storing apparatus as claimed in claim1, wherein:

said control means is a microcomputer repeating a program whose one routine is executed in a specified tie;

said timer means is a counter which counts the number of times of said microcomputer's repeating the program up to a specified number; and said ajusting means adjusts the specified number to be counted up by said timer means.

3. A sheet storing apparatus attachable to an image forming apparatus for receiving and storing sheets ejected from said image forming apparatus, said sheet storing apparatus comprising:

a sheet path through which sheets are transported;

means for detecting a sheet reaching a specified point;

an actuating member which is driven when a sheet is transported from the specified point to be specifically distant therefrom;

timer means for measuring a set period after detection of the sheet by said detecting means;

control means responsive to said timer means for commanding and operation of said actuting member upon expiration of the set period of said timer means;

input means for entering the speed of the sheet transportation in said image forming apparatus; and means for adjusting the set period of said timer means in accordance with the speed of the sheet transportation entered from said input means.

4. A sheet storing apparatus as claimed in claim 3, wherein said input means includes communication means for receiving data on the speed of the sheet transportation from said image forming apparatus.

5. A sheet storing apparatus as claimed in claim 4, wherein said communication means receives data on the speed of the sheet transportation from a control means of said image forming apparatus when a power supply is started.

6. A sheet storing apparatus as claimed in claim 3, wherein:

said timer means include a counter which counts the number of lapses of a predetermined short period; and said adjusting means calculates the distance of a sheet's being transported for the specified time using the entered data on the speed of the sheet transportation, divides the specified distance by the calculated distance and sets the result as a value of said counter.

7. A sheet storing apparatus attachable to an image forming apparatus, wherein sheets ejected from said image forming apparatus are stored, said sheet storing apparatus comprising:

storing means wherein sheets are stored;

means for transporting sheets ejected from said image forming apparatus to said storing means;

means for aligning sheets transported to said storing means;

means for detecting the condition of a sheet being transported from said image forming apparatus toward said storing means;

input means for entering the speed of the sheet transportation in said image forming apparatus; and control means for generating a signal to drive said storing means, said transporting means and said aligning means in accordance with an output of said detecting means, which transmits the entered data on the speed of the sheet transportation into a constant and determines the respective timings of driving said storing means, said transporting means and aligning means by operations of a reference value and the constant.

8. A sheet storing apparatus as claimed in claim 7, wherein said input means includes communication means for receiving data on the speed of the sheet transportion from said image forming apparatus.

9. A sheet storing apparatus as claimed in claim 8, wherein said communication means receives data on the speed of the sheet transportation from a control means of said image forming apparatus when a power supply is started.

10. A method of controlling a sheet storing apparatus attachable to an image forming apparatus, wherein sheets ejected from said image forming apparatus are stored, said method comprising:

a step of storing data on the speed of the sheet transportation in said image forming apparatus;

a step of determining a value of a timer for the timing of driving each of a plurality of sections in said sheet storing apparatus, based on the stored data on the speed of the sheet transportation; and a step of generating a signal for controlling each section in said sheet storing apparatus in response to the value of said timer.

11. A method of controlling a sheet storing apparatus as claimed in claim 10, further comprising a step of receiving data on the speed of the sheet transportation from the control means of said image forming apparatus.

12. A method of controlling a sheet storing apparatus as claimed in claim 11, wherein said data receiving step is executed when a power supply is started.

* * * * *

UNITED STATES PATENT AND TRADEMARK OFFICE

CERTIFICATE OF CORRECTION

PATENT : 5,037,083

DATED : Aug. 6, 1991

INVENTOR(S) : Akiyoshi Johda, et al.

It is certified that error appears in the above-identified patent and that said Letters Patent is hereby corrected as shown below:

Columns 1-30, should be deleted, and substitute therefor the attached columns 1-32.

Signed and Sealed this

Seventh Day of February, 1995

*Attest:*

Bruce Lehman

BRUCE LEHMAN

*Attesting Officer*

*Commissioner of Patents and Trademarks*

SHEET STORING APPARATUS FOR SHEETS EJECTED FROM A COPYING MACHINE AND A METHOD OF CONTROLLING IT

BACKGROUND OF THE INVENTION

1. Field of the Invention

The present invention relates to a sheet storing apparatus and a method of controlling it, and more specifically, to a sheet storing apparatus attachable to an image forming apparatus such as a copying machine, a laser printer, etc., wherein sheets ejected from the image forming apparatus are stacked in order so that a duplex/composite copying operation or a stapling operation will be available.

2. Description of Related Art

Recently, by increasing request for an automatic copying operation, various types of refeeding apparatuses for a duplex/composite copying operation and various types of sheet storing apparatus such as a finisher having a function of stapling sheets with a stapler or a clip, etc. have been proposed and developed. Image forming apparatuses such as copying machines, laser printers, etc. vary in the system speed, that is, the speed of the sheet transportation. Accordingly, such sheet storing apparatuses are requested to comply with various system speeds of image forming apparatuses.

Generally, this type of sheet storing apparatus is controlled by a microcomputer, and the speed of the sheet transportation and the timing of driving each actuating member in the apparatus are changed with a switch or the like so that they are corresponding to the system speed of the image forming apparatus. However, as types of image forming apparatuses are increasing in number, the number of switches for changing the speed and the timing is increasing, and inside the microcomputer, many programs corresponding to respective changes of the speed and the timing need to be prepared, resulting in the necessity of a microcomputer with a large capacity.

SUMMARY OF THE INVENTION

It is, therefore, an object of the present invention to provide a sheet storing apparatus and a method of controlling it, which are flexible enough to comply with various system speeds of image forming apparatuses, that is, a sheet storing apparatus wherein a switch for changing the speed of the sheet transportation and the driving timing is unnecessary and a microcomputer does not need to have a large capacity for the storage of various programs.

To attain the object above, a sheet storing apparatus according to the present invention is an apparatus attachable to an image forming apparatus, wherein sheets ejected from the image forming apparatus are stored. The sheet storing apparatus comprises a sheet path through which sheets are transported; means for detecting a sheet traveling in the sheet path; and control means for controlling each section in the sheet storing apparatus in accordance with an output of the detecting means. The control means comprises timer means for determining the timing of driving each section and means for adjusting the value of the timer means in accordance with the speed of the sheet transportation in the image forming apparatus. Further, the control means is a microcomputer repeating a program whose one routine is executed in a specified time. The timer means is a counter which counts the number of times of the microcomputer's repeating the program up to a specified number. The adjusting means adjusts the specified number to be counted up by the timer means. Furthermore, the sections which are controlled by the control means are storing means wherein sheets are stored, means for transporting sheets ejected from the image forming apparatus to the storing means and means for aligning sheets transported to the storing means.

With the constitution described above, the system speed of the image forming apparatus is sent from a microcomputer of the image forming apparatus, and the value is transmitted into a constant in the sheet transporting apparatus. The constant is used for operations with a reference value in order to calculate the respective timings of the storing means, the transporting means and the aligning means, and thus the timing of driving each means is determined. For instance, the transmission of the system speed of the image forming apparatus into a constant is performed by dividing the system speed by the value of the internal timer of the microcomputer in the sheet storing apparatus. Based on this constant, the reference value to be used in calculating the timings is adjusted. According to this control system, only one program is necessary, and a switch for changing the setting becomes unnecessary.

BRIEF DESCRIPTION OF THE DRAWINGS

Figure 10:
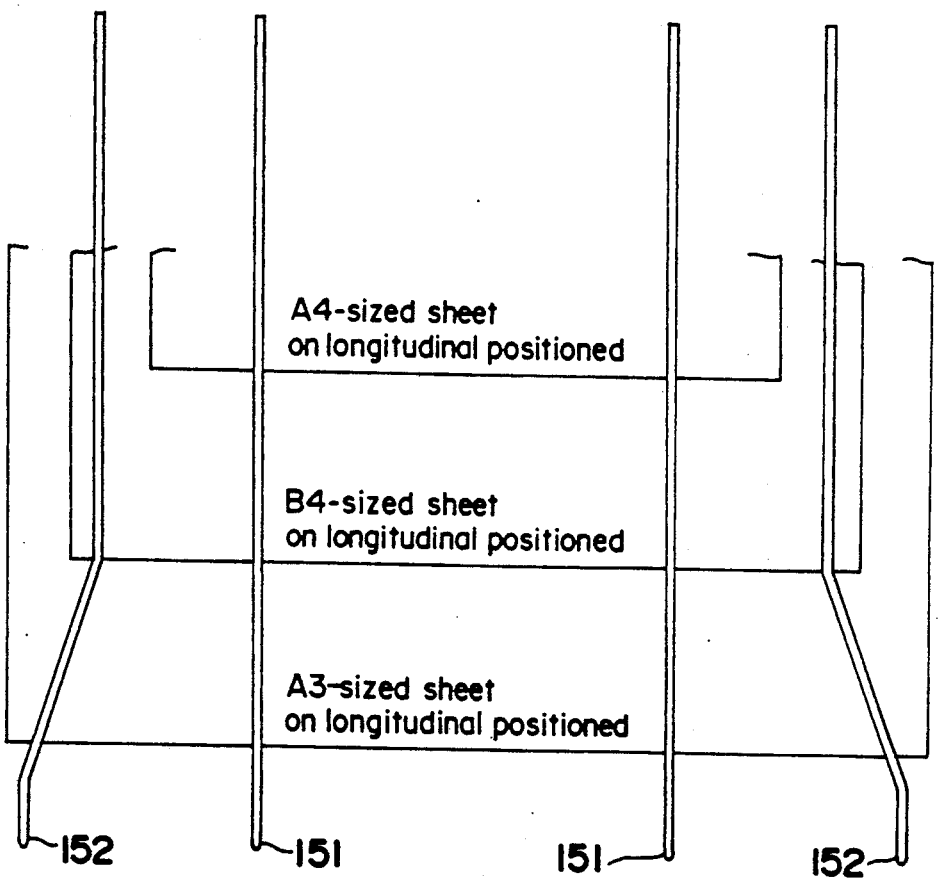
FIG. 10 is an elevational view showing the sheet guide section of the lower unit.
Figure 14A:
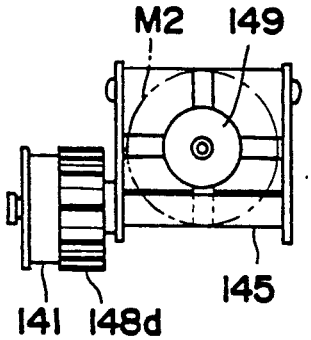
FIG. 14*a* is a plan view sbowing a geared motor.
Figure 14C:
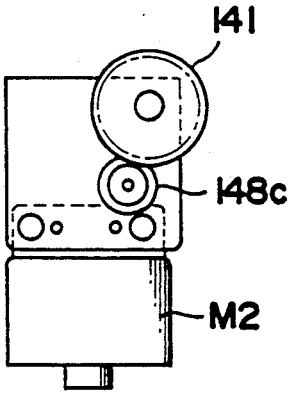
FIG. 14*c* is a left side view showing the geared motor.
Figure 14B:
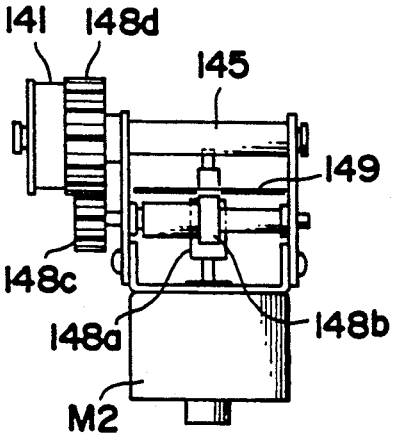
FIG. 14*b* is an elevational view showing the geared motorI
Figure 14D:
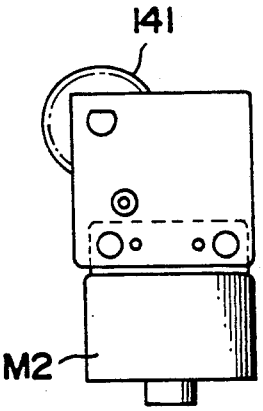
FIG. 14*d* is a right side view showing the geared motor.
Figure 15:
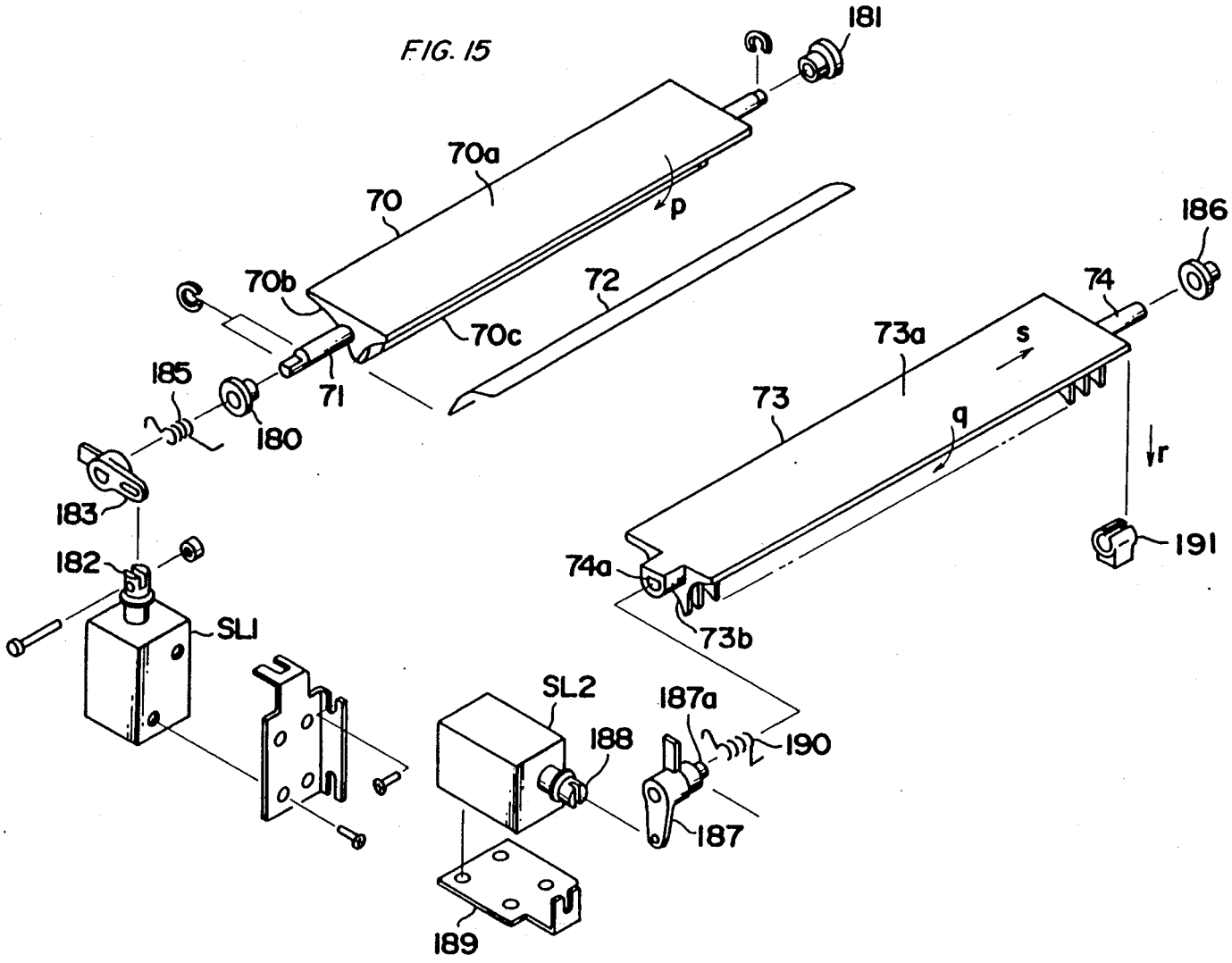
FIG. 15 is an exploded perspective view showing a mounting arrangement of a diverter pawl.
Figure 18:
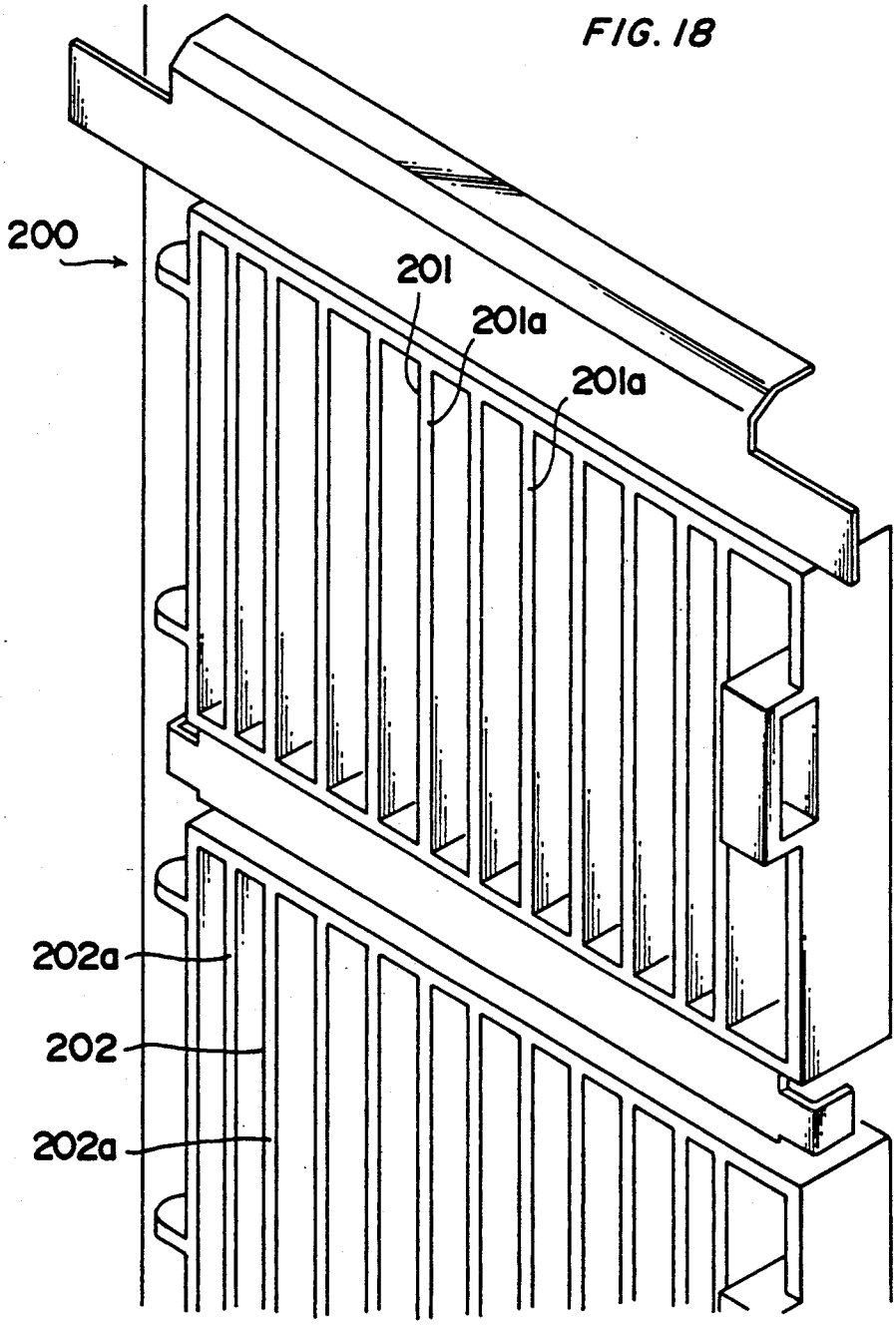
FIG. 18 is a partial perspective view showing the back of a sorter.

These and other objects and features of the present invention will become apparent from the following description taken in conjunction with the preferred embodiment thereof with reference to the accompanying drawings, in which:

FIG. 1 is a schematic block diagram showing a sheet storing/refeeding unit, including a copying machine, according to the present invention;

FIG. 2 is an internal composition showing the sheet storing/refeeding unit;

FIG. 3 is a perspective view showing a pressure mechanism;

FIG. 4 is an enlarged perspective view showing a side stopper:

FIG. 5 is a perspective view showing tbe pressure mechanism and a guide frame;

FIG. 6 is a perspective view showing a drive mechanism for the pressure mechanism;

FIGS. 7, 8 and 9 are horizontal sectional views showing a sheet guide section of a lower unit respectively;

FIG. 10 is an elevational view showing the sheet guide section of the lower unit;

FIGS. 11*a*, 11*b* and 11*c* are explanatory drawings showing a sheet storing operation;

FIGS. 12*a*, 12*b*, 12*c* and 12*d* are explanatory drawings showing a sheet refeeding operation;

FIG. 13 is an exploded perspective view showing a drive mechanism for a lower regulation plate;

FIG. 14*a* is a plan view showing a geared motor:

FIG. 14*b* is an elevational view showing the geared motor;

FIG. 14*c* is a left side view showing the geared motor;

FIG. 14*d* is a right side view showing the geared motor;

FIG. 15 is an exploded perspective view showing a mounting arrangement of a diverter pawl;

FIG. 16 is an exploded perspective view showing a mounting arrangement of a sheet tray and its support plate;

FIG. 17 is a vertical sectional view showing a mounting arrangement of the support plate;

FIG. 18 is a partial perspective view showing the back of a sorter;

FIG. 19 is a diagram showing a control circuitry;

FIG. 20 is a flow chart showing a main routine carried out by a microcomputer for the sheet storing-/refeeding unit;

FIG. 21 is a flow chart showing a subroutine for converting the system operation speed;

FIG. 22 is a flow chart showing a subroutine for timer setting;

FIG. 23 is a flow chart showing a subroutine for duplex/composite copying control;

FIG. 24 is a flow chart showing a subroutine for controlling the sheet storing state;

FIGS. 25 and 26 are flow charts showing a subroutine for putting the regulation plates back to the initial positions;

FIGS. 27, 28 and 29 are flow charts showing a subroutine for a regulation plate driving process:

FIG. 30 is a flow chart showing a subroutine for controlling the speed of the lower regulation plate;

FIG. 31 is a flow chart showing a subroutine for stopping the lower regulation plate at a home position or a sheet regulation position;

FIGS. 32*a*, 32*b* and 32*c* are flow charts showing a subroutine for controlling the pressure mechanism at the sheet storing time;

FIGS. 33 and 34 are flow charts showing a subroutine for controlling the sheet refeeding state;

FIGS. 35*a*, 35*b*, 35*c* and 35*d* are flow charts showing a subroutine for controlling refeeding clutches;

FIGS. 36*a*, 36*b* and 36*c* are flow charts showing a subroutine for controlling the pressure mechanism at the sheet refeeding time; and FIG. 37 is a flow chart showing a subroutine for detecting/treating a sheet jam.

DETAILED DESCRIPTION OF THE PREFERRED EMBODIMENT

An embodiment of the present invention will now be described with reference to the accompanying drawings wherein the invention is applied as a sheet storing-/refeeding unit for a copying machine.

[Copying Machine]

A copying machine 1, which is mounted on a desk 5, is designed to copy an original image on a sheet based on a well-known electrophotographic copying method. Inside the copying machine 1, a photosensitive drum 10, placed approximately at the center of the copying machine 1, is driven to rotate in the direction indicated by arrow (a). First, the photosensitive drum 10 is charged with an electrostatic charge by an electric charger 11, and then an optical unit 12 is moved in the direction indicated by arrow (b), by which the image of an original placed on an original glass table 13 is subjected to a slit exposure to be projected onto the photosensitive drum 10. The electrostatic latent image formed on the photosensitive drum 10 is developed into a corresponding toner image by a magnetic brush type of developing device 14, and then transferred onto a sheet by means of a transfer charger 15.

The photosensitive drum 10 is continued to rotate in the direction of arrow (a) even after a toner image is transferred so that the residual toner can be removed by a cleaning device 17 with a blade, and simultaneously the residual electric charge is erased by an eraser lamp 18 in order to prepare for the next copying operation.

Copying sheets which are loaded in automatic feeding cassettes 20, 21 and 22, are fed one by one selectively from the cassettes 20, 21 or 22. Then, a fed sheet is synchronized with a toner image formed on the photosensitive drum 10 by pairs of timing rollers 23, and is transported to a transfer section. After the transfer processing, the sheet is separated from the drum 10 by means of the ac corona discharge from a separation charger 16 and its stiffness. Further, the sheet is delivered to a fixing device 25 by a transport belt 24 which is provided with an air suction unit not shown in the drawings, where the toner image is fixed to the sheet, then the sheet is discharged from the copying machine 1 by pairs of discharge rollers 26.

In contrast, below the photosensitive drum 10, a refeeding path 30, through which sheets are fed from a storing/refeeding unit 40 as described in detail later to the timing rollers 23, is provided. The refeeding path 30 comprises pairs of transport rollers 31 and 32 as well as guide plates 33 and 34 disposed adjacent to the rollers 31 and 32. Copying sheets are fed into the refeeding path 30 with the copied image up at the time of a duplex copying mode, or with the upper surface down at the time of a composite copying mode which will be described later. The sheet is transported from the refeeding path 30 to the timing rollers 23 through pairs of rollers 27, then is supplied to the transfer section.

[Storing/Refeeding Unit]

(Basic Constitution)

As shown in FIG. 2, the storing/refeeding unit 40 comprises an upper unit 50 having the functions of transporting, aligning, and refeeding sheets, and a lower unit 130 having the function of storing sheets. The upper unit 50 is suspended on U-shaped grooves formed at hooks 2 fixed to a front frame and a rear frame of the copying machine 1 by engaging a stepped shaft 51 thereof fixed to a front frame and a rear frame of the upper unit 50. The lower unit 130 is fixed to a side of the desk 5 with screws with its upper end portion slightly inserted in the upper unit 50.

The reason why the storing/refeeding unit 40 is separated into the two sub-units 50 and 130, both of which are independently detachable from the copying machine 1 and the desk 5, is to facilitate the removing operation of the sub-units 50 and 130 as well as to permit independent removal of the sub-units 50 and 130, which assures greater stability when the sub-units 50 and 130 are removed and placed on the floor.

The storing/refeeding unit 40 can be combined with selectively a sheet tray 80 or a sorter 200. FIG. 2 shows the condition where the storing/refeeding unit 40 is combined with the sheet tray 80. FIG. 1 shows the condition where the unit 40 is combined with the sorter 200. The construction and function of the sorter 200 are well known, i.e. to distribute sheets among a total of 20 bins 210 disposed one upon another. When the sorter 200 is used, the sheet tray 80 is placed in the uppermost bin position to function as a sheet tray in a non-sorting mode or as the first bin in a sorting mode.

The storing/refeeding unit 40 comprises a sheet diverter section 60 for changing the transport form of sheets ejected from the copying machine 1, an intermediate storing section 90 for temporarily storing the sheets whose first surface has received a copied image in the duplex/composite copying mode, and a sheet refeeding section 160 for refeeding the sheets which have been stored in the intermediate storing section 90 toward the refeeding path 30 one after another for the image copying on the second surface.

(Constitution and Operation of the Diverter Section)

The sheet diverter section 60 comprises guide plates 61*a*, 61*b*, and 62, diverter pawls 70 and 73, pairs of ejection rollers 75, pairs of transport rollers 76, guide plates 78 and 79, etc. The diverter pawl 70 has an upper surface 70*a* for guiding sheets, and arched surfaces 70*b* and 70*c* to which a resin film 72 is adhered for guiding sheets. The film 72 has a tip portion in contact with the guide plate 62 to pass the sheet coming from the left portion in FIG. 2 toward the right portion. The film 72 guides the sheet coming from the right portion toward the arched surface 70*c* of the diverter pawl 70. The diverter pawl 70 is pivoted on a shaft 71 and changed over between a position as illustrated by the solid line and a position as illustrated by the dashed line in FIG. 2 by the turning-on and turning-off operations of a solenoid. The other diverter pawl 73 has an upper surface 73*a* for guiding sheets and an arched surface 73*b*. The diverter pawl 73 is pivoted on a shaft 74 to be changed over between a position as illustrated in the solid line and a position as illustrated in the dashed line by the turning-on and turning-off operations of a solenoid. The rotating direction of the ejection rollers 75 can be changed forward or backward via a clutch by the turning-on and turning-off operations of a solenoid. The guide plate 79 is pivoted on a shaft 77 in the direction of arrow (c) to open the path for removing the jammed sheet, etc.

The sheet tray 80 is supported on a support plate 82, where the trailing end of sheets ejected through the ejection rollers 75 are regulated and aligned by means of a regulation plate 89. When the sheet tray 80 is attached to the storing/refeeding unit 40, the diverter pawl 73 is removed. When the sorter 200 is attached, the sheet tray 80 and the support plate 82 are removed to be replaced by the diverter pawl 73.

At the sheet path composed of the upper surface 70*a* of the diverter pawl 70 and the guide plate 62 as well as below the transport rollers 76 in the sheet path composed of the guide plates 78 and 79 are respectively provided with photosensors SE1 and SE2 which respectively have actuators 65 and 66 to detect a sheet passing. An eraser brush is arranged above the diverter pawl 73 to remove electrostatic charge of a sheet ejected from the storing/refeeding unit 40.

The following describes the sheet passing form through the diverter section 60.

When a sheet is ejected in the one-sided copying mode or in the duplex/composite copying mode, the diverter pawls 70 and 73 are set respectively to the positions as illustrated by the solid line and the dashed line, and the ejection rollers 75 rotates forward so as to transport the sheet to the diverter pawl 73. When the sorter 200 is attached, the sheet transported from the copying machine 1 to the diverter section 60 through the ejection rollers 26 is guided by the guide plate 62, the upper surface 70*a* of the diverter pawl 70, and the upper surface 73*a* of the diverter pawl 73, and the sheet is provided with travel force by the ejection rollers 75 to be transported into the sorter 200. When the sheet tray 80 is attached, the diverter pawl 73 is removed from the storing/refeeding unit 40, and therefore the sheet is ejected from the ejection rollers 75 directly onto the sheet tray 80.

When the sheet whose first surface has received an image is ejected from the copying machine 1 in the duplex copying mode, the diverter pawl 70 is set to the position as illustrated by the dashed line, and the sheet is guided by the guide plate 78 and the arched surface 70*b* of the diverter pawl 70 to be transported from the transport rollers 76 toward the intermediate storing section 90 which will be described in detail later.

Further, when the sheet whose first surface has received an image is ejected from the copying machine 1 in the composite copying mode, the diverter pawl 70 is set to the position as illustrated by the solid line, and the ejection rollers 75 is rotated forward. The sheet is guided by the upper surface 70*a* of the diverter pawl 70 and the arched surface 73*b* of the diverter pawl 73. When a certain period has passed since the trailing end of the sheet was detected by the photosensor SE1, the forward rotation of the ejection rollers 75 is stopped. This period corresponds to the time required for the trailng end of the sheet to move from the detection point of the photosensor SE1 to an arbitrary point between the leading end of the film 72 and the ejection rollers 75. The sheet is stopped with its trailing end held by the ejection rollers 75. When the forward rotation of the ejection rollers 75 is stopped in the apparatus provided with the sorter 200, the leading end of the sheet is guided by the arched surface 73*b* of the diverter pawl 73, the trailing end regulation plate 89, a guide surface 79*a* provided for the guide plate 79, a guide surface 95*a* of the guide frame 95, a guide surface 97*a* of the guide frame 97, and side surfaces 201 and 202 of the sorter 200 to be positioned in a space defined by these members. As shown in FIG. 18, the side surfaces 201 and 202 of the sorter 200 is provided with ribs to smoothly guide the sheet. The other guide surfaces 79*a*, 95*a* and 97*a* are also provided with ribs for the same purpose.

When the sheet tray 80 is attached, the sheet is guided onto the sheet tray 80. Then, the ejection rollers 75 are rotated backward, by which the sheet whose trailing end is held by the ejection rollers 75 is transported left in FIG. 2, i.e. switched back to be transported into the intermediate storing section 90 through the transport rollers 76, guided by the film 72 and the arched surface 70*c* of the diverter pawl 70.

(Mounting Arrangement of the Diverter Pawl)

As shown in FIG. 15, the diverter pawl 70 is pivoted on a shaft 71, bearings 180 and 181 being disposed on both ends of the shaft 71 outside the front frame and the rear frame not shown in the drawings. An end of the shaft 71 is connected to a plunger 182 of a solenoid SL1 through a lever 183. The solenoid SL1 is fixed to the front frame not shown in the drawings through a bracket 184. When the solenoid SL1 is turned off, the diverter pawl 70 is urged by a coil spring 185 wound around the shaft 71 to be put in a position as illustrated by the solid line in FIG. 2. When the solenoid SL1 is turned on, the diverter pawl 70 is turned in the direction of arrow (p) to be put in a position as illustrated by the dashed line.

The other diverter pawl 73 is pivoted on a shaft 74 by disposing a bearing at the back end of the shaft 74 inside the frame not shown in the drawings and inserting a shaft portion 187*a* of a lever 187 in a hole 74*a* formed on the front end of the shaft 74. The diverter pawl 73 is connected to a plunger 188 of a solenoid SL2 through the lever 187. The solenoid SL2 is fixed to the rear frame not shown in the drawings through a bracket 189. When the solenoid SL2 is turned off, the diverter pawl 73 is urged by a coil spring 190 wound around the shaft portion 187*a* to be put in a position as illustrated by the dashed line in FIG. 2. When the solenoid SL2 is turned on, the diverter pawl 73 is turned in the direction of arrow (q) to be put in a position as illustrated by the solid line.

The axial movement of the diverter pawl 73 is regulated by engaging an elastic spacer 191 with the shaft 74. Therefore, to remove the diverter pawl 73, firstly pull out the spacer 191 from the shaft 74 in the direction of arrow (r) (downward), and then slide the diverter pawl 73 in the direction of arrow (s) (backward). With these operations, the engagement between the hole 74*a* and the lever shaft portion 187*a* is released. Finally, pull the front side of the diverter pawl 73 slightly upward and move the pawl 73 in the reverse direction of arrow (s) to remove the pawl 73. For mounting the diverter pawl 73, perform the above procedures in reverse order. With the above construction, the diverter pawl 73 can be easily mounted and removed without the use of tools.

(Mounting Arrangement of the Sheet Tray)

As shown in FIGS. 16 and 17, the support plate 82 is fitted between frames 52 and 53 by engaging each protrusion 82*a* on one end of the plate 82 with the opening 52*a* of the frame 52, engaging each protrusion 82*b* on the other end thereof with the opening 53*a* of the frame 53, and engaging a notch 82*c* of each protrusion 82*b* with the lower edge of the opening 53*a*. The regulation plate 89 is fitted between the frames 52 and 53 with screws. The sheet tray 80 is attached to the upper unit 50 as being appropriately positioned by putting its lower edge on the support plate 82, and engaging its protrusion 80*b* respectively with slits 89*a* of the regulation plate 89. The lower rollers of the ejection rollers 75 are placed in notches 89*b* of the regulation plate 89.

In replacing the sheet tray 80 with the sorter 200, the sheet tray 80 can be removed by disengaging the protrusions 80*b* from the slits 89*a*. The support plate 82 can be removed by pushing the protrusions 82*b* upward in the direction of arrow (t) to disengage the plate 82 from the notch 82*c*, and then the plate 82 is moved in the direction of arrow (u) (to the front) to disengage the protrusions 82*b* from the rear frame 53. With the above construction, the sheet tray 80 and the support plate 82 can be easily mounted and removed without the use of tools.

When the sheet tray 80 is attached, the upward movement of the support plate 82 is regulated by the force of gravity of the plate 82 and the tray 80.

(Constitution and Operation of the Intermediate Storing Section)

The intermediate storing section 90 is composed of a segment belonging to the upper unit 50 and a segment belonging to the lower unit 130. In detail, the intermediate storing section 90 comprises a frame 91 having a guide surface 91*a*, a guide frame 95, a base plate 100, side regulation plates 105 (refer to FIG. 3) for guiding both sides of a sheet, a support plate 110 for supporting the side regulation plates 105, guide frames 97 and 98, pairs of storing rollers 116, a paddle wheel 117, a pressure mechanism 120 for pressing the trailing portion of the sheet to be stored, a frame 131, a lower regulation plate 140 for regulating the lower edge of the stored sheet, first guide members 151 and 152 made of a wire material, second guide members 153 made of a wire material, a stepping motor M1 for driving the side regulation plates 105, and a geared motor M2 for driving the lower regulation plate 140, etc. In the portion where the guide frames 97 and 98 are placed, a photosensor SE4 having an actuator 159 is installed to detect whether the intermediate storing section 90 is stored with sheets.

The sheet carrying surface comprises the base plate 100, the support plate 110 and the guide frame 98 when sheets are stored in the intermediate storing section 90.

The lower regulation plate 140 is for regulating the lower edges (the leading ends for the storing) of the sheets stored as being fixed to a timing belt 143 extending between a pulley 141 of the geared motor M2 mounted to the frame 131 and a pulley 142 rotatably mounted to the frame 131. The lower regulation plate 140 can move vertically along the inclined surface of the frame 131 based on the forward or reverse rotation of the geared motor M2 to be appropriately positioned in terms of height according to the size of the sheets to be stored. In this embodiment, the arrangement is such that B5-sized sheets can be transported on latitudinal positioned, A4-sized and B5-sized sheets can be transported on longitudinal positioned and latitudinal positioned respectively, and B4-sized and A3-sized sheets can be transported on longitudinal positioned, transport regulation being center based in all cases. In FIG. 2, the position of the lower regulation plate 140 shown by the solid line is a regulation position in the case of latitudinal positioned for B5 size, a minimum size, and the lower regulation plate 140 assumes this position as its home position, from which it is moved to a position corresponding to any relevant sheet size when the geared motor M2 is driven. The reason why the lower regulation plate 140 is moved in this way according to the size of sheets is that the upper edges of the stored sheets has to be held at a constant level in preparation for subsequent refeeding operation, the upper end level of the sheets being taken as a level at which the upper portion of each sheet is ready to touch a refeeding roller 161 as shown in FIGS. 11*a*, 11*b* and 11*c*.

The following describes the drive mechanism of tbe lower regulation plate 140 with reference to FIG. 13.

The lower regulation plate 140 is linked to the timing belt 143 via a slide member 144. The slide member 144 is guided vertically along a slit formed on the inclined surface of the frame 131. A protrusion 144*a* formed on the slide member 144 disturbs the optical axis of a photosensor SE7 when the lower regulation plate 140 is positioned at the uppermost home position, and thereby the position of the lower regulation plate 140 is detected. An output pulley 141 is fitted to a shaft 145 of the geared motor M2, while an idle pulley 142 is supported at the frame 131 as being rotatable around a shaft 147 via a bracket 146. The timing belt 143 is extended between the pulleys 141 and 142 as mentioned above.

As shown in FIGS. 14*a* through 14*d*, the geared motor M2 has a worm gear 148*a* and a pulse-generating disk 149 fixed to a drive shaft of the motor M2, a helical gear 148*b* engaging with the worm gear 148*a*, an intermediate gear 148*c* fixed to the same shaft of the helical gear 148*b*, and a gear 148*d* rotatably supported around a pulley shaft 145 so as to engage with the intermediate gear 148*c*. The rotation force of the motor M2 is transmitted to the output pulley 141 via the gears 148*a* through 148*d*. Since the geared motor M2 employs a reduction mechanism comprising the worm gear 148a and the helical gear 148b in its drive system, even when the geared motor M2 is turned off with sheets put on the lower regulation plate 140, the lower regulation plate 140 is not displaced downward by the weight of the stored sheets.

The travel amount of the lower regulation plate 140 is detected by counting the rotation amount of the pulse-generating disk 149 fixed to the drive shaft by a photosensor SE8. The travel speed of the lower regulation plate 140 is made sufficient to move to the regulation position for any selected sheets size within a time from the start of the sheet feeding in the copying machine 1 to the passage of the trailing end of the sheet through the storing rollers 116 without regard to the position of the lower regulation plate 140. Therefore, it is not required to delay the sheet feeding for the attainment of moving the lower regulation plate 140 to the appropriate regulation position, which does not reduce the efficiency of image copying procedures.

The paddle wheel 117 has a plurality of flexible radial fins around its rotating shaft as being rotatable in the direction of arrow (d) to exert supplementary transport force to each of the sheets transported from the storing rollers 116 to the intermediate storing section 90. The tip of the paddle wheel 117 is spaced a predetermined distance from the guide frame 98 so that if a small number of sheets are stored and there is little resistance to sheet transport, no more mobility than required is given to the sheets, each sheet being prevented from "crease" development thereon. If more than a predetermined number of sheets has been stored, the paddle wheel 117 will thereafter press the sheets strongly against the guide frame 98 as the stored sheets are increased in number and impart high mobility in proportion to the increase the number of sheets. Meanwhile, as described hereinafter, in the process of sheet refeeding, the paddle wheel 117 does not come into contact with the sheets when the number of sheets is decreased below a certain number, and there will be no transport resistance from the paddle wheel 117.

The first guides 151 and 152 are made of wires having a certain rigidity as being supported by the guide frames 97 and 98 at the upper position and supported by a holder 132 disposed at the lower edge of the frame 113. As shown in FIG. 8, the internal first guides 151 are extended through slits 140a formed on the lower regulation plate 140, while the external first guides 152 are placed outside the lower regulation plate 140, both of them being expanded outward as extending downward (refer to FIG. 10).

The second guides 153 are made of elastic wires as being supported by the frame 97 at the upper portion. The second guides 153 are extended through slits 140b of the lower regulation plate 140 as being placed in a position for guiding the approximate center portion of the sheet and movable in the direction of the sheet stacking.

These guides 151, 152 and 153 are constructed of a wire material in order to minimize possible resistance against sheets transported and electrostatic adsorption force. They prevent stored sheets from slipping from the lower regulation plate 140 and also function to enable sheets to be loaded smoothly and prevent sheets from buckling. Concretely, as shown in FIG. 7, the first guides 151 and 152 exert no effect on the sheets when the sheets are in B5 size and in latitudinal positioned because the lower regulation plate 140 is set in a position as illustrated by the solid line in FIG. 2. The second guides 153 are placed in the position (a) when no sheets are stored, and the distance between the frame 98 and the second guides 153 is set narrower than the maximum thickness of the sheet stack. The second guides 153 are moved outward as the amount of stored sheets increases. The position (b) corresponds to the retreating position. The sheets S1 illustrated by the dashed lines correspond to those in curled conditions.

FIGS. 8 and 9 show respectively the condition where an A4-sized sheet is transported latitudinal positioned, and the condition where an A3-sized sheet is transported longitudinal positioned. Since the first guides 152 are extended outward from the middle portion, an A3-sized sheet transported longitudinal positioned can be satisfactorily regulated on both sides. Of course the first guides 152 cooperate with the second guides 153 to stiffen the passing sheet, whereby even a curled sheets S2 and S3 can be properly stored without bending.

As shown in FIGS. 3 and 5, the pressure mechanism 120 comprises arms 121 placed at both sides, a pressure plate 122 fitted to the tip portions of the arms 121, a roller pressure plate 123 fixed to the pressure plate 122 at a position corresponding to that of the refeeding roller 161 as described in detail later, and an arm 125 for preventing sheets from bending, which is positioned in an approximate center position. The pressure mechanism 120 is pivoted on the guide frame 95 via a shaft 124 supporting the arms 121 and turns between a position as illustrated by the solid line and a position as illustrated by the dashed line in FIG. 2 by turning on and off a solenoid. The sheet-bending prevention arm 125 inclines toward the support plate 110 as bending in a middle portion 125a. The bending middle portion 125a regulates the stored sheet to prevent the sheet from bending. The arm 125 also functions to stiffen the sheet in the storing direction when it is put in contact with the sheet.

As shown in FIG. 5, the guide frame 95 supporting the pressure mechanism 120 via its shaft 124 pivots in the direction of arrow (j) on a shaft 96 fitted to one end thereof, which enables the upper portion of the intermediate storing section 90 to be open. With the opening motion, the pressure mechanism 120 can retreat from the intermediate storing section 90. The arm 121 and the guide frame 95 is connected to each other by a torsion coil spring 126 wound around the shaft 124 to keep the pressure mechanism 120 at a position (home position) as illustrated by the solid line in FIG. 2. A protrusion 121a provided for the arm 121 can disturb the optical axis of a photosensor SE5 (refer to FIG. 3). Whether the photosensor SE5 is on or off determines whether the pressure mechanism 120 is returned to the home position or driven to the position for pressing the trailing portion of the sheets.

The following describes the drive mechanism of the pressure mechanism 120 with reference to FIG. 6.

The drive source is the main motor for driving the sheet transporting mechanism in the storing/refeeding unit 40. The rotation force of the main motor is transmitted to a pulley 181 by means of a timing belt 180, whereby the pulley 181 is driven to rotate in the direction of arrow (v). A ratchet wheel 183 and a cam 184 are mounted around a shaft 182 and capable of rotating together with the pulley 181 via a spring clutch not shown in the drawings. Recesses 183a, 183b, 184a and 184b are formed on the peripheries of the ratchet wheel 183 and the cam 184 respectively. Incidentally, the recess 183b is not shown in FIG. 6. A solenoid SL3 has a lever 185 which is capable of pivoting on its one end 185a. In the off condition, the lever 185 is pivoted in the direction of arrow (w), and a pawl 185b comes into engagement with the recesses 183a and 184a or the recesses 183b and 184b to stop the rotation of the ratchet wheel 183 and the cam 184. Only when the pressure mechanism 120 is driven, the solenoid SL3 is momentarily turned on to rotate the ratchet wheel 183 by an angle of 180 degrees.

The lower edges of drive plates 187 and 188 are fitted to a shaft 186 located on the same axis as the shaft 124 of the pressure mechanism 120, and the drive plates 187 and 188 are capable of turning on the shaft 186. The drive plates 187 and 188 are urged in the direction for reducing the distance between them by means of a torsion coil spring 189 wound around the shaft 186, and a pin 190 fitted to the tip portion of the drive plate 187 abuts against the side of the tip portion of the other drive plate 188. The drive plate 187 is connected to the periphery of the cam 184 via a link member 192 whose both ends are linked with pins 190 and 191. A sliding pin 193, which is fitted to the tip portion of the drive plate 188 via bearing 194, slides along the axial direction. A pin 196 pierces through the sliding pin 193 at the end at a right angle, and rollers 195 are rotatably fitted to both ends of the pin 196. A compressing coil spring 198 is wound around the sliding pin 193 between the drive plate 188 and a flange 197. With the elasticity of the spring 198, the sliding pin 193 and rollers 195 are biased toward the arm 121, while the rollers 195 are placed at the rear of the arm 121.

With the above construction, when the recess 184a of the cam 184 engages with the pawl 185b of the lever 185, the drive plates 187 and 188 are turned in the opposite direction of arrow (f) and positioned. The pressure mechanism 120 is urged in the opposite direction of arrow (f) by the elasticity of the torsion coil spring 126 to be in the position where the rear portion 121b of the arm 121 abuts against the rollers 195, i.e. the home position. When the solenoid SL3 is turned on to allow the lever 185 to disengage the pawl 185b from the recess 184a, the cam 184 is rotated in the direction of arrow (v) by angle of 180 degrees. At the same time, the drive plate 187 is forced to pivot in the direction of arrow (f), and accordingly the drive plate 188 that is connected to the plate 187 via the torsion coil spring 189 pivots in the direction of arrow (f). Simultaneously, the rear portion 121b of the arm 121 is pressed by the rollers 195, and the pressure mechanism 120 is pivoted in the direction of arrow (f) to press the trailing portion of the sheet transported to the intermediate storing section 90 against the base plate 100. The pressing position can be maintained by the engagement of the pawl 185b of the lever 185 with the recess 184b of the cam 184. Then the subsequent turning-on of the solenoid SL3 puts the drive plates 187 and 188 back to the home positions. Namely, the pressure mechanism 120 is set at the pressing position or the home position, each time the solenoid SL3 is turned on. It is noted that the main motor must be kept in a rotating condition for supplying the drive force during the above-mentioned operations.

To assure the above-mentioned operations, the elasticity of the torsion coil spring 189 for giving a combining force to the drive plates 187 and 188 is designed to be greater than that of the torsion coil spring 126 for giving a restoring force to the pressure mechanism 120. Furthermore, the elasticity of the torsion coil spring 189, which exerts a pressure onto the upper end portion of the sheets via portion pressure mechanism 120 at the time of sheet refeeding process as described in detail later, must be controlled. Therefore, the elasticity is determined in consideration of the reaction force of the restoration torsion coil spring 126 to exert an appropriate pressure onto the upper end portion of the sheets against the refeeding roller 161, whereby ensuring the sheet refeeding. When the amount of sheets in the intermediate storing section 90 increases, the travel of the pressure mechanism 120 in the directon of arrow (f) is gradually reduced. At this time, the distance between the pin 190 and the drive plate 188 is increased and the elasticity of the torsion coil spring 189 increases to consequently increase the pressure of the pressure mechanism 120 on the sheets.

The gradual reduction of the travel of the pressure mechanism 120 in proportion to the amount of stored sheets and the consequent increase of the pressure assures a constant load, and an excellent sheet refeed is attained by virtue of the automatic adjustment of the sheet refeed pressure in accordance with the amount of stored sheets as described in detail below. Namely, when the sheets stored in an approximate vertical stand position are fed one after another separately, the greater the amount of the stored sheets is, the greater the resistance against the sheet feed is assured. However, the torsion coil spring 189 exerts an increasing pressure onto the refeeding roller 161 in accordance with the increase of the stored sheets in amount, therefore an appropriate sheet feeding pressure is assured in conformity with the amount of the sheets.

As shown in FIG. 5, the pressure mechanism 120 can pivot in the directon of arrow (j) together with the guide frame 95 to open the intermediate storing section 90. While the section 90 is opened, the rear portion 121b of the arm 121 presses the rollers 195 to put the roller closer to the drive plate 188 together with the sliding pin 193 against the elasticity of the compression coil spring 198. With this operation, the engagement between the arm 121 and the rollers 195 is automatically released. When the pressure mechanism 120 is closed, the rollers 195 slide along the inclined surface 121c formed on the arm 121 to engage with the rear portion 121c. To ensure the reengagement, the solenoid SL3 is turned on when the presure mechanism 120 is closed together with the guide frame 95. With this arrangement, even when the reengagement is incomplete, the rollers 195 are securely moved to the rear portion along 121b the inclined surface 121c.

At the entrance of the intermediate storing section 90, a separator 93 mounted to the guide frame 91 and a brush 99 for removing the electrostatic charge are arranged. The separator 93 is pivoted on a shaft to the frame 91 as hanging down perpendicularly by its own gravity force. The separator 93 guides both sides of the sheet being transported into the storing section 90, and regulates the trailing end of the sheet in the storing direction (the upper end portion in the stored condition) toward the base plate 100 to prevent possible sheet jam at the entrance of the storing section 90. For this purpose, as shown in FIG. 3, the separator 93 is placed between the storing rollers 116. The pressure plate 122 is formed with a notch 122a at the portion facing the separator 93 to prevent mutual interference.

As shown in FIG. 3, the side regulation plates 105 are movable on the support plate 110 in the lateral direction of the sheet, and connected to the reversible stepping motor M1 at the rear of the support plate 110. Namely, the side regulation plates 105 can be moved in the lateral direction of the sheet by driving the stepping motor M1 forward and backward. The plates 105 have their home positions slightly outward at both sides of the sheet in a maximum size, and are moved from the position to the side regulation position corresponding to the sheet size.

The mounting position of the support plate 110 for supporting the side regulation plates 105 can be finely adjusted in the lateral direction of the sheet with respect to the base plate 100. Namely, the support plate 110 is formed with a slit 111 extending in the lateral directon of the sheet for fastening the screw 112. Within the slit 111 the fixing position of the plates 105 is finely adjusted in the lateral direction, and following this operation, the positions of the side regulation plates 105 are finely adjusted. This adjustment is for correcting the possible shear between the first copying image and the second copying image in the lateral direction of the sheet. This arrangement is effective particularly to the composite copying where two images are formed onto the identical surface of the sheet.

The following describes the sheet storing operation.

First, for the preparatory operation, the lower regulation plate 140 is moved to the position corresponding to the sheet size to be stored, and the side regulation plates 105 are moved to the position corresponding to both sides of the sheet. At the same time, the pressure mechanism 120 is set to the position as illustrated by the solid line in FIGS. 2 and 11*a*, while the storing rollers 116 and the paddle wheel 117 are started to rotate.

The sheet diverting section 60 selects the transport path for the sheet. The sheet transported from the transport roller 76 downward is provided with travel force by the storing rollers 116 to be transported into the intermediate storing section 90 as being erased of electrostatic charge by the electrostatic erase brush 99. When the leading end of the sheet is detected by the photosensor SE2, the side regulation plates 105 retreat slightly outward from the side regulation position of the sheet. The sheet is transported into the intermediate storing section 90 as being guided by the separator 93 (refer to FIG. 11*a*). When a certain period has passed since the trailing end of the sheet being transported to the storing section 90 was detected by the photosensor SE2, the side regulation plates 105 are moved to the position corresponding to both sides of the sheet to align the sheet in the lateral direction. Then the pressure mechanism 120 is pivoted to the position as illustrated by the dashed line in the direction of arrow (f) to press the trailing portion of the sheet against the base plate 100 (refer to FIGS. 11*b* and 11*c*). At this time, as shown in FIG. 11*b*, the trailing end of the sheet pivots the separator 93 in the direction of arrow (c), i.e. moves into the base plate 100 by pushing the separator 93 aside. The separator 93 is turned in the direction of arrow (c') by means of its own force of gravity immediately after the trailing end of the sheets departs therefrom, and is returned to the vertical position by way of the notch 122*a* of the presure plate 122.

The timing of the side regulation plats 105 moving toward the side regulation position of the sheet is designed to be slightly delayed with respect to the timing of the leading end of the sheet reaching onto the upper surface of the lower regulation plate 140. The timing of the pressure mechanism 120 pressing the trailing portion of the sheet (reaching the position as illustrated by the chain line) is designed to be slightly delayed with respect to the timing of the side regulation plates 105 reaching the side regulation position of the sheet. With the timing control above, sheets are first aligned in the longitudinal direction, and second aligned in the lateral direction. Finally the trailing end portion is moved toward the base plate 100, whereby a satisfactory sheet alignment can be achieved. Further, every time a sheet is stored into the intermediate storing section 90 linking with the pressing operation, the middle portion of the arm 125 placed at the center position of the pressure mechanism 120 pushes the sheet to the support plate 110 and eliminates sheet bending to keep the sheets in a well-regulated condition.

After the first sheet is stored, first, the pressure mechanism 120 is put back to a position as illustrated by the solid line. When the leading end of the next sheet is detected by the photosensor SE2, the side regulation plates 105 are moved outward again, and the side regulation plates 105 and the pressure mechanism 120 are subsequently driven in the same timing as for storing the first sheet.

The procedure for controlling the above-mentioned operation is described in detail hereinafter.

As shown in FIG. 11*a*, when the pressure mechanism 120 is placed in the retreating position from the pressing position, the trailing end of the stored sheet is regulated by the separator 93 to prevent a sheet jam at the entrance of the intermediate storing section 90. This arrangement eliminates the fear of a sheet jam which may be caused by a collision between the sheet already stored and the sheet subsequently transported and also prevents an insertion of a sheet into the stored sheets which may result in disorder of paging. The separator 93 also functions as a guide plate at the time of storing sheets as mentioned to guarantee ensured sheet storing even when the shets are curled. Therefore, there is no need to provide a large space above the intermediate storing section 90 in preparation for curled sheets.

Furthermore, in this embodiment, the side regulation plates 105 are also provided with side stoppers 106 having the same function as that of the separator 93. As shown in FIG. 3, each of the side stoppers 106 comprises an inclined surface 106*a*, a regulation surface 106*b*, and a protrusion 106*c*, and is pivoted on a pin 107 at a notch formed on an upper portion of the corresponding side regulation plate 105. Each of the stoppers 106 is urged in the direction of arrow (g) by a spring member not shown in the drawings, and it is positioned by the pressure of the protrusion 106*c* on the corresponding side regulation plate 105 from outside.

In storing a sheet, the sheet passes along the inclined surface 106*a* of each side stopper 106, and when the pressure mechanism 120 is pivoted in the directon of arrow (f) to press the trailing portion of the sheet against the inclined surfaces 106*a*, the side stoppers 106 are moved in the opposite direction of arrow (g), whereby the trailing end of the sheet surpasses the side stoppers 106 to move toward the support plate 110. Immediately after the sheet has surpassed the side stoppers 106, the stoppers 106 are pivoted in the direction oi arrow (g) by the elasticity of the spring member to be restored, and then regulate the trailing end of the stored sheet with the regulation surfaces 106*b*.

As shown in FIG. 4, assuming that the reciprocal travel distance of the side regulation plates 105 at the sheet storing time is (n), and the adjustment range of the support plate 110 by means of the slit 111 is (1), the length (m) corresponding to the lateral direction of the regulation surface 106b of the sheet of each stopper 106 is designed to satisfy the equation:

$$m > (n+1)/2.$$

With this arrangement, even when the support plate 110 is moved within the range (l) and the position of the side regulation plates 105 are finely adjusted, both sides of the stored sheet engages with the regulation surfaces 106b when the side regulation plates 105 are moved outward for storing sheets. For this reason, the sheet does not return to the inclined surfaces 106a, i.e. the trailing end of the sheet does not clog the sheet entrance. The above-mentioned function is attained even by either the separators 93 or the stoppers 106. However, the combined use of the two as in this embodiment ensures the storing of sheets in a variety of size as well as sheets curled randomly.

(Constitution and Operation of the Refeeding Section)

The sheet refeeding section 160 is installed to feed sheets which got an image on their first surfaces and have been stored in the intermediate storing section 90 to the refeeding path 30 in the copying machine 1 one after another in the same order as being transported to the intermediate storing section 90 when a sheet refeeding signal is generated. More specifically, as shown in FIG. 2, the sheet refeeding section 160 comprises the base plate 100 which is also used as a receiving surface in the intermediate storing section 90, a refeeding roller 161 and separation roller 163 intermittently driven by a clutch to rotate, a separation pad 165 made of urethane rubber to be abutted to the separation roller 163, pairs of register rollers 170 intermittently driven by a clutch to rotate, etc. The sheet path to the refeeding path 30 comprises a guide surface 91b of the guide frame 91 and a guide plate 94. In front of the register rollers 170, a photosensor SE3 having an actuator 179 is installed. Further, the guide frame 91 is made pivotal in the direction of arrow (i) to open the sheet path for removing ammed sheets, etc.

Each sheet is provided with transport force produced by the frictions between the sheet and the refeeding roller 161 and between the sheet and the separation roller 163. The pressure of the separation pad 165 on the separation roller 163 prevents a feed of a plurality of sheets in a body by the following reason. The friction $\mu 1$ between the separation roller 163 and each sheet is set greater than the friction $\mu 2$ among sheets. The friction $\mu 3$ between the separation pad 165 and each sheet is set greater than the friction $\mu 2$ among sheets but smaller than the friction $\mu 1$. These relations are expressed as follows:

$$\mu 1 > \mu 2$$

$$\mu 1 > \mu 3 > \mu 2$$

Now, the sheet refeeding operation will be explained with reference to FIGS. 12a through 12d.

When a copying signal is generated to require sheet refeeding, first, the pressure mechanism 120 is driven to press the upper portion of the sheets (refer to FIG. 12a). After a moment has passed from the sheet pressing timing, the refeeding roller 161 and the separation roller 163 are started to rotate in the direction of arrow (h) to refeed upward the sheet being in contact with the refeeding roller 161 (refer to FIG. 12b). The sheet that has reached to the nip portion of the separation roller 163 and the separation pad 165 is fed to the register rollers 170. At this time, when a plurality of sheets are fed simultaneously, only one of the sheets being in contact with the separation roller 163 is fed to the register rollers 170 by virtue of the above-mentioned frictional forces. When a certain period has passed since the leading end of the sheet was detected by the photosensor SE3, the register rollers 170 is driven to rotate. Until the register rollers 170 are driven to rotate, the leading end of the sheet is pressed against the nip portion of the rollers 170 to be formed into a tiny loop (refer to FIG. 12c). For this purpose, the base plate 100 is provided with a dented portion 100a at the upper portion. The pressure mechanism 120 is moved backward when the leading end of the sheet is detected by the photosensor SE3, whereby the sheet remaining at the nip portion of the separation roller 163 and the separation pad 165 falls down to be put back to the original storing position (refer to FIG. 12d).

After the register rollers 170 are driven to rotate at the above-mentioned timing, the sheet is fed upward by the rollers 170, and then guided by the guide surface 91b and the guide plate 94 to the refeeding path 30 in the copying machine 1. The rotation of the refeeding roller 161 and the separation roller 163 are once stopped, a moment after the register rollers 170 was started to rotate. It is noted that the rollers 161 and 163 rotate following the feeding motion of the sheet because they are fitted around the shafts via one-way bearings.

The sheet refeeding operation for the second and subsequent sheets is performed by first detecting by means of the photosensor SE3 the leading end of the sheet. After a certain sheet feeding period corresponding to the sum of the sheet length and a certain length (margin length) has passed, the pressure mechanism 120 is driven to operate again to press the leading portion of the sheet. When the trailing end of the sheet being refed is detected by the photosensor SE3, the refeeding roller 161 and the separation roller 163 are driven to rotate again to repeat the same operation as for the first sheet as described above.

When it is detected by the photosensor SE4 that all the sheets in the intermediate storing section 90 have been refed out thereof, the lower regulation plates 140 and the side regulation plates 105 are put back to the respective home positions.

The control method for the operation is hereinafter described in detail.

[Control Circuitry]

A control circuitry for the storing/refeeding unit 40 having the above-mentioned constitution and operation is explained referring to FIG. 19.

The system control is performed mainly by a computer 300 (which is hereinafter referred to as CPU). The CPU 300 comprises a counter 301, a register 302, a memory 303, etc. and it is communicable with a CPU 310 for the copying machine 1. The counter 301 receives a count signal of the rotation pulses of the geared motor M2 from the photosensor SE8 and used for controlling the movement of the lower regulation plate 140.

On and off signals from the sensors SE1 through SE7 are entered into each input port. The optical axes of the sensors SE1 through SE4 are disturbed by respective actuators to produce off signals when the sensors detect no sheet, and the off signals are changed to on signals when the sensors detect a sheet. The sensors SE5, SE6 and SE7 produce the on signals when the optical axes are disturbed by the respective detector, and the off signals are changed to the on signals when the disturbance of the optical axes are removed.

From each output ports, on and off signals are sent to the solenoids, clutches, motors for driving each member. The solenoid SL1 puts the diverter pawl 70 in the position as illustrated by the dashed line when it receives the on signal. The solenoid SL2 puts the diverter pawl 73 in the position as illustrated by the solid line when it receives the on signal. The solenoid SL3 drives the pressure mechanism 120 into the sheet pressing position or the retreating position (home position) every time it receives the on signal. The solenoid SL4 puts the ejection rollers 75 in the reverse rotation when it receives the on signal. Further, the clutch CL1 transmits drive force to the refeeding roller 161 and the separation roller 163 in the on condition. The clutch CL2 cuts off the drive force to the register rollers 170 in the on condition.

[Control Procedure]

The following describes the control procedure for the storing/refeeding unit 40 performed by the CPU 300 with reference to FIGS. 20 through 37.

In the following paragraphs, the term "on-edge" is defined as a change in status, where the switch, sensor, signal or the like changes from the off status to the on status. In contrast, the term "off-edge" represents a change in status, where the switch, sensor, signal or the like changes from the on status to the off status.

FIG. 20 is a flow chart showing the main routine carried out by the CPU 300.

When the CPU 300 is reset to start the program, the data in a random access memory 303 is cleared, the register 302, etc. are initialized, and an initial setting is performed for putting each device back to the initial mode at step S1. Then an initial communication with the CPU 301 for the copying machine 1 is performed at step S2. When it is confirmed at step S3 that necessary communication data for the control of the storing-/refeeding unit 40 is received, a subroutine for converting the system operation speed is performed at step S4. At this step S4, the system operation speed of the copying machine 1 transmitted from the CPU 301 at step S2 is read in order to convert the data to the value of sheet transport per one count of an internal timer.

Then, the internal timer is driven to operate at step S5. The internal timer was already set at step S1 to determine the processing time of the main routine by the CPU 300, and it becomes a reference for one count of the timer at each subroutine as described later.

Then it is judged at step S6 whether a jam flag is "0". The jam flag is set to "1" when a sheet jam takes place in the storing/refeeding unit 40 (refer to step S346). Therefore, when the jam flag indicates "1", the processing directly goes to step S10. When the jam flag is reset to "0", each of subroutines S7 through S10 are called suocessively. When the processing in all the subroutines are completed, the processing returns to step S5 after the completion of the internal timer operation at step S11.

When an interruption demand is generated from the CPU 310 for the copying machine 1, an interruption operation is performed according to the data transmitted at step S15. When an interruption demand is generated from the internal counter 301, the operation of the lower regulation plate 140 is stopped at step S18. The stop operation will be described later.

FIG. 21 is a flow chart showing a subroutine for converting the system operation speed to be performed at step S4.

At this step, in view of the fact that copying machines differ in operation speed and the sheet transporting speed of the storing/refeeding unit 40 which is provided for a copying machine should be adjusted to the system operation speed of the copying machine, a conversion calculation is performed for synchronizing the control timing in the storing/refeeding unit 40 with the sheet transporting speed.

More specifically, the value of the system operation speed of the copying machine 1 is set to "A" at step S20, and the value of the internal timer of the CPU 300 is set to "B" at step S21. Then a value "A/B" is calculated at step S22, and the resulting value is stored in a memory as data of "D speed". Assuming now that the value "B" of the timer is 1 msec. constant and the value "A" of the main system operation speed is 100 mm/sec., the data "D speed" is calculated to be 0.1 mm/count, which means that a sheet moves by 0.1 mm every count of the timer.

The following describes the process for setting the timer of each subroutine based on the reference value "D speed" referring to FIG. 22. The processing at this stage is performed for setting all the timers in the subroutines.

First, a timer address is entered into an HL register at step S30. The term "address" indicates tbe address in the memory where the value of the timer to be set at this stage is stored. Then a length data corresponding to the change is entered into a BC register at step S31, the value of the data stored in the BC register is divided by the value "D speed" at step S32, and the resulting value is entered into an EA register. For example, when the length to be changed is 100 mm and the value "D speed" is 0.1 mm/count as mentioned above, the data to be entered into the EA register is 1000. This means that the 1000 counts of the timer corresponds to the transport of the sheet by 100 mm. Then the data in the EA register is stored in the address designated by the HL register at step S33.

(Control for Sheet Storing)

FIG. 23 is a flow chart showing a subroutine for duplex/composite copying control to be performed at step S7.

In the subroutine, the pawls 70 and 73, the lower regulation plate 140, the side regulation plates 105, etc. are controlled in accordance with the duplex copying mode or the composite copying mode, and sheets which have got an image on their first surfaces are ejected one after another from the copying machine 1 to the intermediate storing section 90.

The subroutine includes the subroutines S40 through S43. At step S40, the condition of stand-by, start and stop are controlled in accordance with the count value of a sheet storing state counter. The operation of the pressure mechanism 120 is controlled at step S42, and the operation of the side regulation plates 105 is controlled at step S43. No detailed description of the subroutines for the pawl control at step S41 and the side regulation plate control at step S43 is provided here.

FIG. 24 is a flow chart showing a subroutine for controlling the storing state to be performed at step S40.

First, the count value of the storing state counter is checked at step S50. The counter is reset to "0" at the initial stage. When the value is "0", it is judged at step S51 whether the photosensor SE4 is off, i.e. sheets are remaining in the intermediate storing section 90. When the photosensor SE4 is off and there is no sheet remaining, the regulation plates 105 and 140 are put back to their home positions at step S52, and a sheet presence flag is reset to "0" at step S53. Then the processing goes to step S55. When the photosensor SE4 is on and there are sheets remaining in the intermediate storing section 90, the sheet presence flag is set to "1" at step S54, and then the processing proceeds to step S55 to set the storing state counter to the value "1".

When it is judged at step S56 that the value of the storing state counter is set at "1", when it is judged at step S57 whether the print switch signal is on-edge. The on signal generated from the print switch is transmitted from the CPU 310 to the CPU 300 in the interruption operation. When the print switch signal is on-edge, it is judged at step S58 whether the copying mode to be performed at the time is the duplex copying mode or the composite copying mode. When neither of the modes takes place, no sheet storing operation is performed, and then the processing goes to step S61. When either of the duplex copying mode or the composite copying mode is selected to be performed, after confirming at step S59 that the sheet presence flag has been reset to "0", the regulation plates 105 and 140 are driven to move into the positions corresponding to the sheet size. Then, the processing proceeds to step S61 to set the storing state counter to the value "2".

When the results at steps S50 and S56 are both negative, it is judged at step S62 whether the image copying process has been completed. A copying completion signal is transmitted to the CPU 300 in the interruption operation. When the copying has been completed, the storing state counter is reset to "0" at step S63, and the subroutine is terminated.

FIG. 25 is a flow chart showing a subroutine for putting the regulation plates 105 and 140 back to the initial positions to be performed at step S52.

In the subroutine, the side regulation plates 105 are returned to the initial positions at step S70, and the lower regulation plate 140 is returned to the initial position at step S71. When it is confirmed at step S72 that the regulation plates 105 and 140 are returned to the initial positions respectively, and the subroutine is completed.

The process for returning the lower regulation plate 140 at step S71 is described in detail with reference to FIG. 26. The process for returning the side regulation plates 105 is not described in detail here, and it is basically the same operation as shown in FIG. 26.

Now, the following describes the lower regulation plate return process at step S71 with reference to FIG. 26. At the steps, first, the lower regulation plate 140 is raised to the home position at a first speed, and second, the plate 140 is lowered from the home position at a second speed that is half the first speed, and finally the plate 140 is put back to the home position at the second speed.

First, it is judged at step S80 whether a home set flag is "0", and then it is judged at step S81 whether a first home check flag is "0". The home set flag is set to "1" when the lower regulation plate 140 is set to the home position finally, and the first home check flag is set to "1" when the lower regulation plate 140 is once put back to the home position. When the results at steps S80 and S81 are both positive, it is judged at step S82 whether the photosensor SE7 is on, i.e. whether the lower regulation plate 140 is in the home position. When the photosensor SE7 is off, the motor M2 is driven to raise the lower regulation plate 140 at step S87. When it is confirmed that the photosensor SE7 is turned on and the lower regulation plate 140 is once put in the home position, the motor M2 is stopped at step S83, and a value "40" is entered into the BL register at step S84. In this place, the value "40" to be entered into the BL register is the count value of the photosensor SE8 for detecting the motor rotation pulses. Then the subroutine for lowering the lower regulation plate 140 is performed at step S85, and the first home check flag is set to "1" at step S86.

Next, when it is judged at step S81 that the first home check flag is "1", it is judged at step S88 whether a positioning completion flag is "1". The positioning completion flag is set to "1" when the lower regulation plate 140 is lowered by a certain amount from the home position in an interruption operation as described later (refer to step S135). Therefore, when the positioning completion flag has been set to "1", after confirming at step S89 that the signal from the photosensor SE7 is not on-edge, a half-speed request flag is set to "1" at step S94 and the motor M2 is driven to rotate for the upward movement at step S95. With these operations, the lower regulation plate 140 is raised toward the home positions at the second speed (lower speed). When it is judged at step S89 that the signal from the photosensor SE7 is on-edge, the motor M2 is stopped at step S90. At the same time, the home set flag is set to "1" at step S91 to inhibit the performance of the subroutine (step S71), the half-speed request flag is rest to "0" at step S92, and the first home check flag is reset to "0" at step S93.

FIG. 27 is a flow chart showing a subroutine for the regulation plate driving process to be performed at step S60. In the subroutine, the side regulation platess 105 and the lower regulation plate 140 are moved from the home positions to the positions corresponding to the selected sheet size.

First, the travel of each of the regulation plates 105 and 140 is calculated based on the sheet size at step S100. More specifically, the necessary travel is divided by the pulse pitches of the motors M1 and M2 to obtain the count value corresponding to the travel. Then the side regulation plates 105 are moved to the positions corresponding to the selected sheet size at step S101, and the lower regulation plate 140 is moved to the position corresponding to the selected sheet size at step S102.

The process for moving the lower regulation plate 140 at step S102 is described in detail in FIGS. 28 and 29. The process for moving the side regulation plates 105 is not described in detail here, because the process is the same as that described in FIGS. 28 and 29.

As shown in FIG. 28, the process for moving the lower regulation plate 140 begins with entering the value of the travel obtained at step S100 into the B register at step S110, and then the subroutine for lowering the lower regulation plate is performed at step S111

As shown in FIG. 29, the lower regulation plate lowering process at step S111 is performed as being common to the process at step S85 in the subroutine for returning the lower regulation plate to the initital position. Namely, a value corresponding to "30" counts is subtracted from the value of the B register, and the resulting value is entered into a register ECPT0 at step S120, and the value of the B register is entered into a register ECPT1 at step S121. Then the motor M2 is driven to lower the lower regulation plate 140.

FIG. 30 is a flow chart showing a subroutine for controlling the speed of the lower regulation plate to be performed at step S9.

In the subroutine, the travel speed of the lower regulation plate 140 is changed to the second speed (lower speed) when the half-speed request flag is set to "1". Namely, it is judged at step S130 whether the half-speed request flag is "1". When the half-speed request flag has been set to "0", the subroutine is completed. When the request flag has been set to "1", the count value of a speed state counter is checked at step S131. When the state count value is "0", it is judged at step S132 whether the present traveling direction is downward. When the traveling direction is downward, the motor M2 is driven for the downward movement at step S133, and the processing proceeds to step S135. When the traveling direction is upward, the motor M2 is driven for the upward movement at step S134, and the processing proceeds to step S135 to set the speed state counter to the value "1".

When the speed state counter is at "1", the motor M2 is stopped at step S136, and the state counter value is reset to "1". In detail, when the half-speed request flag has been set to "1", the operation of the motor M2 is changed between on and off conditions every time the processes at steps S131 through S137 are repeated. Therefore, the motor M2 consumes a half of the electric power without reducing the supply voltage to a half, which consequently results in reducing the rotation of the motor to a half.

The following describes a subroutine for the interruption operation at step S18 with refernce to FIG. 31. Thge interruption opeation is for stopping the lower regulation plate 140 at the home position or the sheet regulation position. The rotation pulses of the motor M2 from the photosensor SE8 are counted, and the process is performed when the count value coincides with the value in the registers ECPT0 or ECPT1 (refer to steps S121 and S122).

More specifically, it is judged at step S140 whether the pulse count value coincides with the value in the register ECPT0. When the values coincides, the motor M2 is stopped at step S141, and the half-speed request flag is set to "1" at step S142. When the pulse count value does not coincide with the value in the register ECPT0, i.e. the value coincides with the value in the register ECPT1, the motor M2 is stopped at step S143, the half-speed requrest flag is reset to "0" at step S144, and the positioning completion flag is set to "1" at step S145.

FIGS. 32*a*, 32*b* and 32*c* are flow charts showing subroutines for controlling the pressure mechanism at the sheet storing time to be performed at step S42.

In the subroutine, the following processes are performed in accordance with the count value of a storing pressure state counter. The state counter indicates the judgment condition for controlling the pressure mechanism 120 in accordance with the image copying condition and the sheet transporting condition.

First, it is judged at step S150 whether the count value of the storing pressure state counter is "0". When the count value is reset to "0", it is judged at step S151 whether the copying machine 1 is in operation. When the copying machine 1 is performing a copying operation, it is judged at step S152 whether the copying operation is performed in the duplex/composite copying modes. When the copying operation is performed in either copying mode, the present subroutine is completed immediately. When the copying operation is performed in either of the copying modes, the count value of the storing pressure state counter is checked at step S153.

When the count value of the state counter is "0", after confirming at step S154 that the main motor M3 is in operation, the pressure mechanism 120 is rest to the home position at step S155, and a main motor drive request flag is set to "1" at step S156. The request flag functions to continue the operation of the main motor M3 when it is set to "1". Then it is judged at step S157 whether the resetting of the pressure mechanism 120 has been completed. When the resetting is completed, the count value of the counter is set to "1" at step S158.

It is noted here that the resetting of the pressure mechanism 120 at step S155 is performed by turning on the solenoid SL3. Therefore, even when the arm 121 and the roller 195 are disengaged with each other, the roller 195 can be securely guided by the inclined surface 121*c* to the rear portion 121*c*.

When the count value of the state counter is "1", it is judged at step S159 whether the photosensor SE5 is on. Namely, it is judged whether the resetting of the pressure mechanism 120 at above-mentioned step S155 has been performed securely by means of the on and off status of the photosensor SE5. When the photosensor SE5 is on and the resetting is confirmed, the count value of the storing pressure state counter is set to "2" at step S160.

When the count value of the state counter is "2", it is judged at step S161 whether the output signal of the sheet presence detection sensor SE2 is off-edge, i.e. the trailing end of the sheet has passed the detection point of the photosensor SE2. When the output signal of the photosensor SE2 is off-edge, a close delay timer is set at step S162, and the count value of the state counter is set to "3". The close delay timer is for determining the pressing timing of the pressure mechanism 120, and designed to make the pressure mechanism 120 press the trailing end of the sheet after a moment from the time the leading end of the sheet to be stored reaches the lower regulation plate 140.

When the count value of the state counter is "3", after confirming at step S164 that the close delay timer operation has finished, the pressure mechanism 120 is driven at S165. With this operation, the pressure mechanism 120 presses the trailing end portion of the stored sheet and the operation once stops in this condition. Then it is judged at step S166 whether the turning on and off operation of the solenoid SL3 to perform the operation has been completed. When the turning on and off operation has been completed, a jam timer 1 for the pressure mechanism 120 is set at step S167, and the count value of the storing pressure state counter is set to "4". In this place, the jam timer 1 is used for detecting the possible sheet jam at the entrance portion of the sheet intermediate storing section 90 when the pressure mechanism 120 does not operate in spite of the fact that the turning on and off operation of the solenoid SL3 has already performed.

When the count value of the state counter is "4", it is judged at step S169 whether the photosensor SE5 is off. Namely, it is judged by the on or off status of the photosensor SE5 whether the drive of the pressure mechanism 120 at step S165 has been securely performed. When it is confirmed that the photosensor SE5 is off and the pressure mechanism 120 is in the pressing position, an open delay timer is set at step S170. The open delay timer is for holding the pressure mechanism 120 in the sheet pressing position for a certain period. Since the drive of the pressure mechanism 120 has been performed securely, the jam timer 1 for the pressure mechanism 120 is reset at step S171, and the count value of the storing pressure state counter is set to "5".

When the count value of the state counter is "5", after confirming the completion of the open delay timer operation at step S173, the pressure mechanism 120 is driven at step S174. With this operation, the pressure mechanism 120 retreats from the sheet pressing position. Then it is judged at step S175 whether the drive has been completed. When the drive has been completed, a jam timer 2 for the pressure mechanism 120 is set at step S176, and the value of the storing pressure state counter is set to "6" at step S177. In this place, the jam timer 2 is used for detecting a possible sheet jam at the portion when the pressure mechanism 120 has been driven but is not returned to the home position.

When the count value of the state counter is "6", the photosensor SE5 has been already turned on at step S178. Then it is confirmed that the pressure mechanism 120 has been securely returned, and the jam timer 2 for the pressure mechanism 120 is reset at step S179. Then it is judged at step S180 whether the copying operation has been completed. When the operation has not been completed, the value of the storing pressure state counter is set to "2" at step S183. When the image copying operation is completed, the main motor drive request flag is reset at step S181 and the value of the storing pressure state counter is reset to "0" at step S182.

(Control for Sheet Refeeding)

FIG. 33 is a flow chart showing a subroutine for the sheet refeeding control to be performed at step S8.

In the subroutine, the refeeding roller 161, the register rollers 170, the pressure mechanism 120, etc. are controlled based on a sheet refeeding signal, and the process of feeding sheets each of which already got an image on its first surface and has been stored in the intermediate storing section 90 to the copying machine 1 one after another is performed.

The subroutine comprises each of the subroutines S200, S201 and S202. At step S200, the stand-by, starting and stopping of the sheet refeeding operation are controlled in accordance with the count value of a sheet refeeding state counter. At step S201, the refeeding roller 161 and the register rollers 170 are controlled by turning on and off the clutches CL1 and CL2. At step S202, the pressure mechanism 120 is controlled.

FIG. 34 is a flow chart showing a subroutine for controlling the sheet refeeding state to be performed at step S200.

First, at step S210, the count value of the refeeding state counter is checked. The state counter is reset to "0" at the time of initialization. When the count value is "0", it is judged at step S211 whether the sheet presence flag is "1". When the sheet presence flag has been set to "1", i.e. there are sheets stored in the intermediate storing section 90, the refeeding state counter is set to "1" at step S212.

When it is judged at step S213 that the counter is set to "1", it is judged at step S214 whether the print switch signal is on-edge. When the switch signal is on-edge, a refeeding mode flag is set to "1" at step S215. When the refeeding mode flag is "1", it indicates that the sheet refeeding operation is being performed. Then the refeeding state counter is set to "2" at step S216.

When the results at steps S210 and S213 are both negative, it is judged at step S217 whether the intermediate storing section 90 is empty. In this stage, the absence of sheets is judged by the off timing of the photosensor SE4 for detecting sheet empty and a timer. When the intermediate storing section 90 is empty, i.e. all the sheets stored therein have been fed out, the refeeding mode flag is reset to "0" at step S218, and the regulation plates 105 and 140 are put back to the home positions respectively at step S219, and the refeeding state counter is reset to "0".

It is noted that the subroutine for setting the initial positions of the regulation plates to be performed at step S219 is the same as the process at step S52 described before (refer to FIGS. 25 and 26).

FIGS. 35*a*, 35*b*, 35*c* and 35*d* are flow charts showing a subroutine for controlling refeeding clutches to be performed at step S201.

In the subroutine, the following processes are performed in accordance with the count value of a clutch state counter. The state counter represents the judgement conditions for controlling the clutches CL1 and CL2 for the refeeding roller 161, the separation roller 163 and the register rollers 170 in accordance with the refeeding condition.

First, it is judged at step S240 whether the refeeding mode flag is "1". Only when the flag has been set to "1", the following steps are performed. More specifically, the count value of the clutch state counter is checked at step S241. When the count value of the state counter is "0", it is judged at step S242 whether a sheet transport permission signal represents "1". While a refed sheet is subjected to a register process by the register rollers 23 in the copying machine 1, the refeeding of the next sheet should be discontinued. For that purpose, the sheet transport permission signal is used. When the signal is "1", the sheet refeeding is permitted, and when it is "0", the sheet refeeding is inhibited. The signal is transmitted from the CPU 310 for the copying machine 1 to the CPU 300 in the interruption operation. Therefore, when the sheet transport permission signal has been set to "1", an interval timer is set at step S243, and the clutch state counter is set to "1" at step S244. The interval timer determines the timing for refeeding a sheet from the register rollers 170.

When the count value of the state counter is "1", it is judged at step S245 whether the sheet transport permission signal is "1". When the signal has been set to "1", the counting operation of the interval timer is continued at step S246. When the signal has been reset to "0", the counting operation of the timer is once stopped at step S247.

Next, it is judged at step S248 whether an open flag for the pressure mechanism 120 is "0". The open flag is set and reset in the subroutine for refeeding pressure mechanism control as described below. The reset condition of the open flag indicates that the pressure mechanism 120 presses the upper portion of the sheets, while the set condition of the open flag indicates that the pressure mechanism 120 is at the home position. Therefore, when the open flag for the pressure mechanism 120 is reset to "0" (the pressure mechanism 120 is in the pressing position), the clutches CL1 and CL2 are turned on at step S249. With this operation, the refeeding roller 161 and the separation roller 163 are driven to rotate, while the rotation of the register rollers 170 stops.

Then a refeeding jam timer is set at step S250, and the clutch state counter is set to "2" at step S251. In this place, the refeeding jam timer is used for detecting the occurrence of a sheet jam near the refeeding roller 161 and the separation roller 163 in combination with the photosensor SE3.

When the count value of the state counter is "2", it is judged at step S252 whether the sheet transport permission signal is "1". When the signal has been set to "1", the counting operations of the interval timer and the refeeding jam timer are continued at step S253, and the refeeding clutch CL1 is continued to operate at step S254. When the sheet transport permission signal has been reset to "0", the counting operations of the interval timer and the refeeding jam timer are once stopped at step S255, and the refeeding clutch CL1 is turned off at step S256.

Next, it is judged at step S257 whether the photosensor SE3 is on, i.e. the leading end of the refed sheet has reached the detection point of the photosensor SE3. When the photosensor SE3 has been turned on, the refeeding jam timer is reset at step S258, and a register timer and a feed-out jam timer are set at step S259. Then the clutch state counter is set to "3". In this stage, the register timer is used for preventing a swerving run of the sheet by forming a tiny loop at the leading portion of the sheet before the register rollers 170. The feed-out timer detects the occurrence of a sheet jam at the detection point of the photosensor SE3 in combination with the photosensor SE3 when the sheet does not pass through the detection point of the photosensor SE3 within a certain period (corresponding to the sum of the sheet length and a margin length).

When the count value the state counter is "3", it is judged at step S261 whether the refeeding permission signal is "1". When the signal has been set, the counting operations of the interval timer, the register timer and the feed-out jam timer are continued at step S262, and the on condition of the refeeding clutch CL1 is continued at step S263. Meanwhile, when the refeeding permission signal has been reset to "0", the counting operations of the interval timer, register timer and the feed-out jam timer are once stopped at step S264, and the refeeding clutch CL1 is turned on at step S265.

After the completion of the register timer operation is confirmed at step S266, the refeeding clutch CL1 is turned off at step S267. With this operation, the leading end of the refed sheet is subjected to the register process by means of the register rollers 170, and then the sheet is put in the standby condition as being formed with a tiny loop. Then the clutch state counter is set to "4" at step S268.

When the count value of the state counter is "4", it is judged at step S269 whether the refeeding permission signal is "1". When the signal has been set to "1", the counting operations of the interval timer and the feed-out jam timer are continued at step S270. When the refeeding permission signal has been reset to "0", the counting operations of the interval timer and feed-out jam timer are once stopped at step S271. Subsequently, when the completion of the interval timer operation is confirmed at step S272, the clutch CL2 is turned off and the clutch CL1 is turned on at step S273. With the turning-off of the clutch CL2, the register rollers 170 are started to rotate, while with the turning-on of the clutch CL1 the refeeding roller 161 and separation roller 163 are started to rotate. With these operations, the sheet is fed out from the register rollers 170 to the refeeding path 30 in the copying machine 1. In addition, It is noted that the simultaneous rotation of the rollers 161 and 163 together with the register rollers 170 is for securely feeding the leading end of the sheet into the nip portion of the register rollers 170.

Then a pressure mechanism open request flag is set to "1" at step S274, a refeeding assist timer is set at step S275 and the clutch state counter is set to "5" at step S276. In this place, the pressure mechanism open request flag designates the pressure mechanism 120 to retreat from the pressing position to the home position when the flag is set to "1". The refeeding assist timer obtains the timing for stopping the refeeding roller 161 and the separation roller 163 after the sheet is securely refed.

When the count value of the state counter is "5", it is judged at step S277 whether the feeding permission signal is "1". When the signal has been set to "1", the counting operations of the refeeding jam timer and the refeeding assist timer are continued at step S278, and the turning-on of the refeeding clutch CL1 and the turning-off of the register clutch CL2 are continued at step S279. When the refeeding permission signal has been reset to "0", the counting operations of the refeeding jam timer and the refeeding assist timer are once stopped at step S280, and the refeeding clutch CL1 is turned off and the register clutch CL2 is turned on at step S281.

Subsequently, when the completion of the assist timer operation is confirmed at step S282, the refeeding clutch CL1 is turned off at step S283. With this operation, the rotations of the refeeding roller 161 and the separation roller 163 are stopped, and the sheet is fed out from the intermediate storing section 90 by the rotation of the register rollers 170. In addition, it is noted that each of the rollers 161 and 163 rotate following with the feeding of the sheet by the operation of the one-way bearings. Then the clutch state counter is set to "6" at step S284.

When the count value of the state counter is "6", it is judged at step S285 whether the refeeding permission signal is "1". When the signal has been set to "1", the counting operation of the refeeding jam timer is continued at step S286, and the turning-off of the register clutch CL2 is continued at step S287. When the refeeding permission signal has been reset to "0", the counting operation of the refeeding jam timer is once stopped at step S288, and the register clutch CL2 is turned on at step S289 to once stop the sheet refeed.

Then it is judged at step S290 whether the photosensor SE3 is off, i.e. the trailing end of the refed sheet has passed the detection point of the photosensor SE3. When the photosensor SE3 has been turned on, the refeeding jam timer is reset at step S291, and the clutch state counter is reset to "0" at step S292.

FIGS. 36*a*, 36*b* and 36*c* are flow charts showing a subroutine for controlling the pressure mechanism at the sheet refeeding time to be performed at step S202.

In this subroutine, the following processes are performed in accordance with the count value of the refeeding state counter for the pressure mechanism 120. The state counter represents the judgment condition for controlling the operation of the pressure mechanism 120 in accordance with the copying condition and the sheet refeeding condition. It is noted that the control in this subroutine is basically the same as the control in the subroutine for the pressure mechanism 120 at step S42 as shown in FIGS. 32a, 32b and 32c.

First, it is judged at step S300 whether the refeeding mode flag is "1". When the flag has been reset to "0", the subroutine is terminated at once, and when the flag has been set to "1", the count value of the state counter is checked at step S301.

When the count value of the state counter is "0", after confirming at step S302 that the main motor M3 is in operation, the pressure mechanism 120 is reset to the home position at step S303. Then the pressure mechanism open request flag is reset to "0" at step S304, and it is judged at step S305 whether the resetting of the presure mechanism 120 has been completed. When it has been completed, the refeeding pressure state counter is set to "1" at step S306.

When the count value of the state counter is "1", it is judged at step S307 whether the photosensor SE5 is on. When the photosensor SE5 is on, i.e. the reset process at step S304 has been securely performed, the pressure mechanism open flag is set to "1" at step S308. Then the refeeding pressure state counter is set to "2" at step S309.

When the count value of the state counter is "2", it is judged at step S310 whether a copy request flag is "1". The copy request flag is set to "1" when the sheet refeeding signal is transmitted from the CPU 310 for the copying machine 1 to the CPU 300. When the copy request flag has been set to "1", the pressure mechanism 120 is driven at step S311. With this operation, the pressure mechanism 120 presses the leading end portion of the sheet in the intermediate storing section 90 and the operation is stopped once in this condition. Then it is judged at step S312 whether the above operation has been completed. When it has been completed, the refeeding pressure state counter is set to "3" at step S313.

When the count value of the state counter is "3", it is judged at step S314 whether the photosensor SE5 is off. Namely, it is judged by the on or off condition of the photosensor SE5 whether the drive of the pressure mechanism 120 at step S311 has been securely performed. When the photosensor SE5 is off, i.e. it is confirmed that the drive of the pressure mechanism 120 has been performed securely, the pressure mechanism open flag is reset to "0" at step S315, and the refeeding pressure state counter is set to "4" at step S316.

When the count value of the state counter is "4", it is judged at step S317 whether the pressure mechanism open request flag is "1". When the flag is set to "1", after resetting the flag to "0" at step S318, the pressure mechanism 120 is driven at step S319. With these operations, the pressure mechanism 120 retreats from the sheet pressing position.

In this procedure, a purpose of canceling the sheet pressing operation of the pressure mechanism 120 on the sheet is to prevent the increase of friction in refeeding sheets when the pressure mechanism 120 is placed in the sheet pressing position during the sheets are fed out from the intermediate storing position 90 by means of the register rollers 170. Another purpose is to put the subsequent sheets that have been unwillingly fed together with the present sheet and staying at the nip portion of the separation roller 163 and the separation pad 165 back into the stored position by its own gravity force. Subsequently, it is judged at step S320 whether the above-mentioned operation has been completed. When it has been completed, the refeeding pressure state counter is set to "5" at step S321.

When the count value of the state counter is "5", the photosensor SE5 is on at step S322. After it is confirmed at step S322 that the pressure mechanism 120 has been securely returned to the home position, the pressure mechanism open flag is set to "1" at step S323. Then a pressure mechanism drive delay timer is set at step S324, and the refeeding pressure state counter is set to "6" at step S325. The delay timer is in charge of a time control for setting the pressure mechanism 120 to the sheet pressing position before the refeeding roller 161 is driven to rotate for the refeeding of the next sheet.

When the count value of the state counter is "6", it is judged at step S326 whether the refeeding permission signal (as described in the clutch control subroutine for refeeding sheets) is "1". When the signal has been set to "1", the counting operation of the pressure mechanism drive delay timer is continued at step S327. When the signal has been reset to "0", the counting operation of the delay timer is stopPed once at step S328. Then when the completion of the delay timer is confirmed at step S329, the refeeding pressure state counter is set to "2" at step S330, and the above processes are repeated.

FIG. 37 is a flow chart showing a subroutine for detecting and treating a sheet jam to be performed at step S11. In this subroutine, when a sheet jam is detected occurring in any section of the storing/refeeding unit 40, a warning and a designation for removing the jammed sheet are dispatched.

First, it is judged at step S340 whether the jam flag is "0". The jam flag represents the occurrence of a sheet jam when it is set to "1". Therefore, when it has been set to "1", the processing immediately proceeds to step S347. When the jam flag is reset to "0", it is judged at steps S341 through S344 whether there occurred a sheet jam in each section. Namely, it is judged at steps S341 and S342 by the completion of the corresponding timer count whether a sheet jam occurred at the entrance section (refer to steps S167 and S176) in transporting sheets to the storing/refeeding unit 40. It is also judged at steps S343 and S344 by the completion of the corresponding timer count whether a sheet jam occurred at the exit section (refer to steps S250 and S259) in refeeding sheets. When a sheet jam takes place at any section, a jam signal is generated at step S345. In this procedure, the jam signal detected at steps S341 through S344 is transmitted to the CPU 310 for the copying machine 1.

Then the jam flag is set to "1" at step S346, and the subroutine for treating a sheet jam is performed at step S347.

Particularly, in this embodiment, when sheets are entering the intermediate storing section 90, the occurrence of a sheet jam at the entrance is found out by comparing an output signal of the photosensor SE5 for detecting the position of the pressure mechanism 12 with an output signal of the photosensor SE2 for detecting the condition of the sheet transport. Therefore, the occurrence of any sheet jam can be detected at an earl stage, and this arrangement minimizes sheet waste an prevents the abnormal operation load on the copyin machine 1.

Although the present invention has been described connection with the preferred embodiment thereof, it to be noted that various changes and modifications a apparent to those who are skilled in the art. Su changes and scope of the present invention as defin by the appended claims, unless they depart therefro For example, the above-mentioned embodiment co prises the function of refeeding sheets, but there may an alternative function of binding sheets with a stapler or a clip, or of merely storing sheets in a stack.

The stored posture of the sheets may be approximately horizontal instead of aforesaid approximately vertical condition. Generally, in a horizontal type of sheet storing/refeeding apparatus wherein sheets are stored one upon another, sheets fall down onto a sheet stack from the entrance. Accordingly, the separator 93 needs to be fitted horizontally and to regulate sheets so that the trailing end of each sheet entering the intermediate storing section will not cover the entrance. Therefore, in this case, the separator 93 is urged by a coil spring or the like so as to be set horizontally all the time.

In the above-described embodiment, a sorter 200 is mentioned as a sheet handling apparatus to be attached to the sheet storing apparatus downstream thereof. However, there may be alternatives such as a finisher unit having a function of stapling the stored sheets with a stapler or a clip, a stacker having a large capacity and so on. Further, there are various mechanisms for fitting and removing the diverter pawl 73 and the sheet tray 80 besides the one adopted in the embodiment above. It goes without saying that the sorter 200 and the diverter pawl 73 may be made in a fixed type.

In the embodiment above, an apparatus wherein sheets are transported making a switchback in the composite copying mode, but upon review of the constitution of the copying machine for which a storing/refeeding apparatus is provided, the apparatus may be so made that the switchback transportation of sheets are performed in the duplex copying mode. Although in the apparatus adopted to the embodiment, sheets are once stored in the intermediate storing section and then fed back to the copying machine, the apparatus may be so made that sheets are directly fed back to the copying machine without being stored.

Also, There are various kinds of processes of calculating a constant of the sheet storing apparatus from the system speed of the copying machine and adjusting the reference value of timing in accordance with the calculated constant besides the process described in the embodiment above.

What is claimed is:

1. A sheet storing apparatus attachable to an image forming apparatus, wherein sheets ejected from said image forming apparatus are stored, said sheet storing apparatus having a plurality of sections and comprising:
- a sheet path through which sheets are transported;
- means for detecting a sheet traveling in said sheet path; and
- control means for controlling the driving of each section in said sheet storing apparatus in acordance with an output of said detecting means, said control means comprising timer means for setting the timing of driving each section, input means for entering the speed of sheet transportation in said image forming apparatus, and means for adjusting the timing set by said timer means in accordance with the speed of the sheet transportation in said image forming apparatus entered by said input means.

2. A sheet storing apparatus as claimed in claim 1, wherein:
- said control means is a microcomputer repeating a program whose one routine is executed in a specified time;
- said timer means is a counter which counts the number of times of said microcomputer's repeating the program up to a specified number; and
- said adjusting means adjusts the specified number to be counted up by said timer means.

3. A sheet storing apparatus attachable to an image forming apparatus for receiving and storing sheets ejected from said image forming apparatus, said sheet storing apparatus comprising:
- a sheet path through which sheets are transported;
- means for detecting a sheet reaching a specified point;
- an actuating member which is driven when a sheet is transported from the specified point to be specifically distant therefrom;
- timer means for measuring a set period after detection of the sheet by said detecting means;
- control means responsive to said timer means for commanding and operation of said actuting member upon expiration of the set period of said timer means;
- input means for entering the speed of the sheet transportation in said image forming apparatus; and
- means for adjusting the set period of said timer means in accordance with the speed of the sheet transportation entered from said input means.

4. A sheet storing apparatus as claimed in claim 3, wherein said input means includes communication means for receiving data on the speed of the sheet transportation from said image forming apparatus.

5. A sheet storing apparatus as claimed in claim 4, wherein said communication means receives data on the speed of the sheet transportation from a control means of said image forming apparatus when a power supply is started.

6. A sheet storing apparatus as claimed in claim 3, wherein:
- said timer means includes a counter which counts the number of lapses of a predetermined short period; and
- said adjusting means calculates the distance of a sheet's being transported for the specified time using the entered data on the speed of the sheet transportation, divides the specified distance by the calculated distance and sets the result as a value of said counter.

7. A sheet storing apparatus attachable to an image forming apparatus, wherein sheets ejected from said image forming apparatus are stored, said sheet storing apparatus comprising:
- storing means wherein sheets are stored;
- means for transporting sheets ejected from said image forming apparatus to said storing means;
- means for aligning sheets transported to said storing means;
- means for detecting the condition of a sheet being transported from said image forming apparatus toward said storing means;
- input means for entering the speed of the sheet transportation in said image forming apparatus; and
- control means for generating a signal to drive said storing means, said transporting means and said aligning means in accordance with an output of said detecting means, which transmits the entered data on the speed of the sheet transportation into a constant and determines the respective timings of driving said storing means, said transporting means and aligning means by operations of a reference value and the constant.

8. A sheet storing apparatus as claimed in claim 7, wherein said input means includes communication means for receiving data on the speed of the sheet transportion from said image forming apparatus.

9. A sheet storing apparatus as claimed in claim 8, wherein said communication means receives data on the speed of the sheet transportation from a control means of said image forming apparatus when a power supply is started.

10. A method of controlling a sheet storing apparatus attachable to an image forming apparatus, wherein sheets ejected from said image forming apparatus are stored, said method comprising:

a step of storing data on the speed of the sheet transportation in said image forming apparatus;

a step of determining a value of a timer for the timing of driving each of a plurality of sections in said sheet storing apparatus, based on the stored data on the speed of the sheet transportation;

a step of starting said timer incorporated with the determined value in accordance with a condition of the sheet transportation; and a step of generating a signal for controlling each section in said sheet storing apparatus in response to the value of said timer.

11. A method of controlling a sheet storing apparatus as claimed in claim 10, further comprising a step of receiving data on the speed of the sheet transportation from the control means of said image forming apparatus.

12. A method of controlling a sheet storing apparatus as claimed in claim 11, wherein said data receiving step is executed when a power supply is started.

* * * * *